US009403056B2

(12) United States Patent
Weinberg et al.

(10) Patent No.: US 9,403,056 B2
(45) Date of Patent: Aug. 2, 2016

(54) MULTIPLE DEGREE OF FREEDOM REHABILITATION SYSTEM HAVING A SMART FLUID-BASED, MULTI-MODE ACTUATOR

(75) Inventors: Brian Weinberg, San Diego, CA (US); Paolo Bonato, Somerville, MA (US); Ozer Unluhisarcikli, Allston, MA (US); Mark Sivak, Boston, MA (US); Constantinos Mavroidis, Arlington, MA (US); Anat Mirelman, Ramat-Gan (IL); Lucas Daniel Johnson, Edmonds, WA (US); Nicholas J. Pappas, Tewksbury, MA (US); Kyle Thomas Hackmeister, Williamsport, PA (US); Daniel T. Lau, Waban, MA (US)

(73) Assignees: Northeastern University, Boston, MA (US); Spaulding Rehabilitation Hospital Corporation, Boston, MA (US)

( * ) Notice: Subject to any disclaimer, the term of this patent is extended or adjusted under 35 U.S.C. 154(b) by 1197 days.

(21) Appl. No.: 13/257,492

(22) PCT Filed: Mar. 22, 2010

(86) PCT No.: PCT/US2010/028121

§ 371 (c)(1), (2), (4) Date: Dec. 1, 2011

(87) PCT Pub. No.: WO2010/108170

PCT Pub. Date: Sep. 23, 2010

(65) Prior Publication Data

US 2012/0109025 A1 May 3, 2012

Related U.S. Application Data

(60) Provisional application No. 61/162,087, filed on Mar. 20, 2009, provisional application No. 61/302,666, filed on Feb. 9, 2010, provisional application No. 61/162,087, filed on Mar. 20, 2009.

(51) Int. Cl.
*A61H 1/02* (2006.01)
*A63B 23/14* (2006.01)
(Continued)

(52) U.S. Cl.
CPC ..... *A63B 23/14* (2013.01); *A61H 1/0285* (2013.01); *A61H 1/0288* (2013.01);
(Continued)

(58) Field of Classification Search
CPC ..... A61H 1/00; A61H 1/02; A61H 1/0274; A61H 1/0285; A61H 2001/0203; A61H 2201/1215; A61H 2201/123; A61H 2201/1238; A61H 2201/1409; A61H 1/0288; A63B 21/0081; A63B 23/14; A63B 23/16; A63B 2024/0096; A63B 2021/0082; A63B 2022/0094; A63B 24/0087; A63B 21/4049; A63B 21/4045; A63B 71/0622; A63B 21/4035; A63B 21/00181; A63B 21/00178; A63B 21/00845; A63B 21/008
USPC ..... 601/5, 23, 33, 34, 35, 40
See application file for complete search history.

(56) References Cited

U.S. PATENT DOCUMENTS 4,889,108 A * 12/1989 Bond et al. ..... 601/34
5,429,140 A 7/1995 Burdea et al.

(Continued)

*Primary Examiner* — Quang D Thanh
(74) *Attorney, Agent, or Firm* — Wilmer Cutler Pickering Hale and Dorr LLP

(57) ABSTRACT

A rehabilitation system that combines robotics and interactive gaming to facilitate performance of task-specific, repetitive, upper extremity/hand motor tasks, to enable individuals undergoing rehabilitation to improve the performance of coordinated movements of the forearm and hand is disclosed. More specifically, the rehabilitation system includes a two degree-of-freedom (DOF) robotic, upper limb rehabilitation system and interactive gaming hardware that is coupled to a computer, to provide a virtual reality-like environment.

31 Claims, 32 Drawing Sheets

(51) Int. Cl.

| | |
|---|---|
| ***A63B 23/16*** | (2006.01) |
| ***A63B 21/008*** | (2006.01) |
| ***A63B 71/06*** | (2006.01) |
| ***A63B 21/00*** | (2006.01) |
| *A63B 22/00* | (2006.01) |
| *A63B 24/00* | (2006.01) |

(52) U.S. Cl.

CPC ..... *A63B 21/008* (2013.01); *A63B 21/00178* (2013.01); *A63B 21/00181* (2013.01); *A63B 21/00845* (2015.10); *A63B 21/4035* (2015.10); *A63B 21/4045* (2015.10); *A63B 21/4049* (2015.10); *A63B 23/16* (2013.01); *A63B 24/0087* (2013.01); *A63B 71/0622* (2013.01); *A61H 2201/12* (2013.01); *A61H 2201/1635* (2013.01); *A61H 2201/1664* (2013.01); *A61H 2201/1671* (2013.01); *A61H 2201/1676* (2013.01); *A61H 2201/5002* (2013.01); *A61H 2201/5007* (2013.01); *A61H 2201/5058* (2013.01); *A63B 2022/0094* (2013.01); *A63B 2024/0096* (2013.01); *A63B 2071/0638* (2013.01)

(56) References Cited

U.S. PATENT DOCUMENTS

| | | | | |
|---|---|---|---|---|
| 5,466,213 | A * | 11/1995 | Hogan et al. | 601/33 |
| 5,721,566 | A | 2/1998 | Rosenberg et al. | |
| 6,162,189 | A | 12/2000 | Girone et al. | |
| 6,283,859 | B1 | 9/2001 | Carlson et al. | |
| 2008/0070752 | A1 | 3/2008 | Einav | |
| 2008/0294074 | A1 * | 11/2008 | Tong et al. | 601/5 |
| 2009/0017993 | A1 | 1/2009 | Khanicheh et al. | |

* cited by examiner

MULTIPLE DEGREE OF FREEDOM REHABILITATION SYSTEM HAVING A SMART FLUID-BASED, MULTI-MODE ACTUATOR

CROSS REFERENCE TO RELATED APPLICATIONS

This application is a national state filing under 35 U.S.C. §371 of International Application PCT/US2010/028121, filed Mar. 22, 2010, entitled A MULTIPLE DEGREE OF FREEDOM REHABILITATION SYSTEM HAVING A SMART FLUID-BASED MULTI-MODE ACTUATOR, and claims the benefit of priority of U.S. Provisional Patent Application No. 61/162,087 filed Mar. 20, 2009, U.S. Provisional Patent Application No. 61/267,193 filed on Dec. 7, 2009, and U.S. Provisional Patent Application No. 61/302,666 filed on Feb. 10, 2010, all of which are incorporated herein by reference.

STATEMENT REGARDING FEDERALLY SPONSORED RESEARCH OR DEVELOPMENT

N/A

BACKGROUND OF THE INVENTION

1. Field of the Invention

A rehabilitation system that combines robotics and interactive gaming to facilitate performance of task-specific, repetitive, upper extremity/hand motor tasks, to enable individuals undergoing rehabilitation to improve the performance of coordinated movements of the forearm and hand is disclosed. More specifically, the rehabilitation system includes a two degree-of-freedom (DOF) robotic, upper limb rehabilitation system and interactive gaming hardware that is coupled to a computer, to provide a virtual reality-like environment.

2. Summary of the Prior Art

Stroke is a major cause of disability in the United States with approximately 800,000 new cases reported annually, of which about 150,000 die. Typically, there are over 4.5 million stroke survivors in the population at any given time. Limited motor recovery in the paretic upper limb accounts for a large share of the disabling sequelae. Indeed, only about a small percentage of stroke sufferers with initial complete upper limb paralysis ever recover functional use of the limb during their lifetime.

The physical effects of stroke are variable and may include impairment in motor and sensory systems, language, perception, emotional and cognitive function. Impairment of motor function usually involves paralysis or paresis of the muscles on the side of the body that is contralateral to the side of the brain lesion. Of all impairments that result from stroke, perhaps the most disabling is hemiparesis of the upper limb.

Population-based statistics indicate that between 73% and 88% of first-time strokes result in an acute hemiparesis of the upper and/or lower limbs. The upper limbs are of special concern because the impact of upper-extremity impairments on disability, independence, and quality of life is so marked. Consequently, improvement in motor abilities, and, more specifically, functional use of the upper extremity, is considered one of the primary goals in post stroke rehabilitation. However, even with rehabilitation, the functional recovery of arm and hand use is generally limited when compared with that of the lower extremities.

Traumatic brain and incomplete spinal cord injuries are other conditions that often leave patients with similar impairments and functional limitations. In both instance, the injury sustained is lifelong.

Traumatic Brain Injury (TBI) is a worldwide major public health problem. The Center for Disease Control and Prevention (CDC) estimates that 235,000 Americans are hospitalized annually with TBI and survive. Sadly, approximately 80,000 of these survivors—roughly one-third of the total—are left with long-term disability. An estimated 10,000 or more who sustain TBI, but are not hospitalized, also become disabled each year.

Long-term disability after TBI includes problems with motor control, i.e., weakness, spasticity, and instability; cognition, i.e., thinking, memory, and reasoning; sensory processing, i.e., sight, hearing, touch, taste, and smell; communication, i.e., expression and understanding; and behavior or mental health, i.e., depression, anxiety, personality changes, aggression, acting out, and social inappropriateness. The CDC estimates the prevalence of disability resulting from TBI in the U.S. to be 5.3 million. Moreover, the annual direct and indirect costs including those due to work loss and disability have been estimated at $60 billion. The incidence of TBI has been exacerbated by the conflicts in Iraq and Afghanistan where, tragically, TBI has become one of the most prevalent injuries among soldiers.

Spinal Cord Injury (SCI) requires on-going, multiple disciplinary efforts to stabilize, diminish or prevent secondary impairments and complications and to improve or maintain social role functioning and quality of life for the individual throughout the remainder of his/her life. There are approximately 250,000 persons with SCI in the United States, and an additional 10,000 sustain SCI injuries annually. The estimated annual national economic impact of SCI is about $9.73 billion.

Because the average age at time of an SCI is 32, specialized care is necessarily long-term. Persons with SCI have increasingly longer life expectancies, and as they age they risk developing secondary conditions. Over 50% of people with SCI have cervical injuries resulting in plegia of all four extremities (tetraplegia) leading to impairments in both mobility as well as independence in activities of daily living. Out of all cervical injuries leading to tetraplegia more then 50% are incomplete, resulting in paresis, which is the ability to perform impaired or inefficient movements.

Stroke/TBI/SCI survivors historically receive intensive, hands-on physical and occupational therapy to encourage motor recovery. However, due to economic pressures on the U.S. health care system, individuals are receiving less therapy and are being discharged from rehabilitation hospitals and clinics sooner than formerly was the case.

Robotic training is a new technology that shows great potential for application in the field of neuro-rehabilitation in either an in-patient or an out-patient setting. Robotic training has several advantages, e.g., adaptability, data collection, motivation, alleviation of patient safety concerns, and the ability to provide intensive individualized repetitive practice. Studies on the use of robotic devices for upper extremity rehabilitation after stroke have shown significant increases in upper limb function, dexterity and fine motor manipulations, as well as improved proximal motor control.

However, there are no available training devices that enable flexion/extension movements of the fingers and the hand in conjunction with supination/pronation of the forearm. These movements are synergistic and important to daily functional tasks such as eating, dressing, and grooming. Consequently, a robotic device that facilitates the performance of coordinated forearm pronation/supination movements and trains hand grasp/release movements would be highly desirable because recovery of these movements is a problem in the rehabilitation of individuals post stroke.

SUMMARY OF THE INVENTION

Although traditional rehabilitation techniques address the need for targeting the recovery of upper extremity motor skills via physical therapy protocols based on a one-to-one interaction between a therapist and a patient, they are limited in providing high intensity, high repetition training. The use of robotics has the potential to provide such training at a cost that is compatible with the financial constraints that mark the health care system in the U.S. and elsewhere in the world and, furthermore, to expand the scope of rehabilitation training. The invention herein described fills a gap in the current offering of robotic systems for rehabilitation. The invention targets coordinated movements of the forearm and of the hand and individual fingers—a key aspect of rehabilitation in several groups of patients who show limited motor ability in the control of the upper extremities.

In one embodiment, a two degree-of-freedom robotic interface includes a smart fluid actuator system, which has a first, smart fluid-based, e.g., magneto-rheological fluid (MRF), electro-rheological fluid (ERF), and the like, actuator and a second, smart fluid-based actuator, the two actuators being structured and arranged to operate in either a linear mode or a rotary mode. In both linear and rotary modes, the smart fluid-based actuator is structured and arranged to selectively apply a controllable motive force or a damping force on demand.

Each of the actuators is capable of operating in at least one of a pure damping mode, a pure braking mode, a pure actuation mode. Preferably, the first and second smart fluid-based actuators are positioned in-line with respect to each other and/or concentric with one another, the first smart fluid-based actuator providing linear actuation and the second smart fluid-based actuator providing rotary actuation. Alternatively, the first smart fluid-based actuator and the second smart fluid-based actuator are disposed perpendicular to one another; the first smart fluid-based actuator providing linear actuation and the second smart fluid-based actuator providing "rotary" actuation by converting rotary movement into linear translation via a rack-and-pinion device.

The addition of an external hydraulic circuit to a smart fluid-based, e.g., ERF, damper allows the actuator to benefit from the controllability and response time of the smart (control) fluid. The close proximity of the main valve of the actuator to the piston provides an improved solution to controlling the hydraulic system. The external hydraulic circuit includes at least one of a pump assembly(ies); a plurality of hydraulic lines that are fluidly coupled between each of the at least one pump assembly(ies) and at least one actuator portion of the robotic interface; and a sensing device(s).

Optionally, the hydraulic circuit can also include a manifold. The manifold switches and modulates the flow of smart fluid from the pump assembly, which pumps in a single direction, through the actuator.

The controller includes a first processing device and a second processing device that are adapted to inter-communicate. The first processing device can provide a hosting function and is adapted to communicate with and between at least one of the second processing device, a patient/user's graphical display device, and a third-party graphical display device, which could be used, e.g., for monitoring a patient/user's performance. The second processing device provides a real-time operating system that is electrically coupled to the robotic interface device to receive data signals therefrom and to transmit control data thereto.

The control hardware is connected to a computer or similar gaming console that provides a virtual reality simulation in order to enhance motor learning by engaging patients in the therapeutic exercise via interactive gaming. The simulation presents visuomotor integration tasks to the patient as part of the games or scenes and challenges the patients with cognitive and problem solving tasks embedded in the games. The gaming console can be an optional feature of the system.

An optional gaming interface includes at least one input/output device that is structured and arranged to enable a patient/user to interact with software being executed on the gaming interface; and a display device that is adapted to display graphical images that are representative of the patient/user's manipulation of the robotic interface.

Although the multi-mode actuators are component parts of the rehabilitation system, the invention also includes stand-alone multi-mode actuators for general application that can be controlled to produce at least one of a desired motive force and a desired resistive force. The actuator can include a linear, smart fluid-based actuator portion and a rotary, smart fluid-based actuator portion, e.g., a fixed-vane type actuator and a sliding-vane type actuator. Alternatively, the actuator can include a pair of linear, smart fluid-based actuator portions that are disposed perpendicular to each other.

Each of the smart fluid-based actuator portions has an integral, smart fluid-based valve. The smart fluid-based valves are disposed within a housing and structured and arranged to provide at least one channel between a first electrode and a second electrode, one of said electrodes going to ground and another of said electrodes being electrically-coupled to the power supply, to activate the smart fluid when current or high voltage are distributed to the electrode that is electrically coupled to the power supply, to increase the yield strength of the smart fluid. Alternatively, the smart fluid-based valves are disposed within a housing and structured and arranged to provide at least one channel between a first electrode and a second electrode, one of said electrodes going to ground and another of said electrodes being electrically-coupled to the power supply, to activate the smart fluid when current or high voltage are distributed to the electrode that is electrically coupled to said power supply, to control a pressure drop across said valves.

BRIEF DESCRIPTION OF THE DRAWINGS

The invention is pointed out with particularity in the appended claims. The advantages of the invention described above, together with further advantages, may be better understood by referring to the following description taken in conjunction with the accompanying drawings. The drawings are not necessarily drawn to scale, and like reference numerals refer to the same parts throughout the different views.

DETAILED DESCRIPTION OF PREFERRED EMBODIMENTS OF THE INVENTION

The mechatronic, hand rehabilitation system disclosed herein includes hardware and software components, which are described in greater detail below. The performance of the entire hand rehabilitation system depends on the proper selection and matching of components, which include simple mechanical elements such as gears and bearings as well as more advanced devices such as servo drives. The hardware components of the hand rehabilitation system include a multiple, e.g., two, degree-of-freedom (DOF) robotic hand rehabilitation interface; a gaming interface; and a computer-based controller with a data acquisition system.

A multiple degree-of-freedom hand rehabilitation system was described in U.S. Provisional Patent Application No. 61/162,087 filed on Mar. 20, 2009, which is incorporated herein in its entirety by reference. Although this disclosure will describe the hand rehabilitation system and the robotic hand rehabilitation interface in terms of only two degrees-of-freedom, those of ordinary skill in the art can appreciate that a more sophisticated system with additional degrees-of-freedom, i.e., greater than two, can be manufactured in accordance with the teachings of this disclosure.

Figure 1:
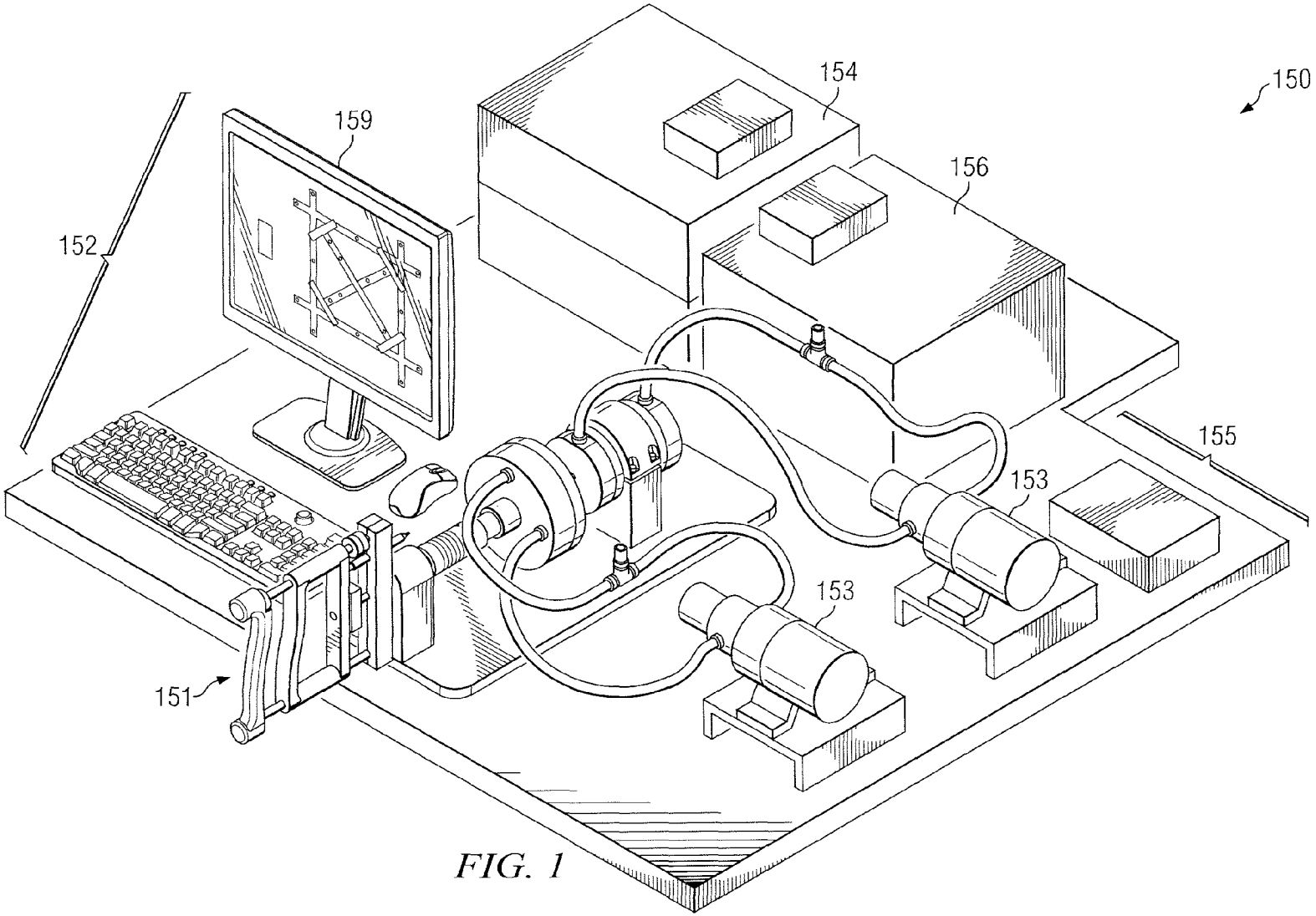
FIG. 1 shows a two degree-of-freedom robotic hand rehabilitation system according to the invention as claimed.

Referring to FIG. 1, an illustrative embodiment of a multiple DOF robotic hand rehabilitation system 150 is shown. The system 150 shown includes a multiple, e.g., two, DOF robotic interface 151 having a translatable, rotatable, ergonomic handle assembly, a multi-mode actuator system, and at least one sensing device; a multiple-dimension gaming interface 152 that includes a display device 159, an input/output (I/O) interface, and related software for generating display gaming images; a hydraulic circuit 155, which includes a pump assembly 153; a power supply 154; and a controlling system 156.

Multiple DOF Robotic Interface

A variable resistance hand rehabilitation device was disclosed in U.S. patent application Ser. No. 12/475,821 filed Jun. 1, 2009, which claims the benefit of U.S. Provisional Patent Application No. 61/130,484 filed on May 30, 2008, which are both incorporated herein in their entirety by reference. An ergonomic handle for a two DOF robotic hand rehabilitation device was disclosed in U.S. Provisional Patent Application No. 61/267,193 filed on Dec. 7, 2009, which is also incorporated herein in its entirety by reference.

Figure 2A:
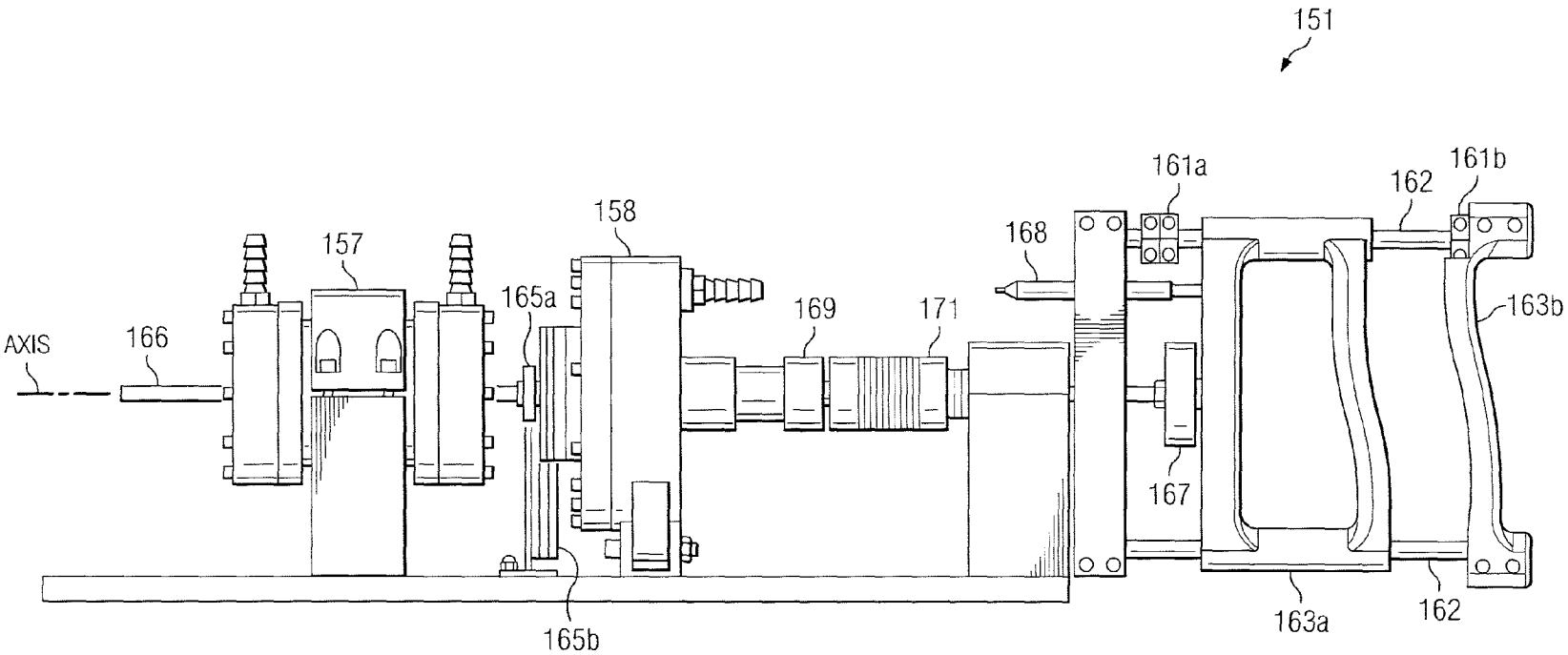
FIG. 2A shows a diagrammatic view of an in-line, two degree-of-freedom hand rehabilitation interface according to the invention as claimed.

A two DOF, robotic hand rehabilitation interface 151 having a handle assembly 163 that is adapted to translate along and to rotate about an axis of rotation (AXIS) and that is in operational communication with in-line, concentric linear and rotary actuators 157 and 158 is shown in FIG. 2A. The interface 151 and, more particularly, the actuators 157 and 158 are adapted to provide resistive active movement in response to patient/user translational motion during grasp/release hand movement and/or to rotational motion in response to supination/pronation movement of the forearm; as well as to provide active forces and/or torques to assist, e.g., to guide, the patient/user's motions. Each of the linear actuator 157 and the rotary actuator 158 is directly and operatively coupled to the handle assembly 163 via an output shaft 166.

The linear portion, i.e., the grasp/release portion, of the interface 151 extends between the linear actuator 157 disposed at a first, distal end of the interface 151 and the handle assembly 163 disposed at the proximate end of the interface 151. An output shaft 166 extends along the axis of rotation (AXIS), operatively coupling the handle assembly 163 to the linear actuator 157. In pertinent part, the output shaft 166 is adapted to pass through openings provided in the housing portion of the linear actuator 157 so that activation of smart (control) fluid flowing into and within the linear actuator 157 can be used to modify the resistive force of the output shaft 166 to translational forces. Although FIG. 2A shows two actuators 157 and 158, those of ordinary skill in the art can appreciate that the design could include a single actuator or more than two actuators.

At or near the handle assembly 163 (at the proximate end), the output shaft 166 can be releasably and mechanically attached to a first sensing device, e.g., a load cell 167, which can, in turn, be releasably and mechanically attached to the translating handle portion 163*a* of the handle assembly 163. Load cells 167 are well known to the art and will not be discussed in detail. Preferably, the load cell 167 is adapted to provide pressure and/or strain data directly to the controlling system 156.

A second sensing device, e.g., a linear potentiometer 168, can also be attached to the translating handle 163*a*, to measure absolute position of the translating handle 163*a* with respect to the stationary handle 163*b* or another fixed position. Linear potentiometers 168 are well known to the art and will not be discussed in detail. Preferably, the linear potentiometer 168 is adapted to provide displacement data directly to the controlling system 156.

The rotary portion, i.e., the supination/pronation portion, of the interface 151, extends between the rotary actuator 158 and the handle assembly 163. The output shaft 166 is adapted to pass through openings provided in the exterior of the rotary actuator 158 so that activation of smart fluid flowing into and within the rotary actuator 158 can modify the resistive force of the output shaft 166. Hard stops 161*a* and 161*b* can be installed or disposed on one of both of the parallel linear shafts 162, to adjust maximum and minimum allowable handle stroke in a rotational direction.

At or near the distal end, on a distal side of the rotary actuator 158, a third sensing device, e.g., an extension spring potentiometer 165*a* and its corresponding pulley 165*b*, is disposed. The extension spring potentiometer 165*a* is adapted to measure the absolute angle of the handle assembly 163 with respect to the "neutral position" of the interface 151. Potentiometers 165*a* are well known to the art and will not be discussed in detail. Preferably, the potentiometer 165*a* is adapted to provide rotational velocity and/or rotational displacement data directly to the controlling system 156.

On the opposite, proximate side of the rotary actuator 158, a fourth sensing device, e.g., a torque cell 169, can be operatively coupled to the output shaft 166, e.g., using a rotary actuator adapter (not shown) that is adapted to lock the rotation of the interior vane disposed within the rotary actuator 158 and the output shaft 166 to the torque cell 169. A helical shaft coupling (not shown) can be used to couple the torque cell 169 to a flexible shaft coupling 171. The flexible shaft coupling 171 prevents binding of the output shaft 166 by compensating for any non-concentricity.

A reaction torque sensor, such as a torque cell 169, measures torque, i.e., a force associated with the clockwise or counterclockwise rotation of the handle assembly 163 about the axis (AXIS) and, resultingly, the output shaft 166, directly. Preferably, the torque cell 169 is adapted to provide torque, rotational velocity, and/or rotational displacement data directly to the controlling system 156.

Figure 2B:
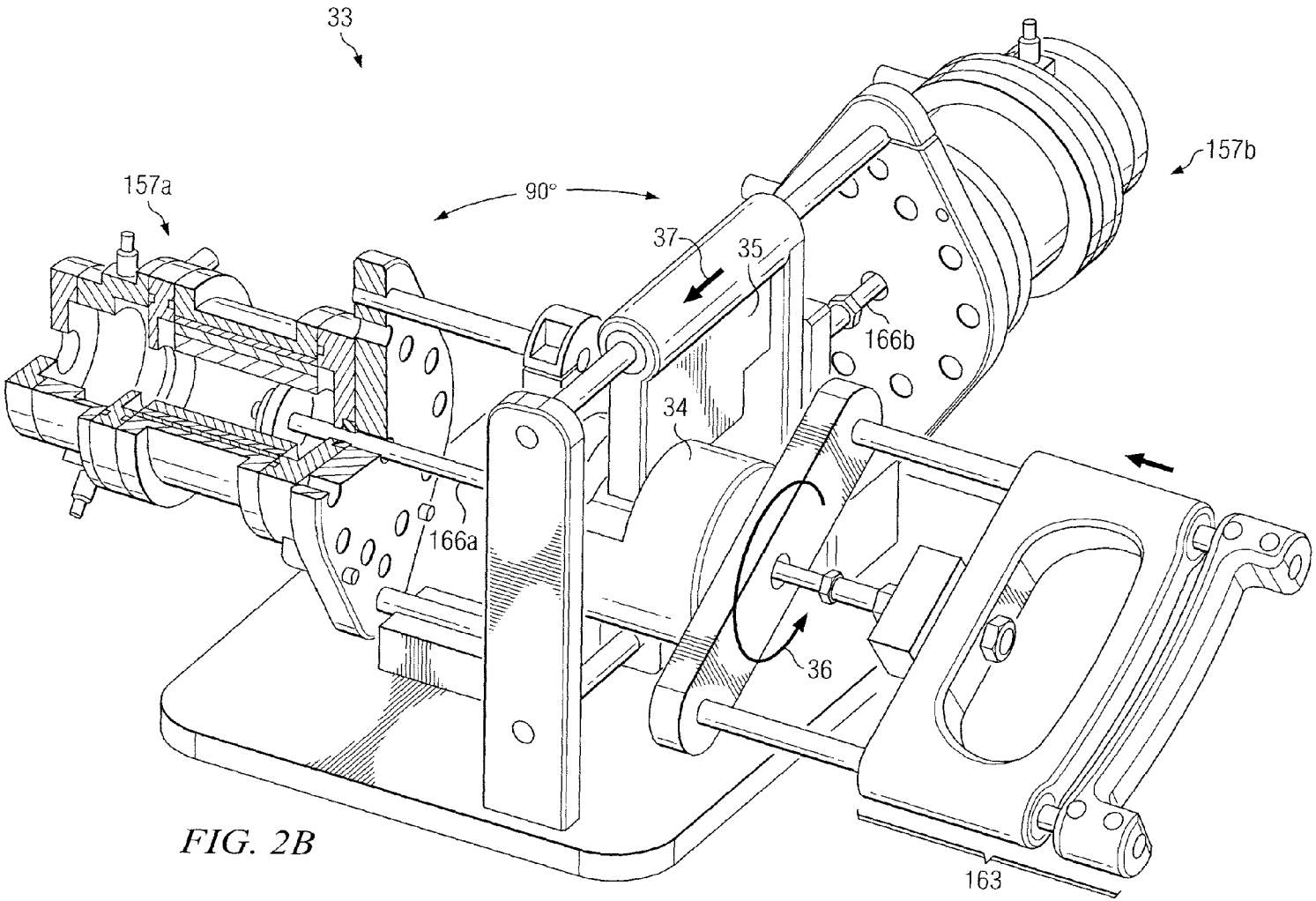
FIG. 2B shows a diagrammatic view of two degree-of-freedom hand rehabilitation interface having linear actuators disposed at 90-degrees from each other according to the invention as claimed.

Although the robotic interface 151 has been and will be described hereinafter as having in-line, concentric and coaxial linear and rotary actuators 157 and 158, alternatively, as shown in FIG. 2B, the robotic interface 151 can also be designed to employ a pair of linear actuators 157*a* and 157*b* that are structured and arranged in a 90-degree configuration 33. A first linear actuator 157*a* can be disposed in-line with and coaxial with an output shaft 166*a* for grasp/release motion. A second linear actuator 157*b* can be disposed perpendicular to or normal to the axis of rotation of the output shaft 166*a*.

With this embodiment, the handle assembly 163 is further mechanically coupled to a gear system, e.g., a precision rack-and-pinion gear system 34, that is adapted to convert pronation/supination-related rotation of the handle assembly 163 into linear motion of the output shaft 166*b*. More specifically, as shown in FIG. 2B, the gear system 34 converts counterclockwise rotation 36 of the handle assembly 163 into linear displacement 37 of a rack slide 35 in the direction of the output shaft 166*b* of the second linear actuator 157*b*. Thus, torque is converted to linear force, which can be measured using, for example, a load cell that is mounted on a rack slide 35.

The handle assembly 163 shown in FIG. 2A and FIG. 2B restrains the metacarpophalangeal (MCP) joint, requiring the distal interphalangeal (DIP) joint and the proximal interphalangeal (PIP) joint, respectively, the second and third joints on the fingers, to execute a grasping motion. This movement, however, can be very uncomfortable.

Figure 26:
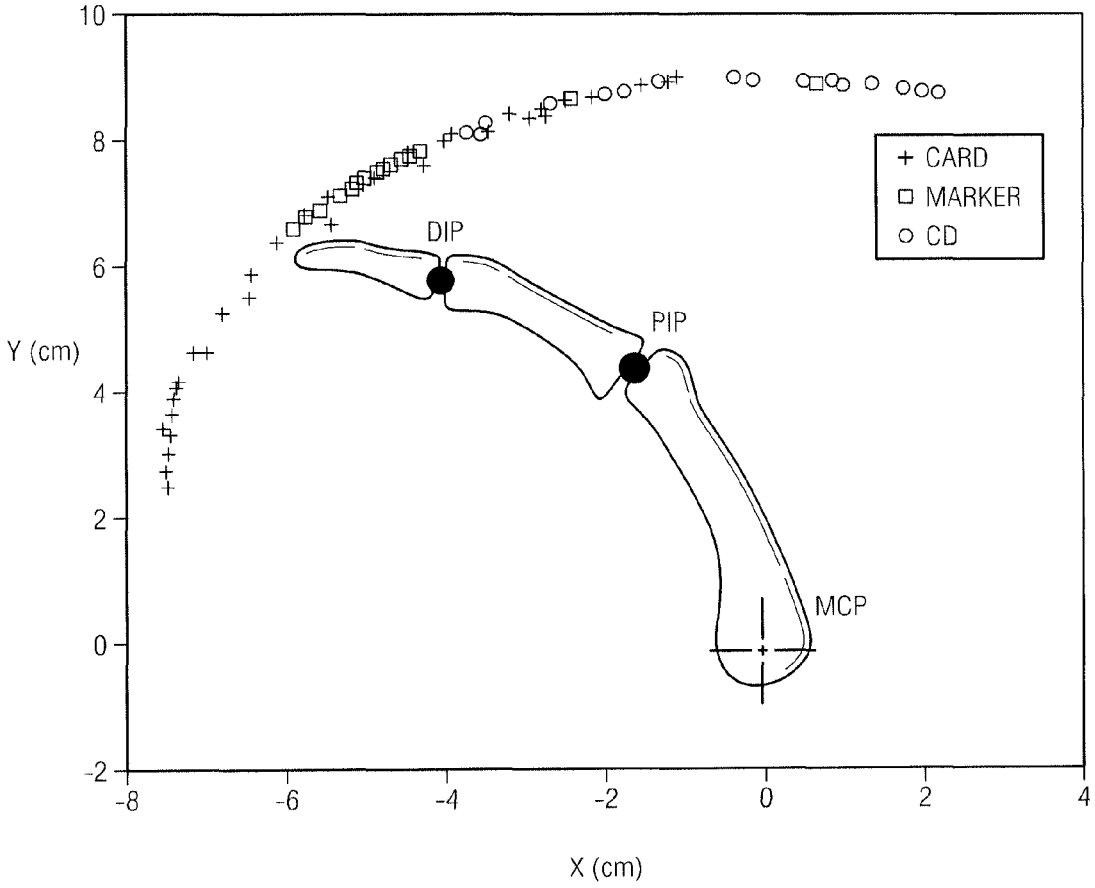
FIG. 26 shows a diagrammatic view of the log spiral trajectory of a fingertip pivoting about the MCP joint.

To address the possible discomfort, an ergonomic handle assembly for inclusion in the hand rehabilitation system has been designed to allow one to achieve a natural finger and finger joint trajectory during grasp/release motions, which is to say using the MCP joint as a pivot and the finger tips following a spiral or log spiral motion rather than a linear motion (FIG. 26).

Figure 27:
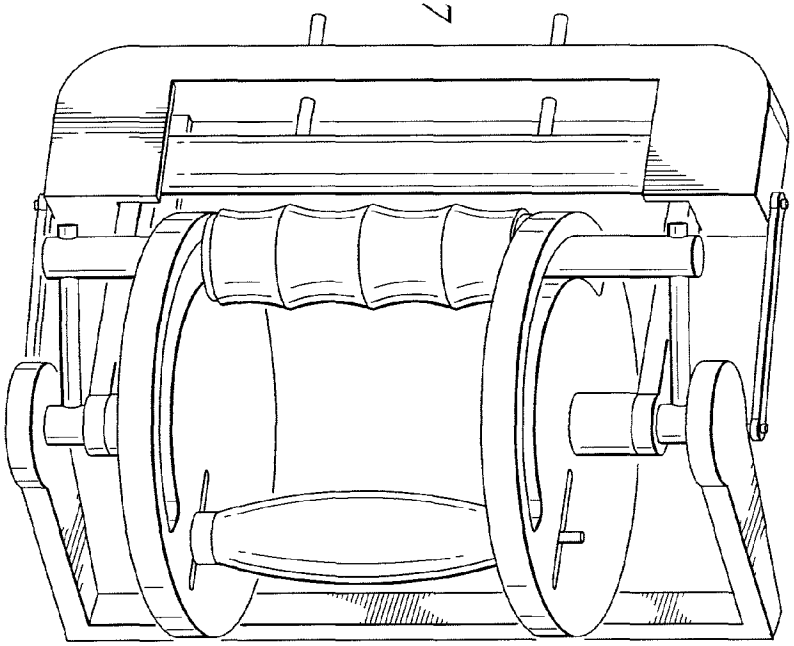
FIG. 27 shows a first diagrammatic view of a sweeper-type handle assembly.
Figure 28:
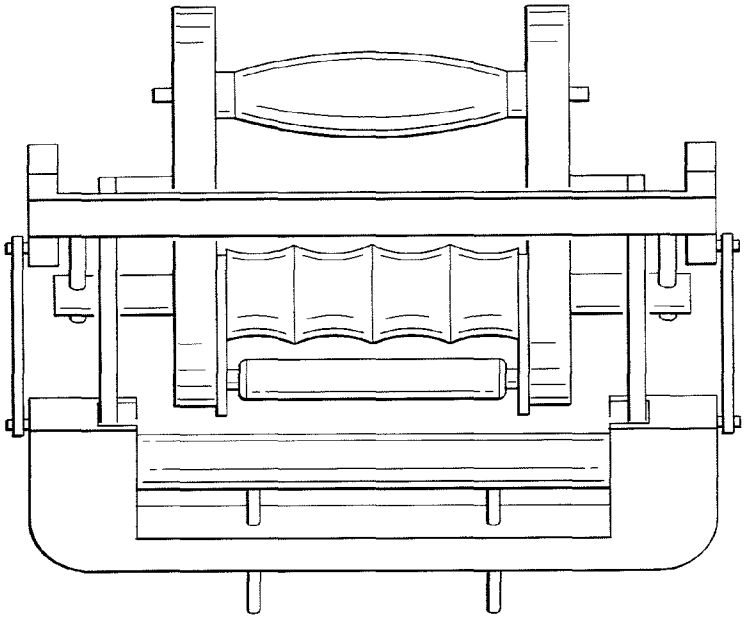
FIG. 28 shows a second diagrammatic view of a sweeper-type handle assembly.
Figure 29:
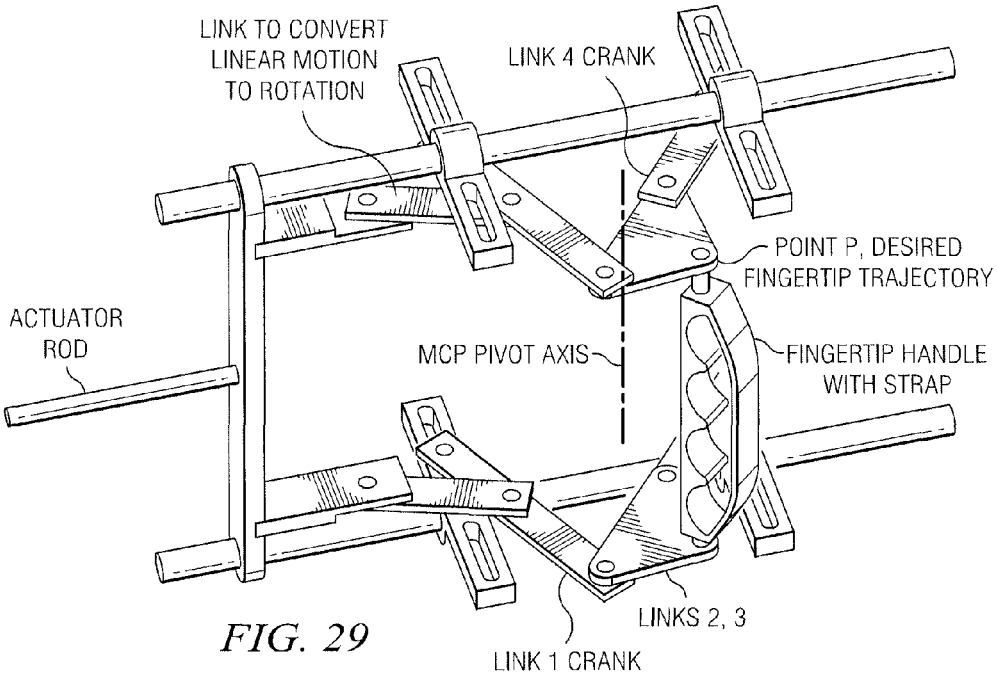
FIG. 29 shows a first diagrammatic view of a four-bar mechanism handle assembly.
Figure 30:
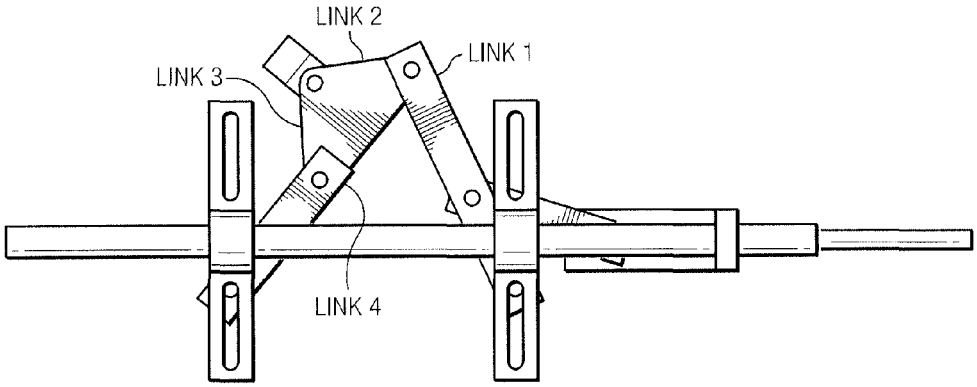
FIG. 30 shows a second diagrammatic view of a four-bar mechanism handle assembly.
Figure 31:
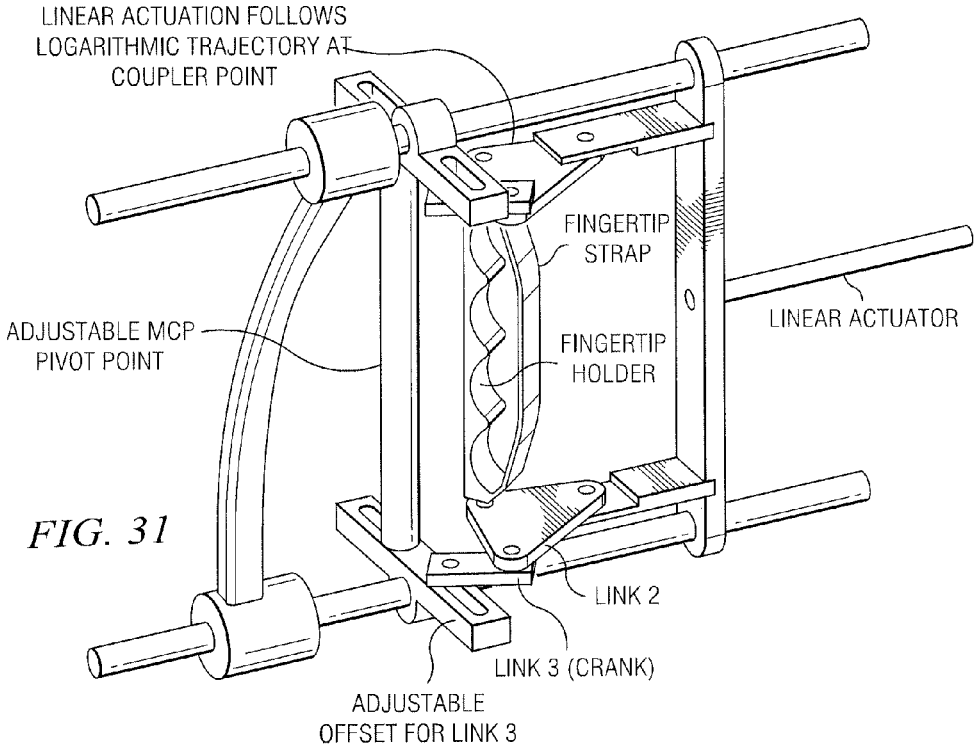
FIG. 31 shows a first diagrammatic view of a slider/crank handle assembly.
Figure 32:
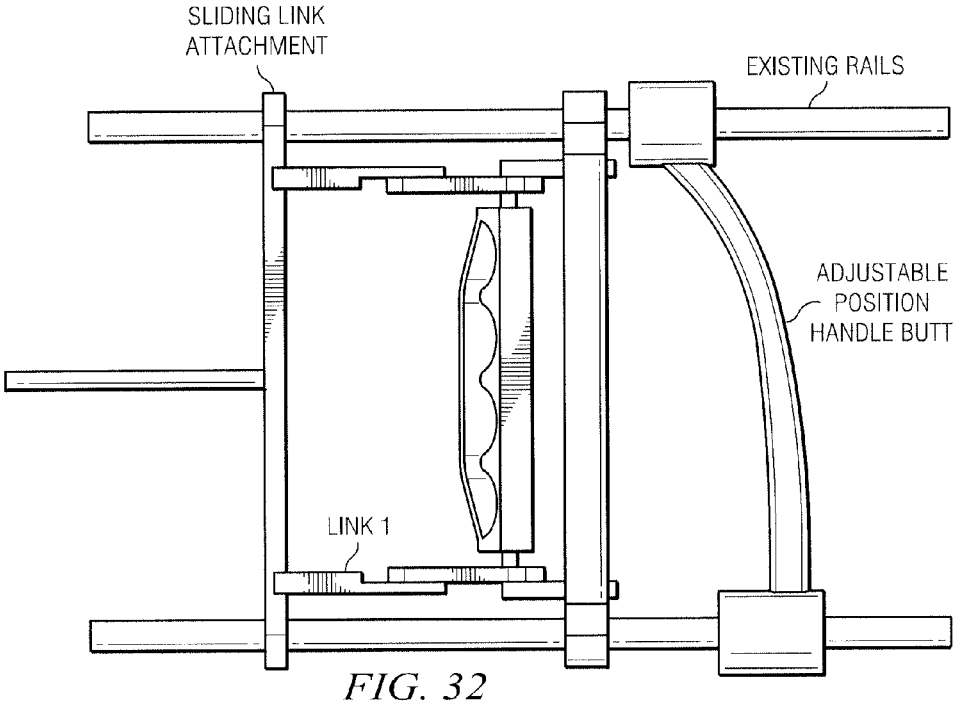
FIG. 32 shows a second diagrammatic view of a slider/crank handle assembly.
Figure 33:
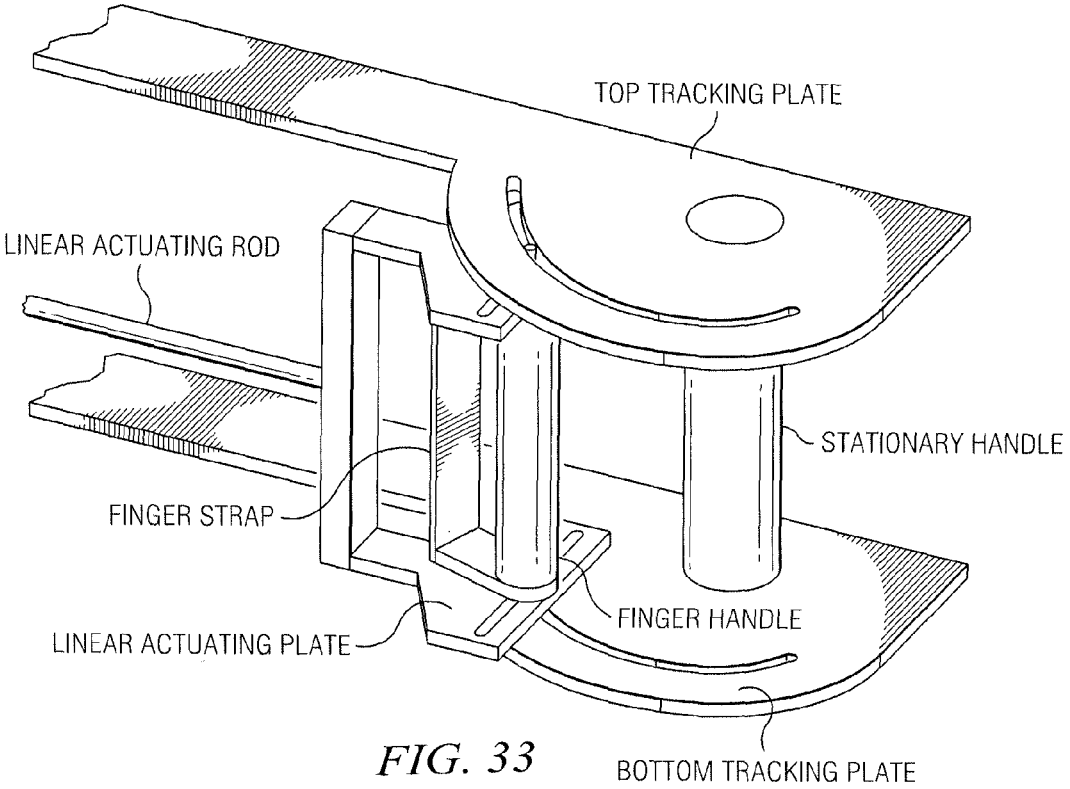
FIG. 33 shows a diagrammatic view of a "tracking plate" handle assembly.
Figure 34:
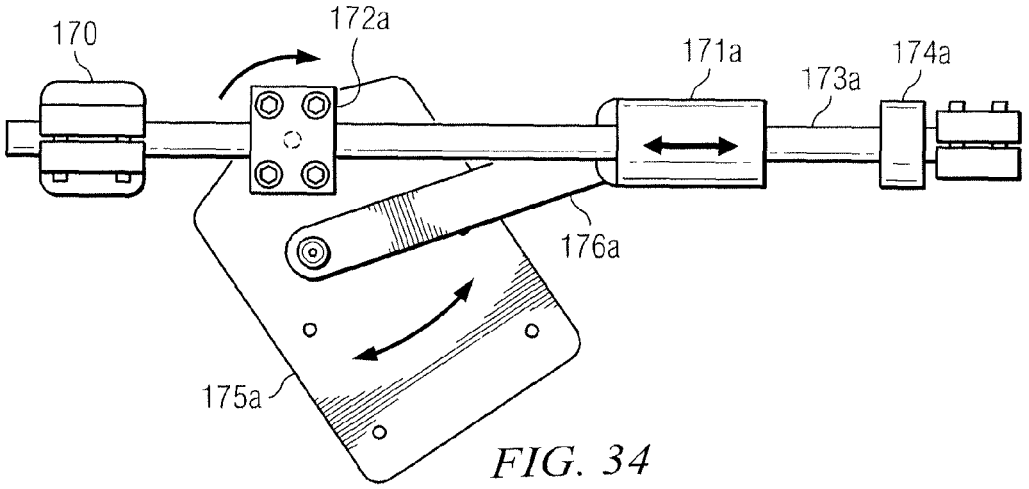
FIG. 34 shows a first diagrammatic (plan) view of a paddle-type handle assembly.
Figure 35:
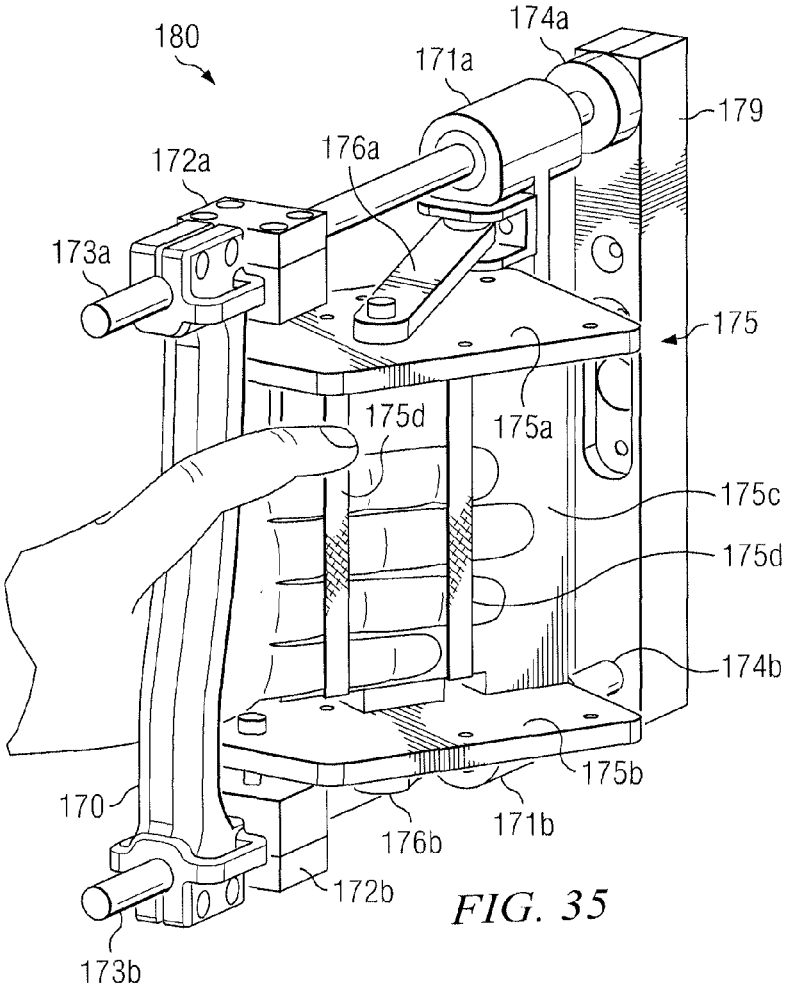
FIG. 35 shows a second diagrammatic view of a paddle-type handle assembly.

Embodiments of ergonomic handle assemblies are shown in FIG. 27 and FIG. 28 ("sweeper" design), FIG. 29 and FIG. 30 (four-bar mechanism concept), FIG. 31 and FIG. 32 ("slider/crank" concept), FIG. 33 ("tracking plate" concept), and FIGS. 34 and 35 ("paddle" concept). After evaluation of each of the concepts in detail, the "paddle" concept was determined to be best at allowing a patient/user to place his/her palm onto an adjustable handle butt 170 while the patient/user's fingers are attached to a paddle assembly 175 that is structured and arranged to convert the circular, viz. log spiral, motion of the fingers into linear motion.

Referring to FIG. 34 and FIG. 35, the handle assembly 180 includes a static handle butt 170, and a handle block 179, which are connected by a upper rail 173*a* and a lower rail 173*b*. To accommodate hands of different size, the handle butt 170 can be moved linearly along the upper and lower rails 173*a* and 173*b*, closer to and further away from the paddle assembly 175. The diameter or thickness of the handle butt 170 can also be made smaller (for women, children, and persons with smaller hands) or larger (for men and persons with larger hands).

An MCP pivot assembly includes an upper MCP pivot mount 172*a* that is translatable and relocatable along and fixedly attachable to the upper rail 173*a* and a lower MCP pivot mount 172*b* that is translatable and relocatable along and fixedly attachable to the lower rail 173*b*. Each of the upper and lower MCP pivot mounts 172*a* and 172*b* is rotatably attached to the handle paddle assembly 175. Bumpstops 174*a* and 174*b* can be disposed on the upper and lower rails 173*a* and 173*b*, respectively, to prevent the paddle assembly 175 or sliding links 171*a* and 171*b* from contacting the handle block 179.

The handle paddle assembly 175 can include a top hand plate 175*a* and a bottom hand plate 175*b* that are mechanically coupled by a vertical plate 175*c*. A plurality of finger straps 175*d* are stretched between and releasably attached to the top and bottom hand plates 175*a* and 175*b*. Links 176*a* and 176*b* operatively couple, respectively, the top hand plate 175*a* to an upper sliding link 171*a* and the bottom hand plate 175*b* to a lower sliding link 171*b*. The upper sliding link 171*a* includes an annulus portion that allows the link 171*a* to translate in a linear direction along the upper rail 173*a*. The lower sliding link 171*b* includes an annulus portion that allows the link 171*b* to translate in a linear direction along the lower rail 173*b*.

As a result, in operation, as the joints of the hand apply a non-linear force to the hand straps 175*d*, the paddle assembly 175 rotates about the MCP pivot mounts 172*a* and 172*b*. With further rotation, the links 176*a* and 176*b* apply a load to the sliding links 171*a* and 171*b*, causing linear translation. The sliding links 171*a* and 171*b* can be mechanically connected to an output shaft 166 that is mechanically coupled to one or more linear actuators.

Figure 36:
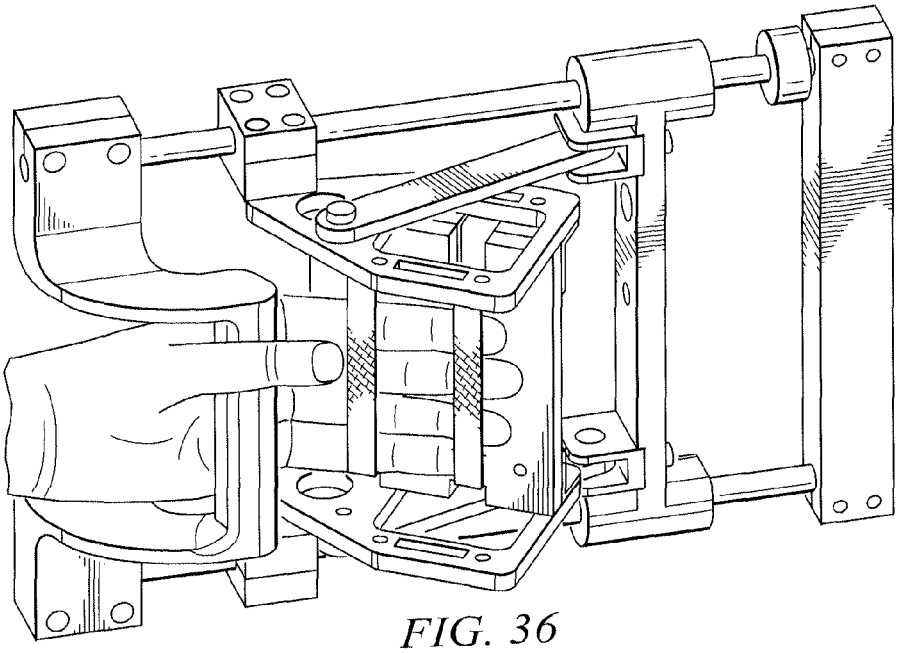
FIG. 36 shows a diagrammatic view of a second embodiment of a paddle-type handle assembly.

A variation to a handle paddle assembly 180 is shown in FIG. 36 in which the handle butt is offset from the axis of the upper and lower rails so that the axis of the patient/user's forearm is coaxial to the axis of the rails. For better ergonomics, the center of rotation of the handle butt is structured and arranged to coincide with the MCP joint of the patient/user's hand.

The device can be augmented with the functionality of isolated finger motions by modifying the paddle assembly 175. For example, to isolate finger motion from grasping motion, the patient/user's hand should be strapped to the existing main paddle at the proximal phalange, i.e., at the base of the finger, and the distal phalange, i.e., the tip of the finger, should be strapped to an additional subsystem that is hinged to the paddle assembly 175. The additional subsystem can include a passive elastic element to provide resistance or a compact actuator that can provide assistive forces. All fingers can be strapped to a single subsystem, or a plurality of individual subsystems can be provide for the number of isolated finger motions desired.

MRI-Compatible, Smart Fluid-Based, Multi-Mode Actuator

The actuator is the principle component that drives the two DOF robotic interface 152 and the two DOF rehabilitation system 150. Developed technology for stroke/TBI/SCI rehabilitation includes systems that enhance shoulder and wrist movement. However, training devices that are adapted to enable flexion/extension of the fingers and hand, i.e. grasp/release movement, as well as pronation/supination movements, i.e., palm up and palm down movement, of the forearm are virtually unavailable. These movements, however, are synergistic and important to functional tasks such as eating, dressing, and grooming.

The prior art suggests the use of some sort of actuator to provide resistive force. Previous implementations of smart fluid-based actuators by others, however, have resulted in single-function brakes and/or dampers. Single-function brakes/dampers are passive devices that are adapted to generate resistance to an applied force but that cannot create a driving force on its own. Accordingly, prior art use of such systems has been limited to discrete applications such as for vibration control, controllable resistance, and motion control. As a result, prior art brakes/dampers may cause problems with patients who cannot move their hands at all.

An active force device is one in which the device assists the patient/user to perform a desired movement. Heretofore, when an active force is desirable for a particular application, designers have limited themselves to one of two options. A first option employs a motor with a closed-loop controller. The first option is widely used to reach high force/torque levels. However, disadvantageously, large motors must be used, which are expensive and bulky and, therefore, undesirable.

A second option employs a driver in combination with a damper. Disadvantageously, the second option is a more complex, combining two mechatronic systems that must be controlled closely for the system to operate transparently.

Notwithstanding, it is possible to provide passive and active, i.e., assistive, force with conventional actuators using, for example, voice coils and hydraulic cylinders. Indeed, the use of a smart fluid-based actuator has several superior features over its counterparts. For example, first, it has high-force density, which is to say, that it can provide forces up to 500 N in a compact design. Second, the relatively high response rate to varying electric fields enables smooth control of forces during rehabilitation games. Finally, smart fluid-based actuators are MRI-compatible, so devices that use them have the option of being made MRI-compatible.

In one embodiment, the actuator is adapted to use smart (control) fluids such an electro-rheological fluid (ERF), a magneto-rheological fluid (MRF), and the like, to provide damping/braking selectively. An ERF-based actuator performs exceptionally compared to standard hydraulic system due to the proximity of its control (main) valve to the actuator itself and will be described further herein.

An MRI-compatible, smart fluid-based, multi-mode actuator is described in U.S. Provisional Patent Application No. 61/302,666 filed on Feb. 10, 2010, which is incorporated herein in its entirety by reference.

A smart (control) fluid-based, multi-mode actuator that is structured and arranged to provide a linear and a rotary actuator mode of operation and/or a damper/brake mode of operation will now be described. In either its linear or its rotary forms, the actuator is adapted to apply either a controllable motive force and/or a controllable damping force.

More particularly, the control (main) valve of an ERF-based actuator can be disposed within the actuator itself and, further, can be controlled by varying the strength of an electric field across the main valve. A change in electric field strength at the main valve changes the yield stress of the ERF fluid therein, which affects the pressure drop across the main valve. Hence, pressure and pressure differentials, which affect velocity, can be controlled by controlling the yield stress of the ERF. Since the main valve is disposed inside the actuator itself proximate to the piston (or to a rotary vane member) and, moreover, because ERF reacts, i.e., can be activated by an electric field, on the order of milliseconds, rapid and precise force control is possible.

Extensive research has been conducted by others on smart fluid dampers and damper applications. However, the primary focus of others has been on use of dampers as vibration damping elements. Smart fluid actuators, however, have many features that are suitable and desirable for patient rehabilitation applications. For example, they exhibit a high response rate to varying electric (or magnetic) field strength and, moreover, are compatibility with magnetic resonance imaging (MRI).

Various actuator types for the multi-mode actuator rehabilitation system will now be described. Use of the generic term "actuator" hereinafter will include use of the same device for damping and braking operations. Hence, the "damper" or "brake" terms will not be included in the description of the device, although, those skilled in the art can appreciate that, by convention, an actuator qua actuator does not perform damping or braking.

Smart Fluid-Based, Linear Actuator

Figure 4A:
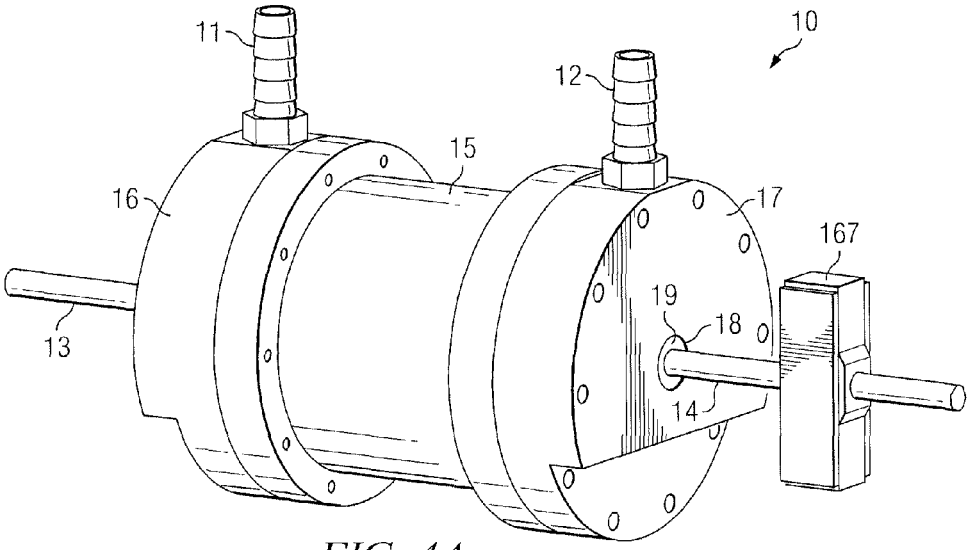
FIG. 4A shows a diagrammatic view of a smart fluid-based linear actuator in accordance with the invention as claimed.
Figure 4B:
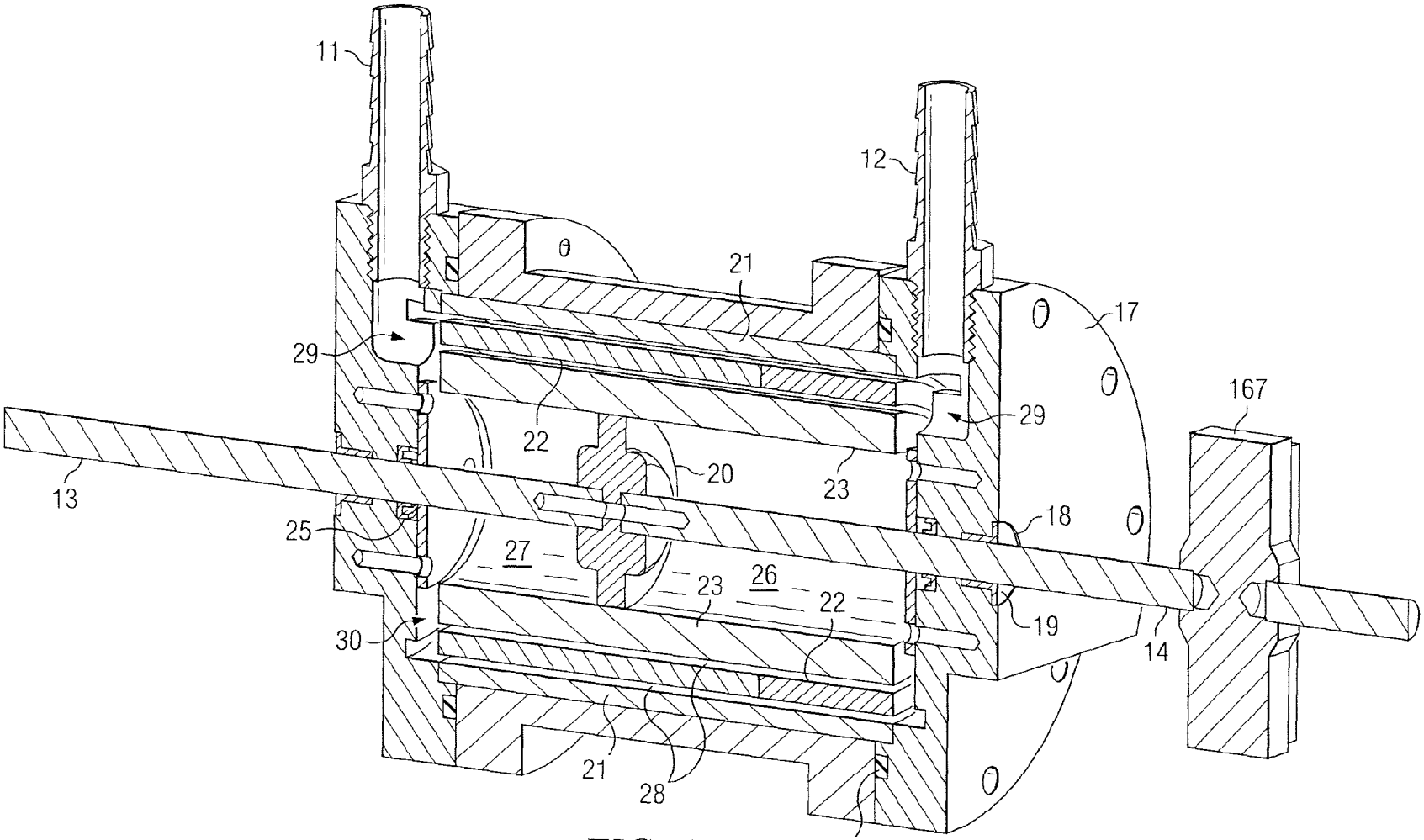
FIG. 4B shows a cross section of the linear actuator shown in FIG. 4A.

Referring to FIG. 4A and FIG. 4B, an illustrative embodiment of a smart fluid-based, linear actuator 10 is shown. The smart fluid-based linear actuator 10 draws its principle functionality from a smart (control) fluid such as ERF, MRF, and the like. Although the invention is described including ERF-based actuators, those skilled in the art can appreciate that MRF-based actuators and other high performance actuators are equally suitable for use in this system.

The actuator 10 includes a central portion 15 that is mechanically coupled to a first (front) end cap 17 and a second (rear) end cap 16, to define a plenum or cavity therein. The central portion 15 is structured and arranged to house, inter alia, a piston chamber 26 and 27 and a field-inducing device 30 within the plenum space or cavity.

Primary and secondary piston shafts 14 and 13 are disposed through openings 18, respectively, in the front and rear end caps 17 and 16. Low-friction bearings 19 are provided in each opening 18 for the purpose of centering the piston shafts 14 and 13 while also permitting the piston shafts 14 and 13 to translate in an axial direction and/or to rotate freely about the translation axis, in a clockwise or a counterclockwise direction, without unwanted side loads or friction.

The piston chamber 26 and 27 is structured and arranged to accommodate a piston 20 and a volume of smart fluid. The piston 20 divides the plenum or cavity into a first chamber portion 26 and a second chamber portion 27. The piston 20 is machined to a close tolerance to provide a negligible radial gap, e.g., within one-thousandth of an inch (0.001 in.), between the outer periphery of the piston 20 and the inner surface of the piston chamber 26 and 27. Maintenance of a negligible radial gap eliminates the need for a piston seal, which can be a major source of friction.

The piston 20 translates in a longitudinal direction in response to a force applied to the primary or secondary piston shaft 14 or 13. A translational force on one side of the piston 20 or the other, i.e., within the first chamber portion 26 or the second chamber portion 27, can produce a pressure differential between the two chamber portions 26 and 27. Depending on the location of the pressure differential with respect to the piston 20, smart fluid flows into/out of the first chamber portion 26 via a conduit 29 and a first input/output port 12 that is integrated into the front end cap 17 and smart fluid flows into/out of the second chamber portion 27 via a conduit 29 and a second input/output port 11 that is integrated into the rear end cap 16.

The piston 20 is mechanically coupled to primary and secondary piston shafts 14 and 13 that are disposed on opposing sides of the piston 20. The primary piston shaft 14, typically, has a force or torque applied to it by the patient/user while the secondary piston shaft 13 acts as a volume compensator and/or can be used as an auxiliary connection point, e.g., to a linear potentiometer to measure relative position.

Sealing devices, e.g., an O-ring 24 and a low-friction spring seal 25, are provided to prevent smart fluid from escaping the chamber portions 26 or 27 during movement of the piston 20.

For ERF-based actuators 10, the field-inducing device 30 can include outer 21, middle 22, and bore electrodes 23, which combination produces the "main valve" or "control valve" of the actuator 10. The electrodes 21, 22, and 23 are relatively thin, hollow cylinders that are disposed coaxial and concentric about the axis of translation as well as each other. The outer electrode 21 and the bore electrode 23 are electrically coupled to ground while the middle electrode 22 is electrically coupled to a current power source 154.

Concentric, annular gaps 28 are provided between the outer electrode 21 and the middle electrode 22 and between the middle electrode 22 and in the bore electrode 23. During operation, smart fluid flows through the gaps 28. However, during an actuator mode of operation, there is no field induced in the smart fluid. During a damper/brake mode of operation, the electrodes 21, 22, and 23 are adapted so that as high voltage is applied to the middle electrode 22, an electric field of a controllable strength is induced in the smart fluid flowing in the gaps 28. The induced electric field activates the smart fluid, which is to say causes the yield stress of the smart fluid and, therefore, the resistance to flow to increase. Increased resistance provides the damping/braking.

For example, when the handle assembly 163 is subject to a grasp force, the patient/user moves (pulls) the translating handle 163*a* towards the stationary handle 163*b*. As the piston 20 is pulled in the direction of the primary piston shaft 14, the volume of the first piston chamber 26 decreases; hence, smart fluid is forced out of the first chamber portion 26 and through annular gaps 28 between the electrodes 21, 22, and 23 into the hydraulic circuit 155 via the conduit 29 and the first input/output port 12. At the other end, the volume of the second piston chamber 27 increases. As a result, smart fluid is introduced into the second chamber portion 27 and the annular gaps 28 from the hydraulic circuit 155 via the second input/output port 11 and the conduit 29. The pressure differential between the first and second piston chambers 26 and 27 determines the degree of resistance to the patient/user's grasp motion. By activating the smart fluid in the gaps 28 of the field-inducing device 30, the pressure drop can be controlled to provide more or less resistance.

Similarly, when the handle assembly 163 is subject to an active, release force, the patient/user's hand must resist the force of the translating handle 163*a* as it is forced away from the stationary handle 163*b*. Release motion pushes the piston 20 in the direction of the second piston chamber 27 and the secondary piston shaft 13. As the volume of the second piston chamber 27 decreases, smart fluid is forced out of the second chamber portion 27 and from between the annular gaps 28 between the electrodes 21, 22, and 23 into the hydraulic circuit 155 via the conduit 29 and the second input/output port 11. At the other end, the volume of the first piston chamber 26 increases so smart fluid is introduced into the first chamber portion 27 and the channel gaps 28 from the hydraulic circuit 155 via the first input/output port 12 and the conduit 29. Here again, the pressure differential between the first and second piston chambers 26 and 27 determines the degree of resistance to the patient/user's release motion.

During either grasp/release operation, smart fluid flows through the "main valve" 30, which modulates pressure drop across its length as a function of the electric field strength. Hence, pressure drop, which equates to handle assembly resistance, can be controlled merely by varying the electric field strength. Because smart fluids inherently respond to an increase in electric field strength (or an increase in magnetic field strength), the yield stress of the control fluid increases with increasing field strength and decreases with decreasing field strength. As a result, when a smart fluid is influenced by an electric field (or by a magnetic field), generated by the field-inducing device 30, the fluid's yield stress increases, making it more resistive to motion as the thickened fluid flows through the "main valve" 30.

Fluid resistance in the "main valve" 30 can be harnessed mechanically using various configurations of pistons (linear) or vanes (rotary), which are discussed in greater detail below. Advantageously, in an ERF form, an actuator 10 could be made to be fully compatible with magnetic resonance imaging (MRI), which is to say, to be selectively operable in either active or damping modes in high magnetic field environments such as magnetic resonance imaging (MRI).

An optional load cell 167, e.g., a strain gauge, can be mechanically coupled to the primary or secondary piston shaft 14 or 13 to measure load/or and load rate. Strain gauges and their application are well known to the art and will not be discussed in greater detail. Load cells 167 can also be adapted to provide strain data as output to the controller 156, e.g., wirelessly or via a hardwire coupling (not shown).

Smart Fluid-Based, Sliding-Vane, Rotary Actuator

Figure 5A:
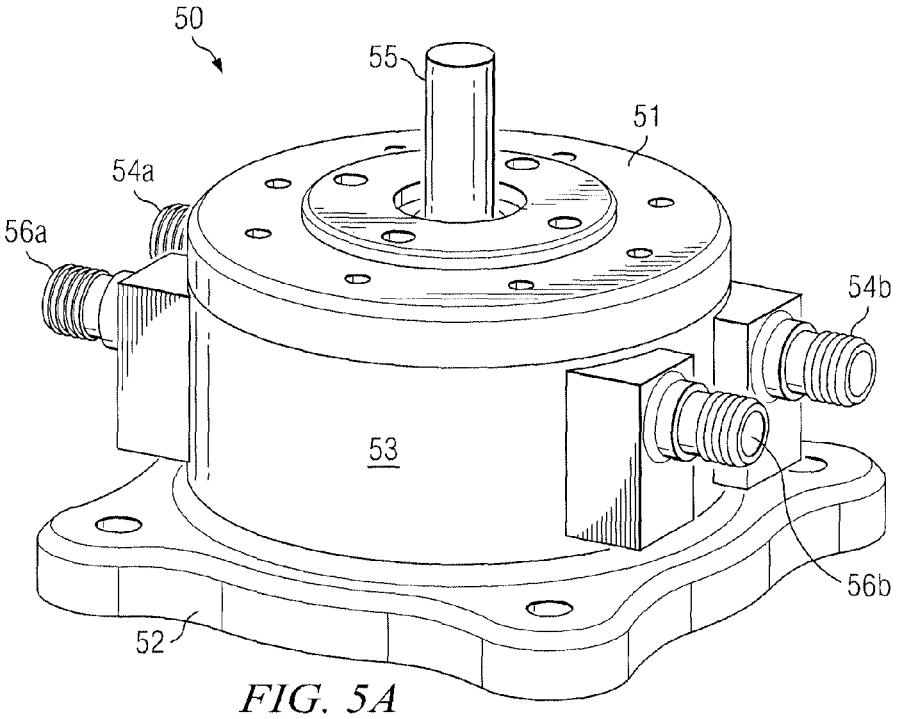
FIG. 5A shows an isometric diagrammatic view of a smart fluid-based, rotary, sliding-vane actuator in accordance with the invention as claimed.
Figure 5B:
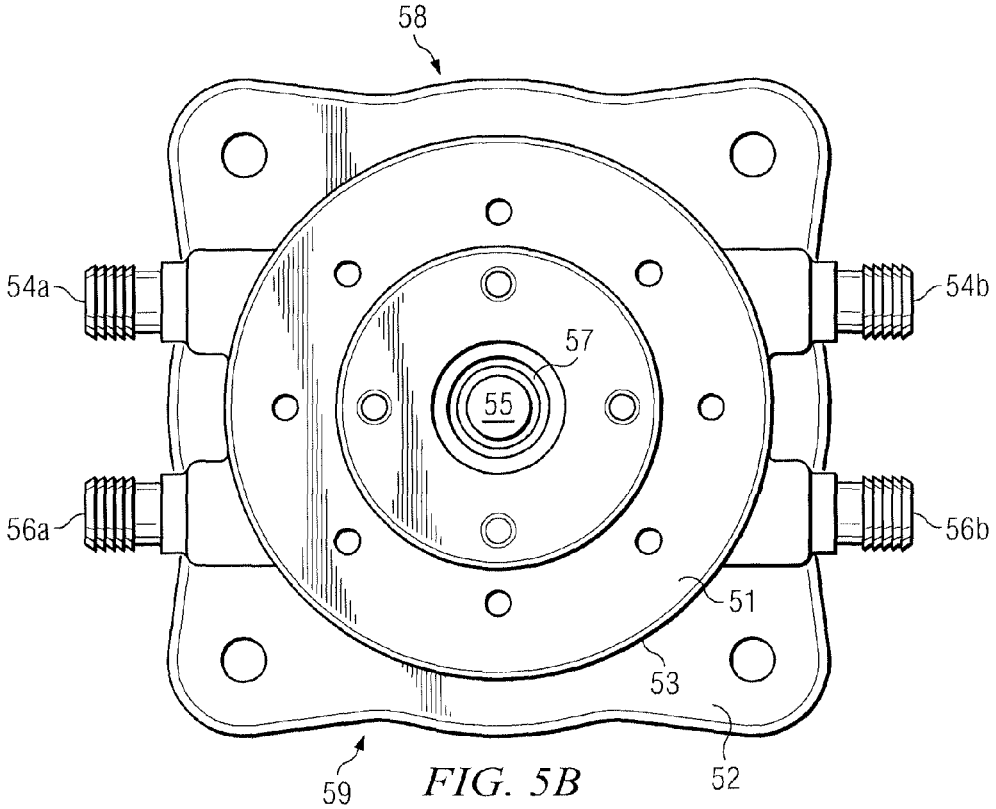
FIG. 5B shows a plan view of the sliding-vane actuator shown in FIG. 5A.

Diagrammatic views of an exemplary rotary, sliding-vane actuator (the "Rotary Actuator") 50 are shown in FIG. 5A (isometric) and FIG. 5B (plan). The rotary actuator 50 includes a lid assembly 51, a base assembly 52, a vane chamber 53, and a rotary shaft 55. The rotary actuator 50 also includes a first pair of input/output valves 54*a* and 54*b* on a first side (Side A) and a second pair of input/output valves 56*a* and 56*b* on a second side (Side B) 59.

Figure 6A:
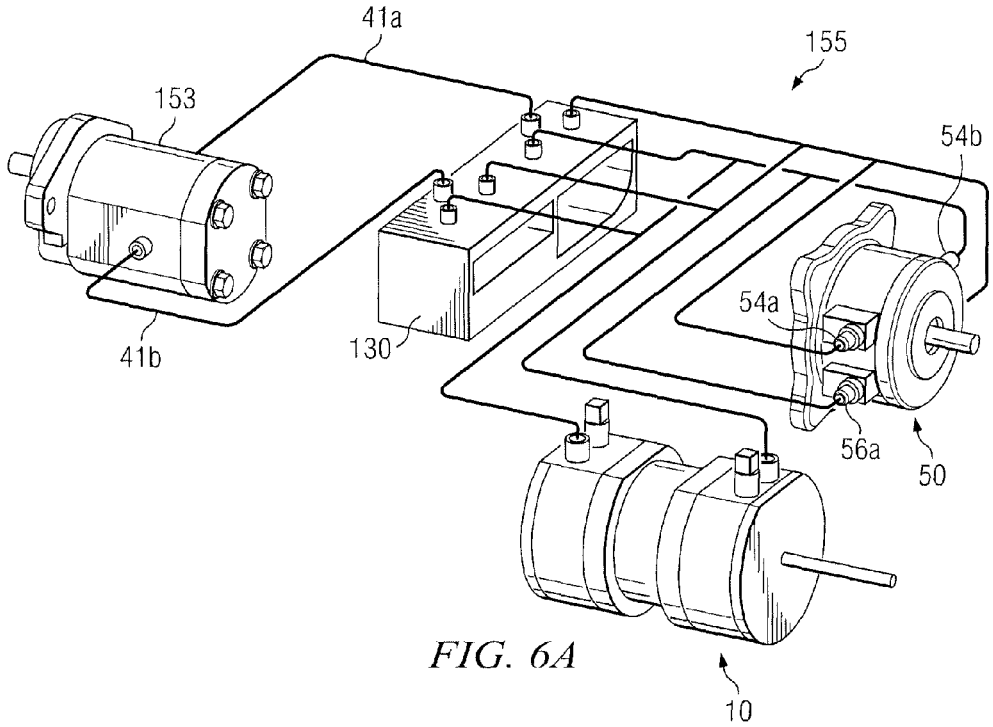
FIG. 6A shows a diagrammatic view of a pump assembly and hydraulic circuit with a manifold in accordance with the invention as claimed.
Figure 6B:
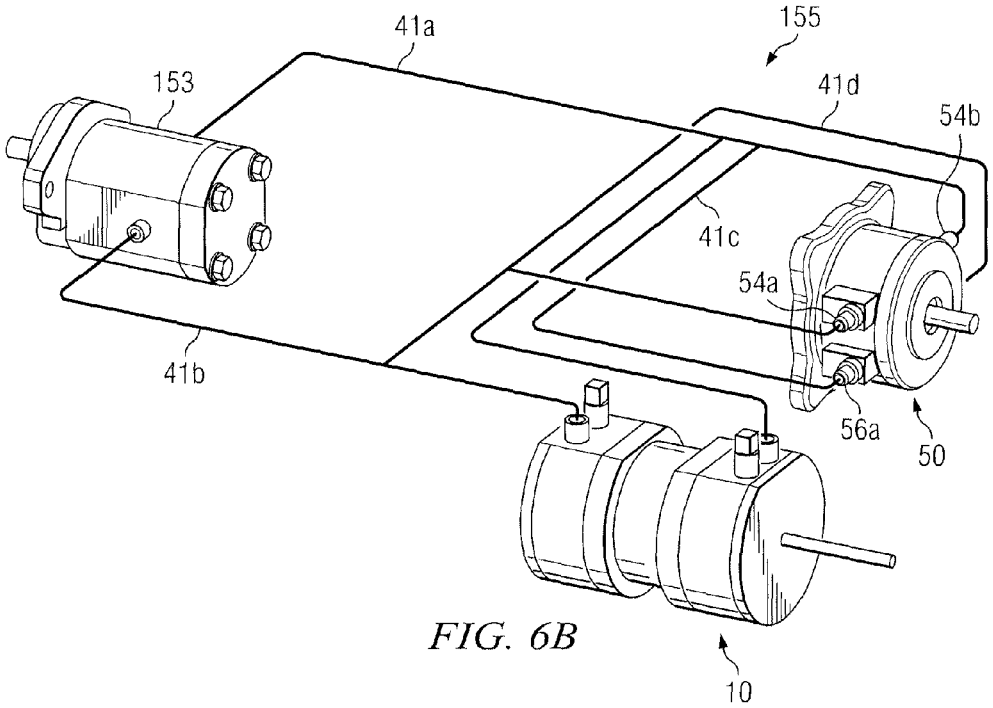
FIG. 6B shows a diagrammatic view of a pump assembly and hydraulic circuit in accordance with the invention as claimed.

The two sides 58 and 59 are symmetrical, each providing its own flow path. The function of Side A and Side B will be discussed in greater detail below. Referring to FIG. 6A and FIG. 6B, whereas a linear actuator 10 has two hydraulic lines 41*a* and 41*b* that are fluidly coupled, respectively, to the front valve 12 and the rear valve 11 of the linear actuator 10, a rotary actuator 50 can have two 41*a* and 41*b* or four hydraulic lines 41*a*-41*d* to opposing sides of the rotary actuator 50. The number of hydraulic lines 41 determines whether the rotary actuator 50 is "balanced" (2 lines) or "unbalanced" (4 lines). The manifold 130 shown in FIG. 6A is optional and will be discussed in greater detail below.

Figure 7A:
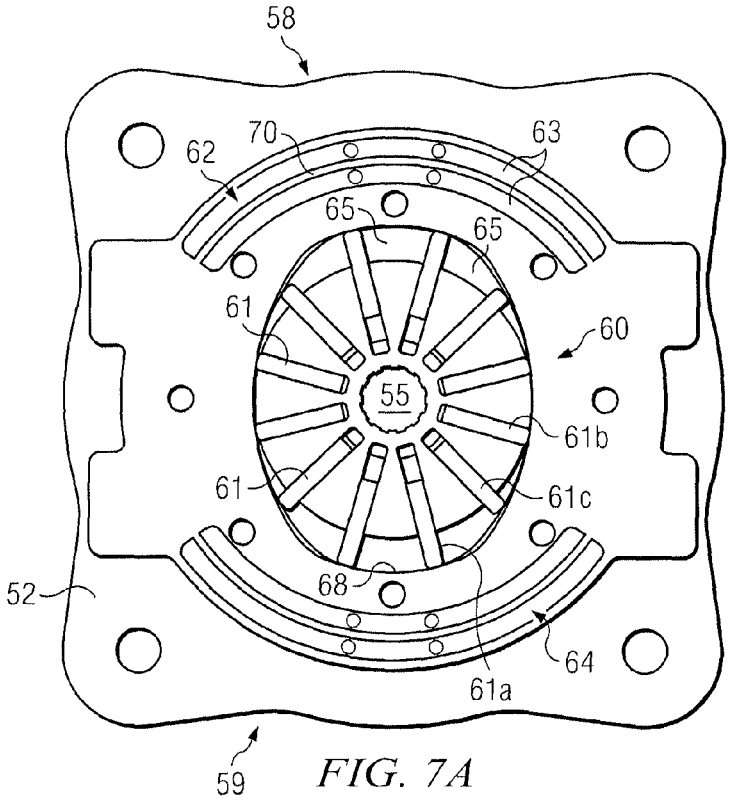
FIGS. 7A and 7B show cross-section views of the sliding-vane actuator shown in FIGS. 5A and 5B taken from different elevations.
Figure 7B:
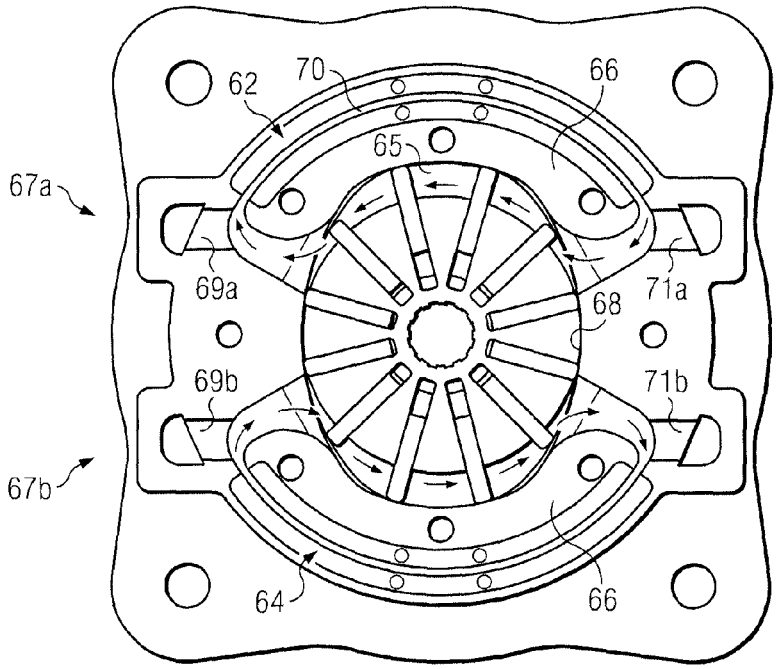
Figure 8:
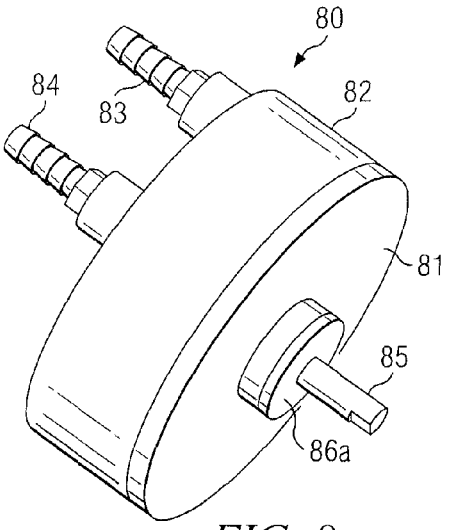
FIG. 8 shows a diagrammatic view of a rotary, fixed-vane actuator in accordance with the invention as claimed.

FIG. 7A and FIG. 7B show cross-sectional views of the rotary actuator 50 at different elevations for the purpose of showing the function thereof. The rotary actuator 50 includes a circular or substantially circular, rotary, sliding-vane mechanism 60 that is mechanically coupled to the rotary shaft 55 such that rotation of the sliding-vane mechanism 60 produces rotation in the rotary shaft 55.

The circular or substantially circular rotary mechanism 60 is disposed in a non-circular chamber 68. The rotary mechanism 60 includes a plurality of radial vanes 61 that are biased, e.g., spring-biased, so that the distal edge of each vane 61 remains in contact with the peripheral surface of the chamber 68 during rotation, to provide a seal.

The vanes 61 operate in one of three modes: a fully extended mode 61*a*, a fully depressed mode 61*b*, and a partially-depressed (or partially-extended) mode 61*c*. As shown in FIG. 7, there is space 65 for control fluid between adjacent vanes 61 that are both fully extended 61*a*; between one vane that is fully extended 61*a* and an adjacent vane that is partially-extended 61*c*; between adjacent vanes that are both partially-extended 61*c*; and between adjacent vanes that are fully depressed 61*b* and partially-extended 61*c*. In other words, there is no or substantially no space for control fluid between adjacent vanes 61 that are both fully depressed 61*b*.

The rotary actuator 50 also includes plural electrodes 63 that are separated by a fluid gap 70. One electrode is coupled to ground and the other is coupled to a power source (not shown). The power source is adapted to provide current or high voltage to influence the ERF or the MRF, respectively. The electrodes 63 and fluid gap 70 provide a "main valve" 62 (for Side A 58) and a "main valve" 64 (for Side B 59), for controlling pressure drops. Indeed, by adjusting high-voltage delivered to the electrodes 63 and, thereby, the strength of the electric field induced in the control fluid in the gaps 70, the pressure drop and pressure differential (on either side of the main valve 62) can be varied.

Referring to FIG. 7B, internal flow pathways 69*a* and 69*b* for Side A 58 and Side B 59, respectively, provide fluid communication between the Side A input/output 54*a*, the Side A valve 62, and the Side A input/output 54*b*; and between the Side B input/output 56*a*, the Side B valve 64, and the Side B input/output 56*b*, respectively. In this balanced design, there are two independent flow pathways 67*a* and 67*b* with little internal fluid exchange between the two. The direction of the flow can be clockwise or counterclockwise.

Each "side" of the rotary actuator 50 cycles smart control fluid through the internal flow pathways 67*a* and 67*b* and external hydraulic circuit 155 and through the gaps 70 in the "main valves" 62 and 64. The distribution of flow is controlled by the pressure difference between the "main valve" 62 or 64 and the external hydraulic circuit 155.

In the Side A internal flow pathway 67*a*, a volume of control fluid from the hydraulic circuit 155 and/or from the gap 70 enters a sub-chamber 65 of the chamber 68 via the internal flow passageway 69*a*, between a first, fully depressed vane 61*b* and an adjacent partially-extended vane 61*c*. As the rotary sliding vane device 60 rotates about the axis of the rotary shaft 55, the biasing spring (not shown) forces the distal end of each vane 61 against the peripheral wall of the chamber 68. As this happens the volume of the sub-chamber 65 increases to a maximum (while the volume of the fluid remains unchanged or substantially unchanged) and then decreases until the control fluid is output at to the internal flow pathways 71*a*.

The fluid then passes through the "main valve" 62 and/or is output into hydraulic circuit 155. As the fluid passes through the main valve 62, the strength of the field (electric or magnetic) will cause the yield stress of the fluid to increase or decrease accordingly. As the yield stress increases, it becomes more resistive and slows down (dampens or brakes) the action of the rotary shaft 55. The resistivity can be increased so as to arrest (brake) any movement of the shaft 55. As the yield stress decreases, it becomes less resistive and speeds up the action of the rotary shaft 55.

Instead of valves, a compressible closed cell foam or the like can be incorporated behind the vanes. These serve dual function; to assist in sealing the vanes during low speed operation by adding a spring behind the system and to take up the volume behind the vanes when they are compressed down.

Smart Fluid-Based, Fixed-Vane, Rotary Actuator

As an alternative to the sliding-vane actuator 50 described hereinabove, a rotary, fixed-vane actuator ("Fixed-vane Actuator") can be used. An exemplary fixed-vane actuator 80 is shown in FIGS. 8-11. The fixed-vane actuator 80 is adapted to house within an inner plenum or cavity a rotating member 89 to which an output shaft 85 and a single, fixed vane 88 are mechanically attached.

The housing elements include a cylindrical case portion 82 and a lid portion 81. Input/output barbs 83 and 84 are provided in the case portion 82 for fluidly coupling the fluid chamber 79 of the fixed-vane actuator 80, which is disposed in the inner plenum or cavity, to the hydraulic circuitry 155. The lid portion is structured and arranged to include a centrally-located opening that accommodates the output shaft 85 as well as a low-friction sealing device 86*c* and a first, upper, low-friction bearing 86*b*. The bearing 86*b* is adapted to center the output shaft 85 with a minimal amount of lateral loading. The sealing device 86*c* is provided around the output shaft 85, to prevent leakage of smart fluid during operation. A removable bearing lid 86*a* is provided to confine the bearing 86*b* and seal 86*c* within the lid portion 81.

As shown in FIGS. 9A, 9B, 10A, and 10B, a bi-directionally-rotatable rotating member 89 is housed within the inner plenum or cavity provided by the cylindrical case portion 82. A second, lower, low-friction bearing 86*d* is provided in the base of the case portion 82, to center the output shaft 85 with a minimal amount of lateral loading. The fixed vane 88 is integrated into or mechanically attached to the outer periphery of the rotating member 89.

The fixed vane 88 is fabricated to provide minimal, friction-less or virtually friction-less clearance between the fixed vane's outermost radial surface and the inner peripheral wall of the plenum or cavity, to again minimize leakage and/or pressure loss about the fixed vane 88. The annular region between the outer periphery of the rotating member 89 and the inner surface of the plenum or cavity of the case portion 82 defines a fluid chamber 79.

Figure 11:
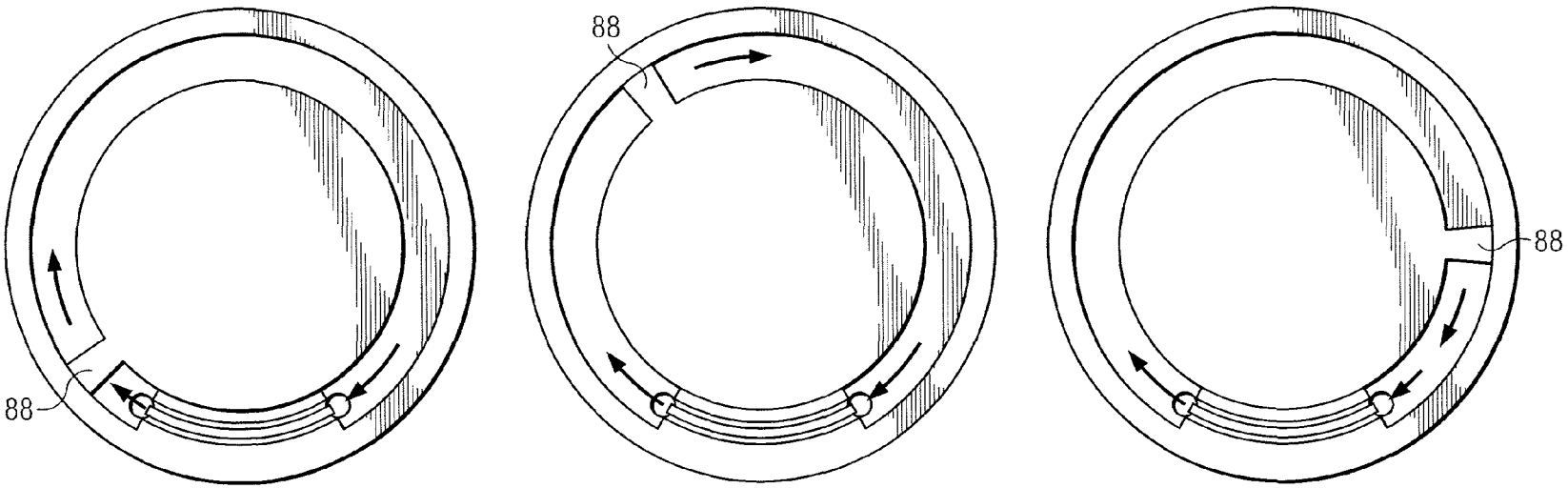
FIG. 11 shows a diagrammatic view of the internal operation of the fixed-vane actuator shown in FIG. 8.
Figure 12A:
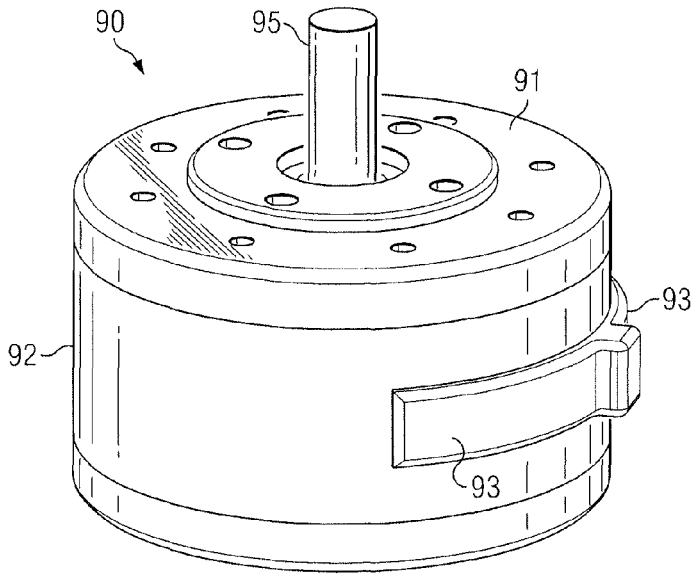
FIG. 12A shows a diagrammatic view of a rotary vane pump assembly in accordance with the invention as claimed.
Figure 12B:
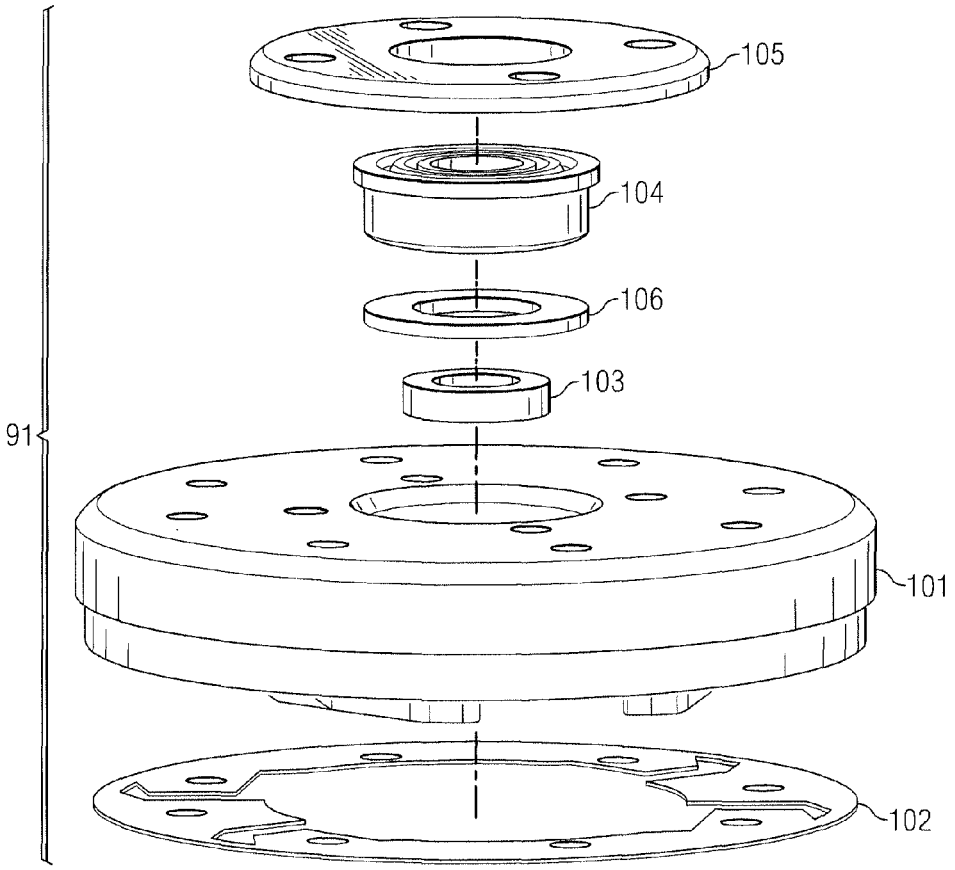
FIG. 12B shows an exploded view of the lid assembly of the rotary vane pump assembly shown in FIG. 12A.

As the vane 88 rotates, smart (control) fluid passes through the main valve 74 and the hydraulic circuit 155. The difference in pressures between the front 88*a* and the back 88*b* of the vane 88 will determine the direction and velocity of flow as well as the device's functionality. During clockwise operation (as shown in FIG. 11), pressurized ERF passes into the fluid chamber 79 through one of the opening 73*a*, forcing the fixed vane 88 to rotate in the direction of the arrow.

A pressure plate 87*a* and biasing means, e.g., a plurality of biasing springs 87*b*, are provided to seal the rotating member 89 within the fluid chamber 79, to prevent leakage of smart fluid therefrom. The pressure plate 87*a* can be made from or coated with a low-friction material, to minimize friction loss due to contact between the rotating member 89 and the plate 87*a*. The springs 87*b* apply a constant or substantially constant force that balances design needs for low friction with needs for low leakage.

The fluid chamber 79 is structured and arranged to provide a main valve 74 and plural, e.g., two, sub-chambers 79*a* and 79*b*, whose volume is constantly changing as the rotary member 89 and the fixed vane 88 rotate. When operated as an actuator, a pressure difference in the smart fluid between the two sub-chamber sides 79*a* and 79*b* is modulated and promoted by the main valve 74. The pressure difference gives rise to an output torque in the direction of the lower pressure. Alternatively, when operated as a damper/brake, the fixed vane 88 forces smart fluid though the main valve 74, which modulates the pressure difference. This is felt on the shaft 85 as a resistance to rotation.

A first sub-chamber 79*a* is fluidly coupled to the hydraulic circuitry 155 via a first opening 73*a* in the case portion 82 and in one of the input/output barbs 83 or 84. A second sub-chamber 79*b* is fluidly coupled to the hydraulic circuitry 155 via a second opening 73*b* in the case portion 82 and in one of the input/output barbs 83 or 84. The main valve 74 is disposed between and proximate or adjacent to the pair of openings 73*a* and 73*b*.

Figure 9A:
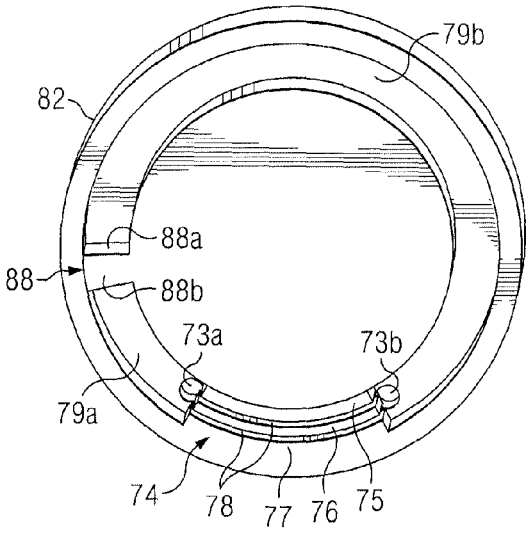
FIG. 9A shows a diagrammatic view of the inner portion of the fixed-vane actuator shown in FIG. 8.
Figure 9B:
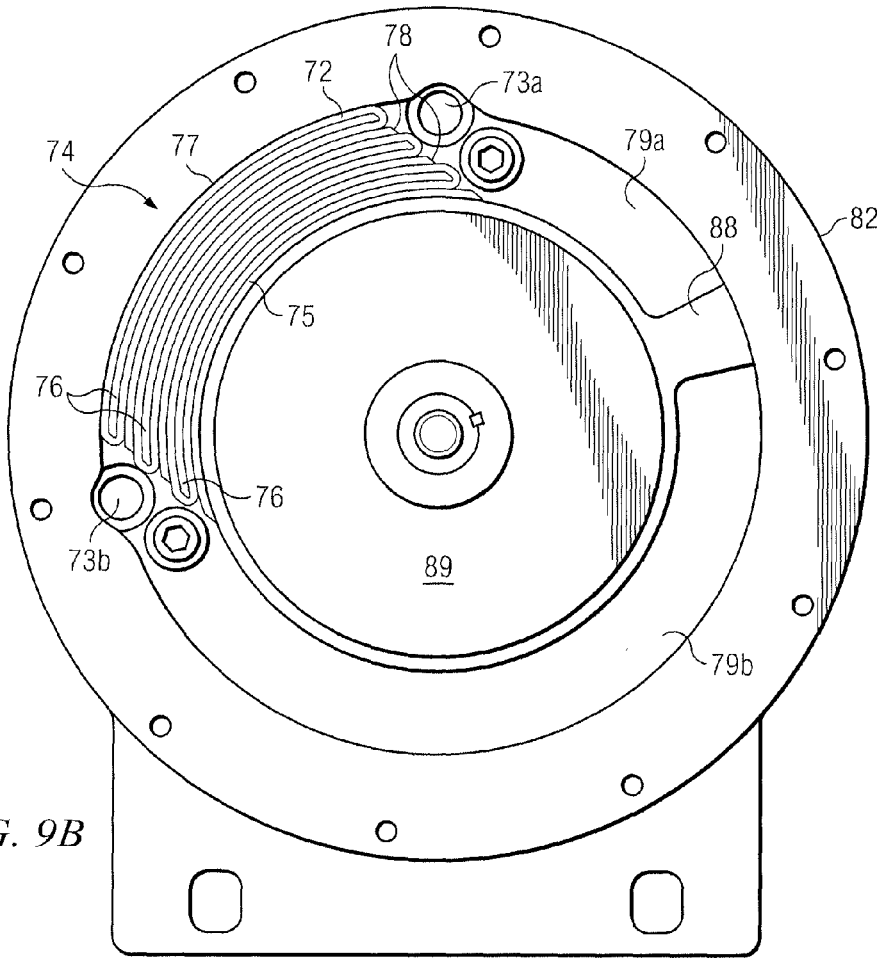
FIG. 9B shows a diagrammatic view of an alternative inner portion of the fixed-vane actuator shown in FIG. 8.
Figure 10A:
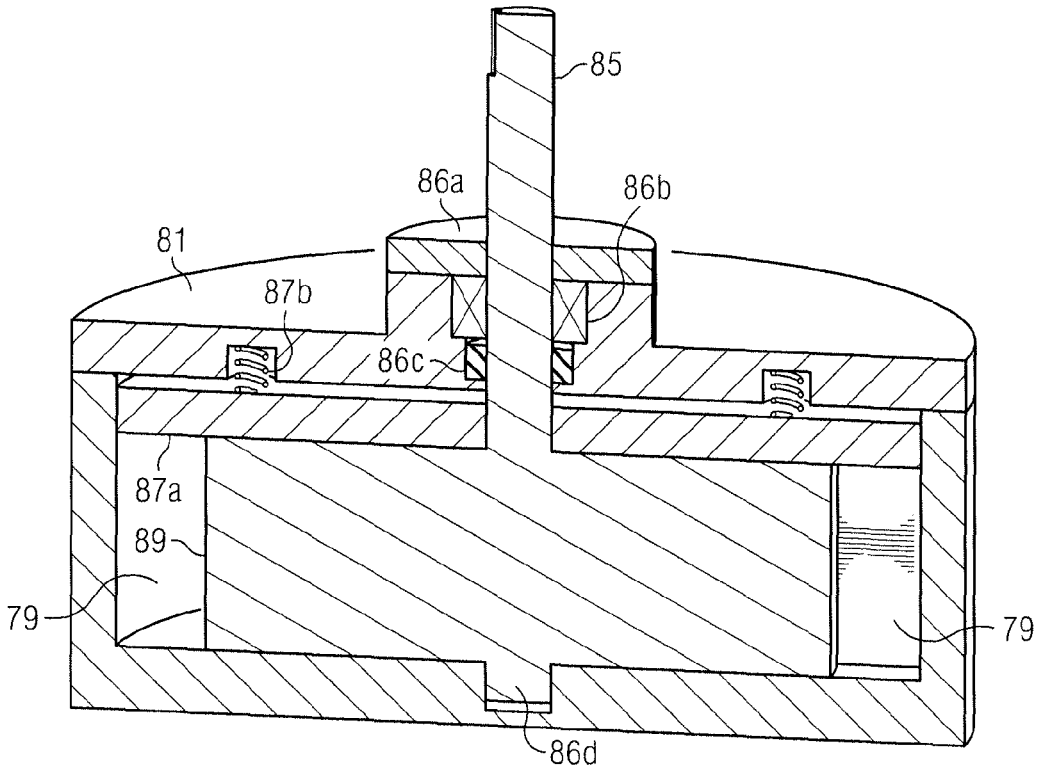
FIGS. 10A and 10B show cross-section views of the fixed-vane actuator shown in FIG. 8.
Figure 10B:
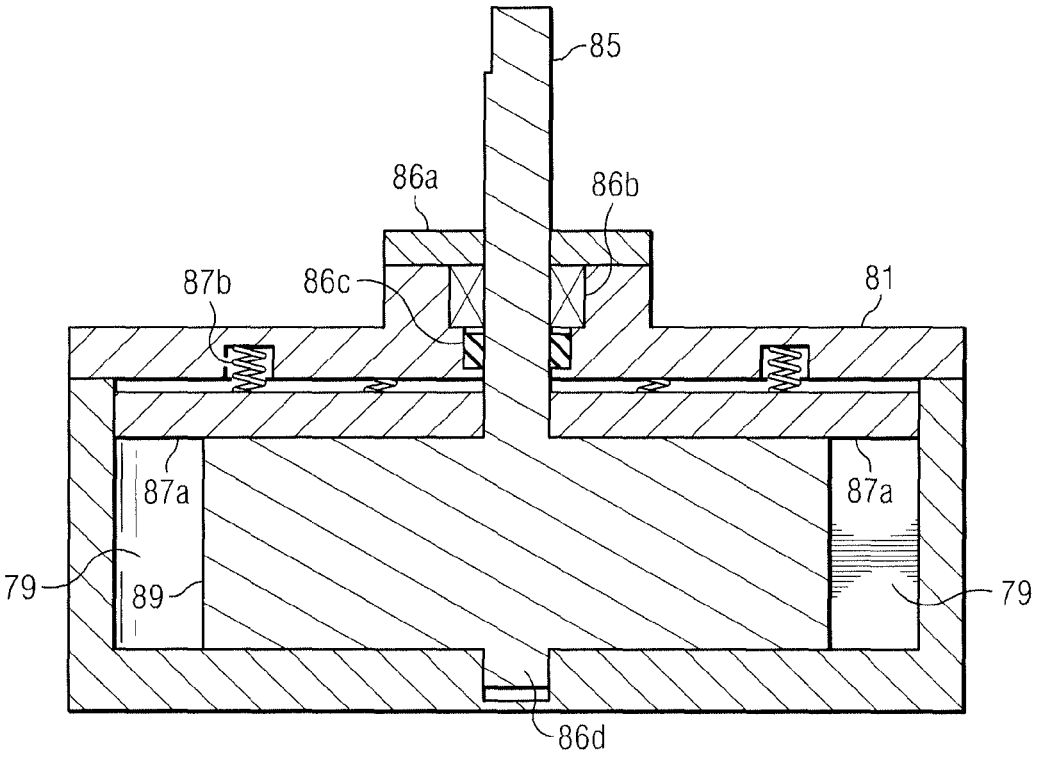

As shown in FIG. 9A, the main valve 74 includes a pair of fluid channels 78, respectively, which are disposed between a bore electrode 75 and a middle electrode 76 and between the middle electrode 76 and an outer electrode 77. The bore and outer electrodes 75 and 77 are electrically grounded while the middle electrode 76 is electrically coupled to a current power source. As shown in FIG. 9B, the main valve 74 includes a plurality, e.g., six, of fluid channels 78, respectively, which are disposed between a bore electrode 75 and a middle electrode 76, between a middle electrode 76 and an inner ground electrode 178, and between the middle electrode 76 and an outer electrode 77. Insulators 72 for electrically insulating the non-grounded middle electrodes 76, e.g., plastic inserts, are provided. The bore 75, inner ground 178, and outer electrodes 77 are electrically grounded while each middle electrode 76 is electrically coupled to a current power source.

To dampen or arrest the rotational velocity of the fixed vane 88, current is supplied to the middle electrode 76 to activate the smart control fluid within the fluid channels 78 of the valve 74. As the smart fluid is activated, resistance to flow within the fluid channels 78 and, consequently, the fluid chamber 79 increases, retarding or dampening further rotation.

Optionally, pressure sensors (not shown) can be incorporated into the fixed-vane actuator 80 or on either side of the valve 74, to assist in controlling the device using pressure difference readings directly.

Conventional Actuators

Figure 37:
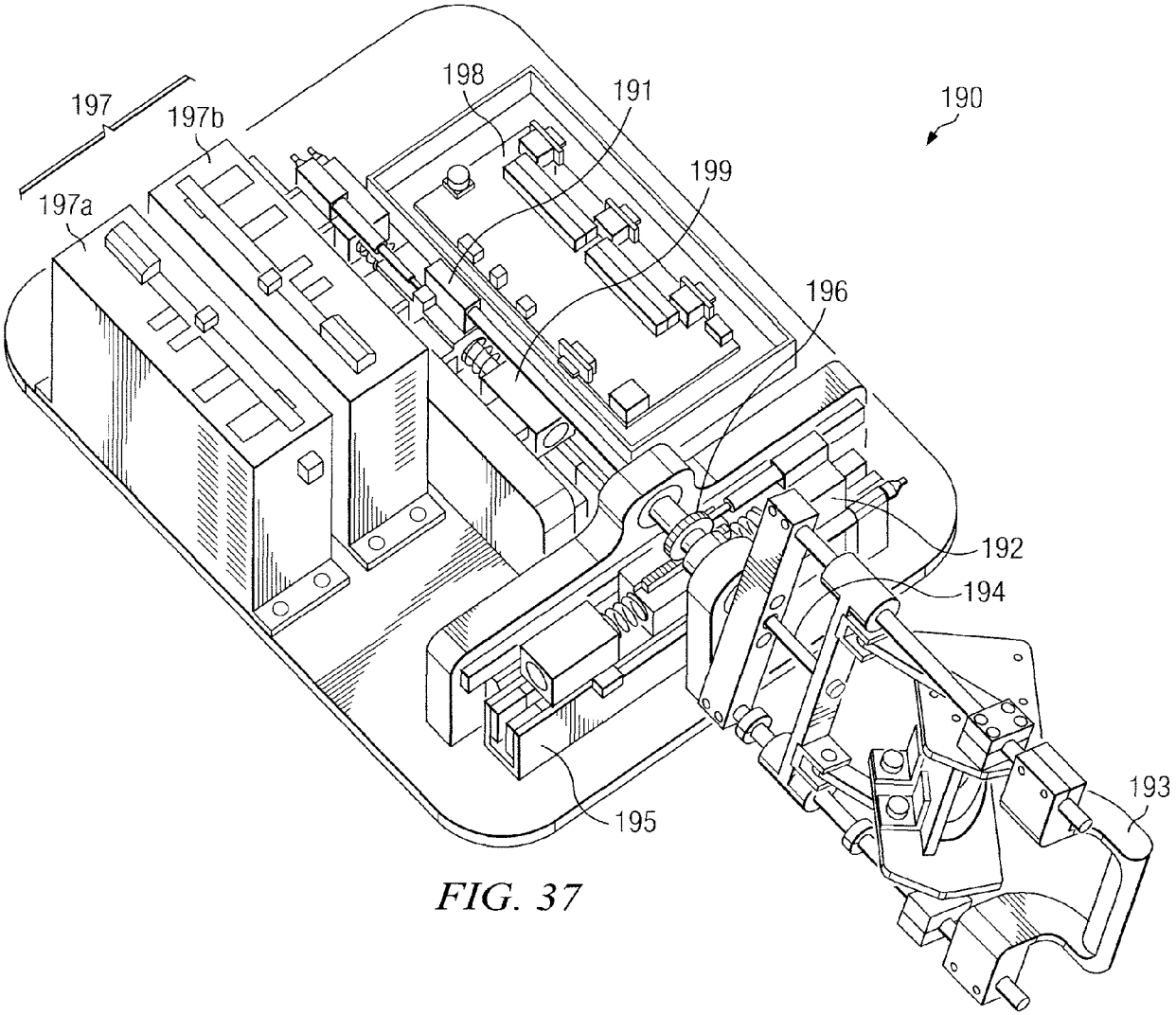
FIG. 37 shows an embodiment of a two degree-of-freedom hand rehabilitation system with conventional, linear-type motor actuators.

Heretofore, the invention has been described assuming the use of smart fluid-based actuators. However, the invention can also be practiced using conventional, linear-type motor actuators. Referring to FIG. 37-39, there are shown various views and details of a system 190 having a first actuator for the first degree-of-freedom (linear), which includes a linear drive motor 191 and a compliant force sensor 199, and a second actuator for the second degree-of-freedom (rotary), which includes a linear drive motor 195 and a compliant force sensor 192. Also shown are a two DOF handle assembly 193 that is mechanically coupled to a linear actuation shaft 194, a controller 198, and a pair of motor amplifiers 197*a* and 197*b*, which are operatively coupled to a corresponding linear drive motors 191 and 195. A rack-and-pinion device 196 is provided for converting the rotary motion of the handle assembly 193 into a linear DOF motion of the linear motor 195.

Figure 38A:
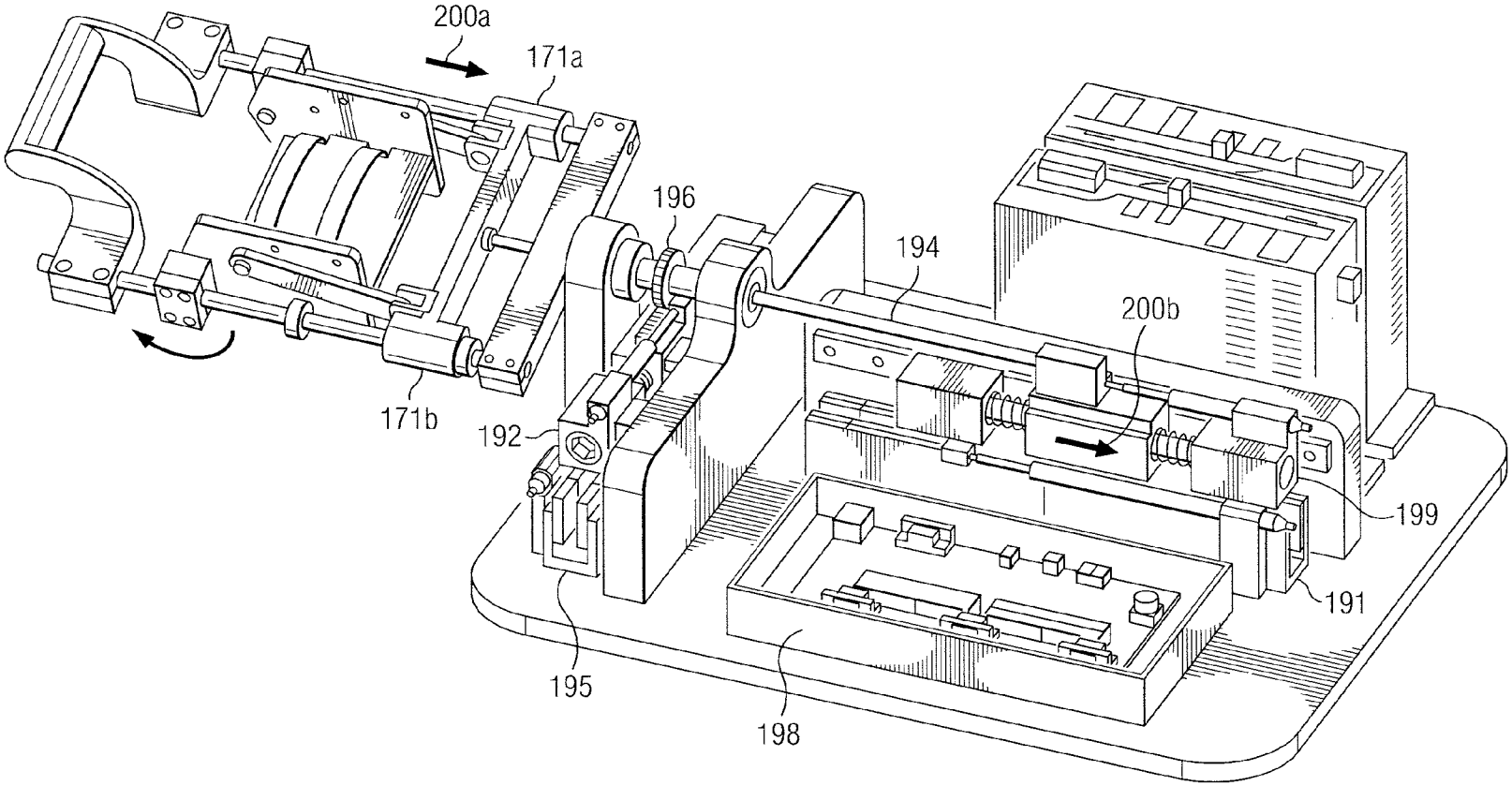
FIG. 38A shows the two degree-of-freedom hand rehabilitation system in FIG. 37 when the handle assembly is in the fully released position.
Figure 38B:
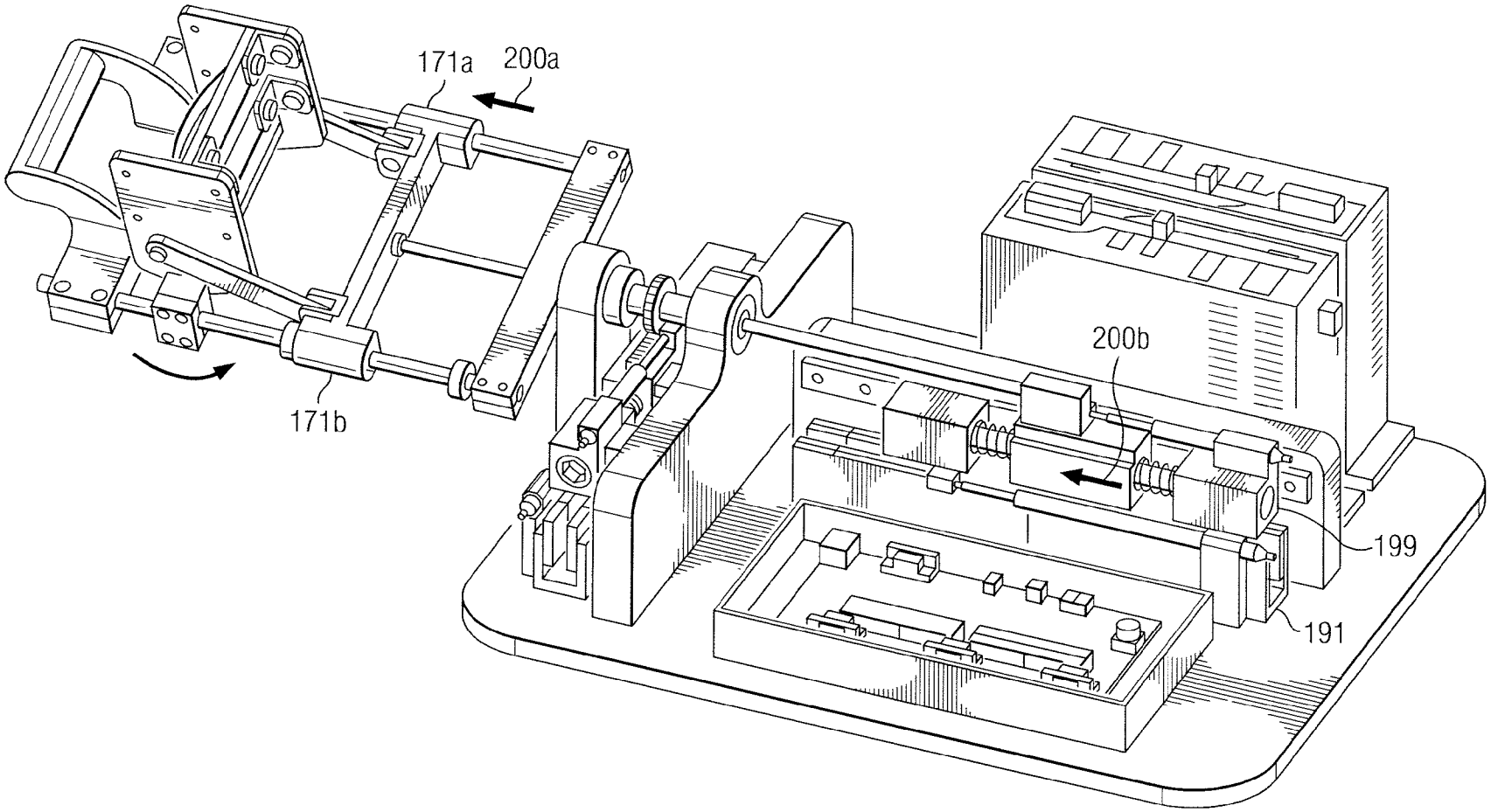
FIG. 38B shows the two degree-of-freedom hand rehabilitation system in FIG. 37 when the handle assembly is in the grasped position.

For example, FIG. 38A shows a handle assembly 193 that is in the fully-released position, which is to say that the patient/user's hand is fully opened. As shown, when fully-released, the sliding locks 171*a* and 171*b* move in the direction of the arrow 200*a*, causing the shaft 194 to force the force sensor 199 in the same direction 200*b*. FIG. 38B shows a handle assembly 193 that is in the fully-grasped position, which is to say that the hand is fully or substantially closed. In contrast with the fully-released position, the sliding locks 171*a* and 171*b* move in the direction of the arrow 200*a*, causing the shaft 194 to pull the force sensor 199 in the same direction 200*b*.

Figure 39A:
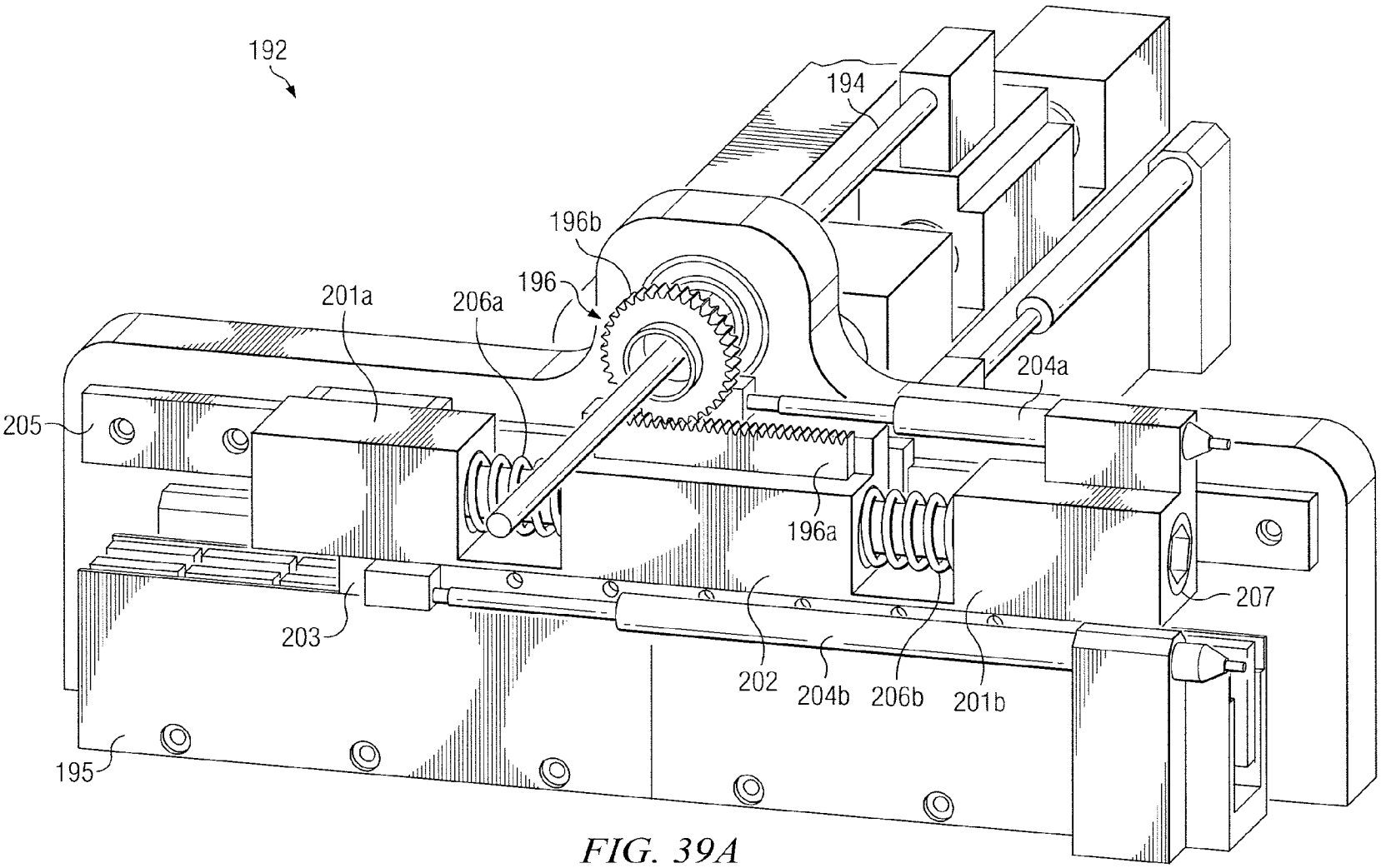
FIG. 39A shows a diagrammatic view of the linear motor actuator for the rotary degree of freedom.
Figure 39B:
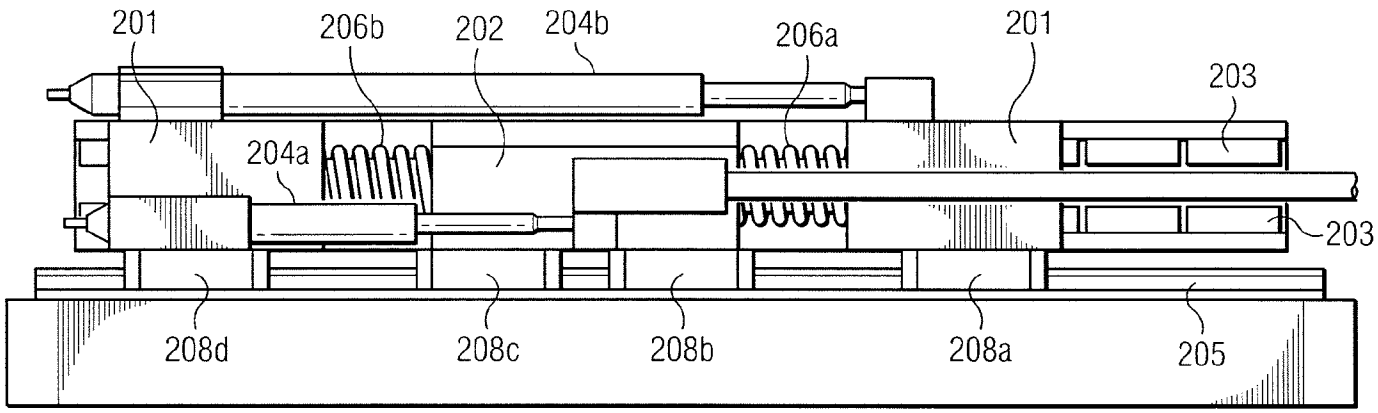
FIG. 39B shows a detail of the linear motor actuator shown in FIG. 39A.
Figure 39C:
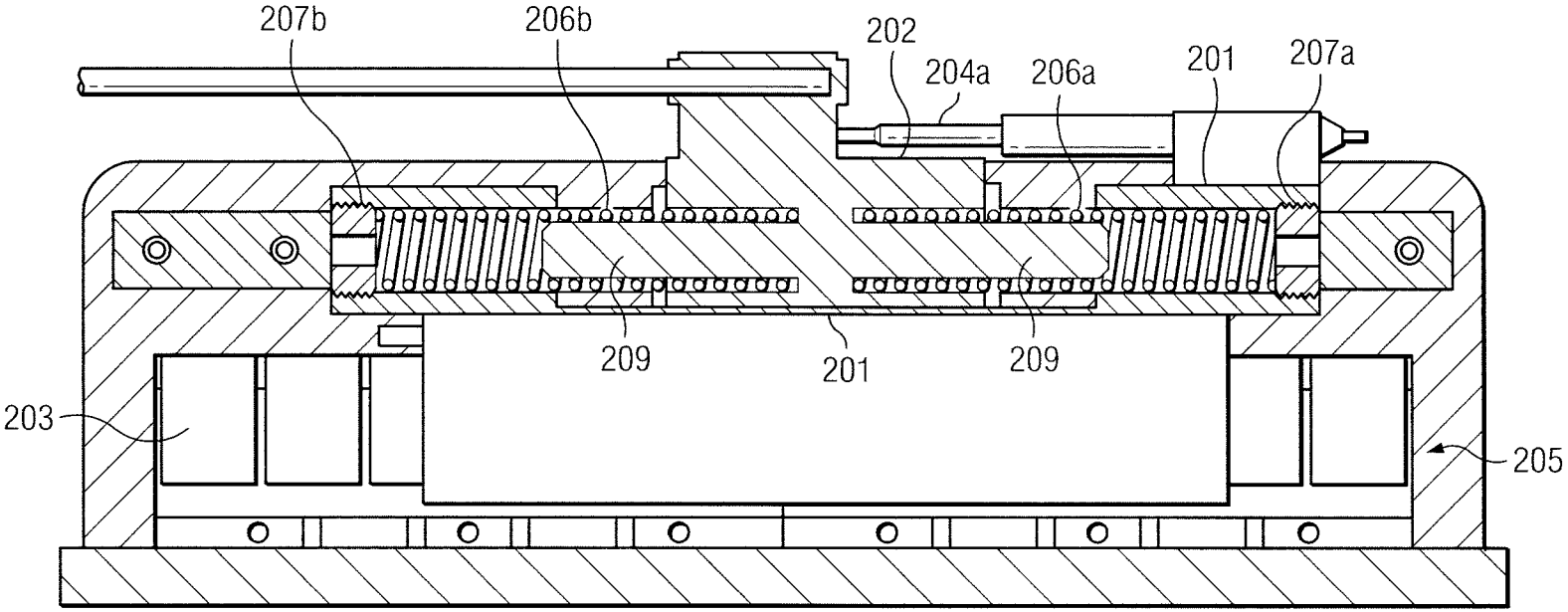
FIG. 39C shows a cross-section of the linear motor actuator shown in FIG. 39A.

As mentioned above, a linear drive actuator with a rack-and-pinion device 196 is provided to convert rotary motion of the handle assembly 193 into a linear motion. Referring to FIGS. 39A, 39B, and 39C, the linear actuator for the rotary degree-of-freedom, includes a base portion having a guide rail 205 onto which a plurality of guide blocks 208 can be slidably affixed. The guide blocks 208 provide a rigid, low-friction platform for mounting the sensor stages 201 and 202. Each sensor stage 201 and 202 is independently adjustable on the guide blocks 208 and the guide rail 205 to facilitate aligning the rack-and-pinion device 196 with the linear motor coil/magnet 195.

For example, a first end 201*a* of the outer sensor stage 201 is fixedly attached to a first guide block 208*a*, an inner sensor stage 202 is fixedly attached to a second and to a third guide blocks 208*b* and 208*c*, and a second end 201*b* of the outer sensor stage 201 is fixedly attached to a fourth guide block 208*d*. The outer sensor stage 201 is mechanically coupled to the linear motor 195 so that any force applied by the linear motor 195 results in displacement of the outer sensor stage 201.

The force sensor 192 includes a first spring 206*a* that is disposed about a removable rod 209, between the first end 201*a* of the outer sensor stage 201 and the inner sensor stage 202 and a second spring 206*b* that also is disposed about a removably rod 209, between the inner sensor stage 202 and the second end 201*b* of the outer sensor stage 201. A spring-loaded adjustment screw 207 is provided on at least one end of one of the outer sensor stage 201. In FIG. 39C, spring-loaded adjustment screws 207*a* and 207*b* are provided on the first 201*a* and second ends 201*b* of the outer sensor stage 201, respectively. The spring-loaded adjustment screw 207 ensures that each of the springs 206*a* and 206*b* is compressed a pre-determined distance that is designed to exceed, under any loading condition, the displacement (x) of the inner sensor stage 202. By displacing springs 206*a* and 206*b* of a known spring constant (k), the force (F) can be determined accurately by measuring the relative displacement (x) between the outer and inner sensor stages 201 and 202 and by using Hooke's Law, viz. $F=k*x$.

For measuring displacement between the second end 201*b* of the outer sensor stage 201 and the inner sensor stage 202, a first sensing device 204*a*, e.g., linear potentiometer, is fixedly attached to each of the second end 201*b* and the inner sensor stage 202. The rack portion 196*a* of the rack-and-pinion device 196 is also fixedly attached to an inner sensor stage 202. As a result, any torque applied to the actuator shaft 194 will cause the rack portion 196*a* and the inner sensor stage 202 to which it is attached to translate in a linear direction depending on whether the pinion portion 196*b* is rotated clockwise or counterclockwise.

Translation of the inner sensor stage 202 along the guide rail 205 in response to the torque places further compresses either the first or the second spring 206*a* or 206*b*. The linear potentiometer 201*b* measures the displacement associated with the compression or that associated with the tension, which should be equal in a linearly elastic system. Knowing the spring constant (k) and the displacement (x), a force (F) can be calculated using Hooke's law.

When resistive force is purposely added to the linear motor 195, absent an equal and opposite force, the applied resistive force can cause the outer sensor stage 201 to displace along the guide rail 205. Accordingly, in order to measure the absolute position of the inner sensor stage 202, which can be used to determine the handle assembly angle (for a rotary actuator) or the grip position (for a linear system), a relative position measurement between the first end 201*a* and the case of the linear motor 195 using a second sensing device 204*b*, i.e., a second linear potentiometer, is needed. The second sensing device 204*b* can be fixedly attached between the first end 201*a* of the outer stage 201 and to the case of the linear motor 195, which should remain stationary or fixed. Adding any displacement measured by the second sensing device 204*b*, which provides a measurement of the motor coil 203 position, to the displacement between the inner sensor stage 202 and the second end 201*b*, provides absolute position.

Robotic interfaces can also include an actuator selected from the group consisting of ball-screw linear actuators, pneumatic actuators, standard hydraulic actuators, geared rotary DC motors, and geared linear DC motors.

Gaming Interface

The adaptation of a three-dimensional gaming interface or engine 152 to a rehabilitation system 150 and its advantages are disclosed and described in greater detail in International Patent Application Number PCT/US2010/021483 filed on Jan. 20, 2010, which claims the benefit of U.S. Provisional Patent Application No. 61/145,825 filed on Jan. 20, 2009 and of U.S. Provisional Patent Application No. 61/266,543, filed Dec. 4, 2009—all three of which are incorporated in their entirety herein by reference. As a result, the gaming interface 152 function will not be described in great detail except to describe how the gaming interface 152 interacts with the other components of the system 150.

A game engine is a software system that is designed for the creation and development of video games. For example, an open source 3D game engine, e.g., Panda3D, can be used in the development of the computer graphics for the rehabilitation system.

Figure 3:
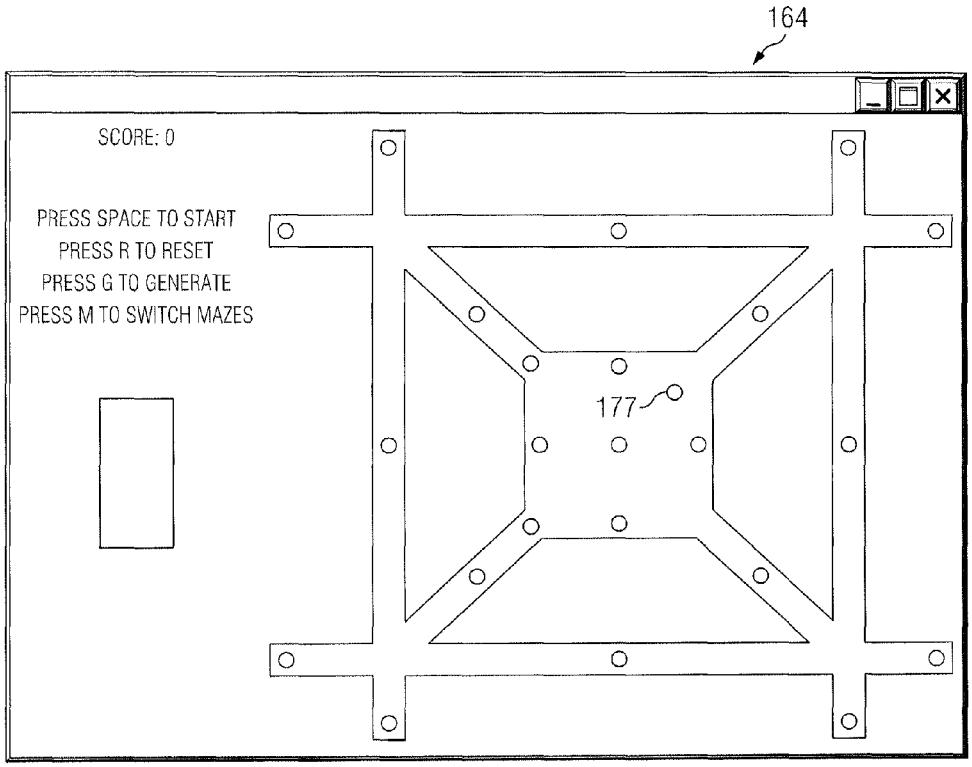
FIG. 3 shows a diagrammatic view of an illustrative maze game that can be run on the gaming engine in accordance with the invention as claimed.

FIG. 3 shows an illustration of an exemplary displayed gaming image 164 that is representative of one of a multiplicity of games or game themes ("scenes") that can be created by a gaming engine and executed (run) by the gaming interface 152 using input data from the 2 DOF robotic interface 151, to drive an icon, cursor, or other figure ("dot" 177) graphically on the screen of the display device 159. The illustrative display 164 is a two-dimensional maze, to which a first DOF of the robotic interface 151 is coupled to a first dimension and a second DOF is coupled to a second dimension. Maze games fall into the category of navigation games, to which can be added pick-and-place games, e.g., chess, checkers, and the like, virtual task games, e.g., turning a virtual doorknob, inserting a virtual key in a lock, flicking on or off a virtual light switch, and so forth, obstacle navigation games in which the patient/user avoids virtual objects, and triggered event games in which a virtual scene forces the patient/user to react to an event being displayed. These games can be computer controlled and can use artificial intelligence to react to patient/user input and induced patient/user reactions.

The graphical patient interface, i.e., the display device 159 with a displayed, interactive game scene, provides a visual, interactive gaming environment for performing therapeutic exercises using the robotic interface 151. The interface provides motivation to the patient/user and real-time feedback, e.g., to the patient/user, a practitioner, a therapist, and the like, concerning the quality of the movements performed by the patient/user, to achieve the motor tasks required to play the games. With such an interface, the patient/user is more motivated to perform visuomotor tasks that are part of the rehabilitation session in the most appropriate and useful way to achieve motor recovery. Moreover, the practitioner, the therapist, and the like can monitor each patient/user's performance and progress to evaluate his/her current state and to design future goals for him/her.

Because the extent and nature of the disability may differ from patient to patient, some patients may have problems with grasp and release movements, while others may have problems with supination and pronation. For this reason, a maze design can be created (or selected from existing designs), that allows practitioners, therapists, and the like to focus the therapy on the desired movements of the patient/user's hand.

With two degrees-of-freedom there are several possibilities for virtual reality scenes. A first possible design is to use a first degree-of-freedom to control the x position and a second degree-of-freedom to control the y position in a Cartesian coordinate system. For example, a grasp/release action can result in, i.e., display, movement in a vertical or y-direction, while pronation/supination motion can result in, i.e., display, movement in a horizontal or x-direction, or vice versa.

A second possible design uses a first degree-of-freedom to control the direction of the dot 177 and the other degree-of-freedom to control velocity of the dot 177. An example of this design would be to use the supination/pronation degree-of-freedom for direction control and the grasp/release degree-of-freedom for velocity.

A third design is not to use either degree-of-freedom for position, direction, or velocity but instead use them to control another aspect of the virtual reality scene. For example, turning a doorknob, moving a checker or a chess piece, inserting a key in a lock, and so forth. In general, the user-controlled position can be directly or indirectly specified. For the direct method, each position of the handle assembly 163 corresponds to a specific position on the screen of the display device 152. When the patient/user moves the handle assembly 163, the represented position follows movement of the handle assembly 163 exactly. For the indirect method, there is an equation of thrust or something similar that drives the represented position.

The representative dot 177 can also be given a mass so that a corresponding friction, inertia, etc. can calculated and added, and the position changes accordingly. The patient/user controls the level and direction of thrust with the handle assembly 163. Force feedback controls the feel of the handles. Either of these methods can be applied to one or both of the degree-of-freedom of the device.

With each game, discrete movements of hand grasp/release and forearm pronation/supination can be pre-programmed to control certain aspects of a game, such as navigating the dot through a virtual, multiple-dimensional environment. Advantageously, the virtual environment provides challenges, requires the performance of visuomotor integration tasks (hand-eye coordination), offers real-time visual feedback, and provides input to the controller 156 so that haptic feedback can also be provided.

A game or a "scene" from a game can be provided in which certain virtual events, e.g., a collision with a surface or an object and so forth, can be detectable during the play of the game and that such collisions or contact with objects prevent or hinder the patient/user's dot from moving freely in the virtual environment. For example, the game engine can read a 1-bit (black and white) bitmap picture file, creating an array of logical values, e.g., TRUE (1) or FALSE (0). For example, a logical value of TRUE (1) can correspond to a black pixel (a wall), and a logical value of FALSE (0) can correspond to a white pixel (a path). As long as the patient/user's dot stays on white pixels, i.e., the path, he/she continues to advance through the maze. Such events limit the movements of hand grasp/release and forearm pronation/supination until the obstacle encountered is negotiated.

Knowledge of results and performance are provided continuously as part of the graphical patient interface, to provide the patient/user with a measure of success as well as to encourage the patient/user to do better and more as rehabilitation progresses. For instance, in a goal-oriented game in which the patient/user accumulates points as he/she navigates through a virtual reality environment and/or collects discrete objects, a reward can be provided for achieving a specific score, e.g., point total, during play of the game.

For example, the patient/user's score can increase as the patient/user achieves goals in the game and performs tasks that are required, and can decrease when the patient/user does not perform the tasks in accordance with the rules of the game. For instance, in a scene, if navigation through a virtual maze in the virtual environment is supposed to occur without collisions, the patient/user receives no points and/or losses some or all of the points that he/she has accumulated in the event of a collision.

Optionally, visual and/or haptic feedback can be provided to notify the patient/user that he/she has suffered a negative event. Different haptic feedback may be created by defining proper relationship between the position of the handle and the forces experienced by the patient/user. Since the force and torque are under accurate closed-loop control, it is possible to emulate the dynamics of many systems. For example, visual and/or haptic feedback can also be used when a task is performed properly. For instance, as a patient/user navigates through the virtual environment and obtains an object or attains an objective, the graphical patient interface can be programmed to provide an encouraging message or similar reward messages on the screen of the display device 159, to encourage the patient/user to keep doing the "right things".

Performance data can also be gathered during the game and, in addition to being provided as real-time feedback to the patient/user, can be collected and stored for a later date and/or time for use, for example, by a therapist, clinician, physician, practitioner, and the like, who is skilled in analyzing the data of the therapeutic session, to plan for further rehabilitation sessions. Performance data relate to the characteristics of the movements performed by the subject while accomplishing tasks required by the video games.

Of particular interest in this context is monitoring compensatory movement, in which the patient/user uses leverage from other parts of his/her body, e.g., "body English", to facilitate the game. One might want to discourage this type of movements. Typical compensatory movements would be leaning forward with the trunk, rotating the trunk while performing a pronation (accompanied by internal rotation of the trunk) or supination (accompanied by external rotation of the trunk) movement of the forearm, flexion of the elbow while closing the hand, etc. Movements of these types can be detected using sensor technology that would be combined with the robotic system. The output of the sensors would allow one to detect the performance of compensatory movements and the game could be modify so as to discourage the subject from relying upon compensatory movements. For instance, in the maze game, the walls of the maze could get closer (thus presenting a narrower path to navigate the maze) when people lean forward while playing the game and could move farther apart (thus offering a wider path) when subjects keep their trunk in an appropriate position.

Negative behaviors, such as the use of compensatory strategies by the patient/user to achieve a motor goal, can also be discouraged by means of both visual and haptic feedback modalities. Haptic feedback is controlled via the game and provided to the patient/user both as increasing "resistance" to aspects of movements that should be corrected as well as by actively "guiding" the patient/user's arm or hand to perform the motor tasks properly.

The theme and number of potential scenes and games are as limitless as the number of computer games that proliferate in the market today. Basically, a rudimentary virtual reality software scene includes a two-dimensional maze. A velocity model is then applied to the patient/user's position or icon. The scenes can be time-based or goal-based.

Depending on the position or relative position of the handles 163*a* and 163*b*, a velocity (vector) and a direction (vector) is applied to the current position or icon. The vector is a combination of the grasp-release motion, which controls y-axis (vertical) velocity, and the supination/pronation motion, which controls x-axis (horizontal) velocity components. These vectors are summed and the resulting vector is applied to the position or icon.

The basic feedback on the handles 163*a* and 163*b* includes simulated springs on the handles to guide the patient/user back to a neutral position; the strength, i.e., spring constant, of the spring action can be adjusted to provide greater resistance; and the like. A myriad of additional scenarios can be added to increase the feedback of the system. For example, a modifier can be added to the force feedback as the patient/user's icon nears the walls, making it more difficult to hit the virtual walls or, alternatively, "steering" the position or icon away from the virtual walls.

A second modifier attaches a mass to the patient/user's position or icon to add inertial effects to the motion. The maze can also include reward/goals and/or traps to avoid in random or specific positions. Rewards and traps work in conjunction with the time- or goal-based scene to motivate patients/users.

To accomplish the above, the gaming interface or the controlling device includes at least one of an algorithm, an application, and at least one driver program that is adapted to provide at least one of a collision detection program to read a bitmap picture that is part of a visuomotor integration task, having a plurality of free movement areas and a plurality of no movement areas, and to determine whether an object that is movable as a function of the two degree-of-freedom input data can move commensurate with said input data if movement is to a free movement area or cannot move commensurate with said input data if movement is to no movement area; an additional force field program that increases resistance in the robotic interface when the object approaches any of the plurality of no movement areas; a force/torque program to modulate the two degree-of-freedom input data to achieve a pre-determined force/torque; a feed-forward program that is based on an inverse model for PID control; a sliding mode control program; a model mismatch program to compensate for any mismatch based on the inverse model; and a haptic interaction program that is adapted to define force/torque using a virtual spring, having a spring constant, and a damper, having a damping constant. With the latter, the spring constant of the virtual spring can be positive so as to maintain the object at a neutral position or can be negative so as to make the object deviate from the neutral position.

External Hydraulic Circuit and Pump Assembly

Referring to FIG. 1, inclusion of an external hydraulic circuit 155 in the system 150 expands the functionality of a smart fluid-based actuator. Indeed, the rehabilitation system 150 can operate in several different modes depending on the type of output that is required. These modes of operation can include: a pure damping/braking mode, a counter-flow mode, and an actuator mode.

In a pure damping/braking mode, the external hydraulic circuit 155 is inactive, or "passive"; hence, all flow of smart fluid through the main valve is driven solely by force-induced movement of the piston or by the rotating member. The system functionality is completely resistive. Backflow through the external hydraulic circuit 155 can be offset by a controllable external manifold 130 and/or reverse pumping action can be offset by the pump assembly 153 (or can be prevented altogether if the pump type does not allow backflow by design).

In a counter-flow mode, the external hydraulic circuit 155 is "active" but the fluid flow direction, which is driven by the hydraulic circuit 155, flows counter to the fluid flow through the main valve, which is driven by the piston or rotating member. This increases the flow rate of the smart fluid though the main valve.

Increased flow rate is particularly helpful when piston velocity is relatively low. Typically, hysteresis effects decrease while the smart fluid changes from a gel to a liquid state. However, artificially increasing the flow rate using the external hydraulic circuit 155 decreases the probability of this happening. In short, in a counter-flow mode, the actuator would operate more like a compressible spring.

Finally, in an actuator mode of operation, the external hydraulic circuit 155 is "active" and the direction of smart fluid flow through the main valve is the same as the flow generated by piston action or rotating member action. The effect of the external hydraulic circuit 155 during actuator mode of operation, is, first, to offset the impedance of the system, e.g., friction, viscosity, and so forth, and, then to change the functionality to that of an actuator at higher levels of activation.

More particularly, the external hydraulic circuit 155 creates a controllable pressure differential sufficient to cause the vane (whether sliding- or fixed-) to rotate. The main valve operates as a controllable bypass with the advantages of a continuously tunable range and fast response time due to its close proximity to the piston or rotating vane(s). Thus, the output of the system is controlled by adjusting the flow rate of the external pump and the pressure drop across the main valve. The ability to adjust/control the pump flow rate and the smart fluid bypass harmoniously allows for precise control of the output force/velocity of the actuator.

Referring to FIG. 6A and FIG. 6B, the hydraulic circuit 155 includes, inter alia, hydraulic lines 41, a volume compensator (not shown), and a pump assembly 153. Optionally, the hydraulic circuit 155 can also include a manifold 130, to control the direction of flow to the actuators 10 and 50 and/or backflow of the smart fluid, and/or to bypass flow to the actuators altogether. The use and need for a manifold 130 (described in greater detail below) depend on the type of pump assembly 153 that is utilized and the response-time requirements for flow direction reversal.

FIGS. 12-16 show various diagrammatic views of a rotary vane pump assembly 90. The pump assembly 90 includes a housing having a lid assembly 91 and a main body 92, a pressure transducer chamber 93 for taking pressure measurements, a pumping mechanism 110, and an output shaft 95. The lid assembly 91 is releasably attached to the main body 92 and, when removed, provides access to the plenum or cavity within the main body 92. As shown in FIG. 12B the lid assembly 91 can include, inter alia, a lid 101 and sealing device, e.g., gasket 102, for providing a tight seal between the lid assembly 91 and the main body 92. A low-friction main bearing 104 is provided to center the drive shaft 95. A sealing device, e.g., shaft seal 103, provides a tight seal between the lid assembly 91 and the output shaft 95, to prevent leakage. A spacer 106 is employed to separate the main bearing 104 from the shaft seal 103. A bearing cover 105 is releasably connectable to the lid 101, to retain the main bearing 105 and shaft seal 103 in place.

Figure 13B:
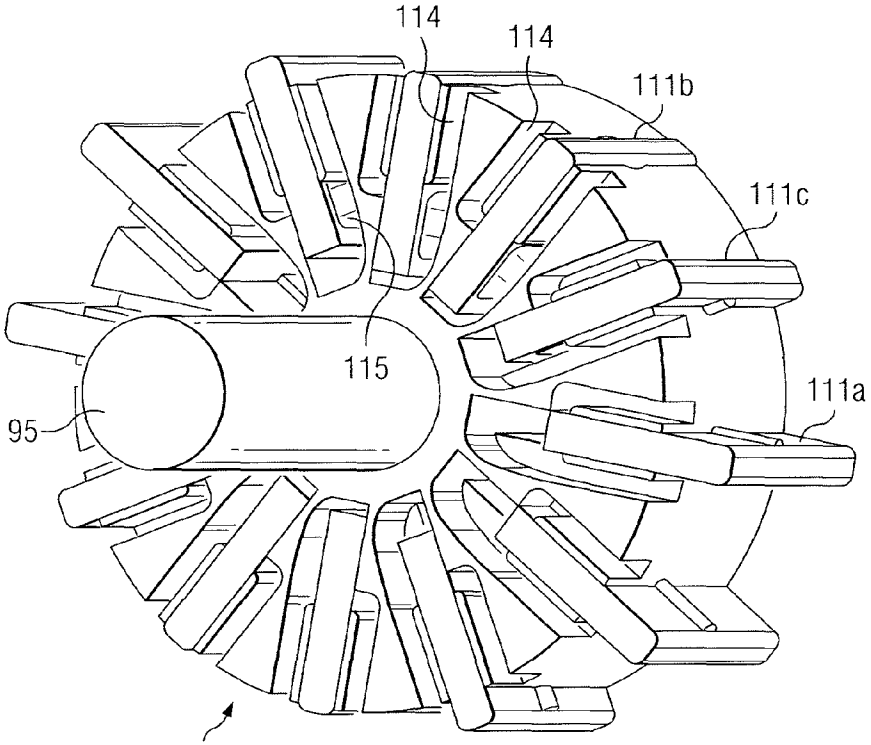
FIGS. 13A and 13B show isometric views of the pumping mechanism disposed within the rotary vane pump assembly shown in FIG. 12A.
Figure 13A:
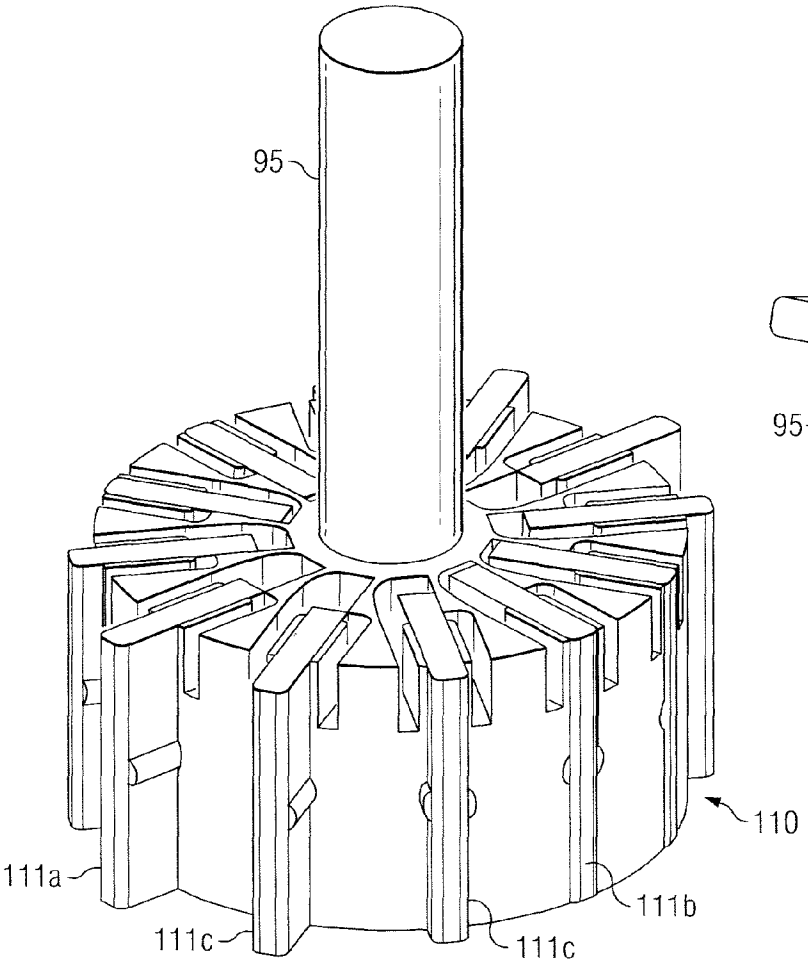
Figure 14:
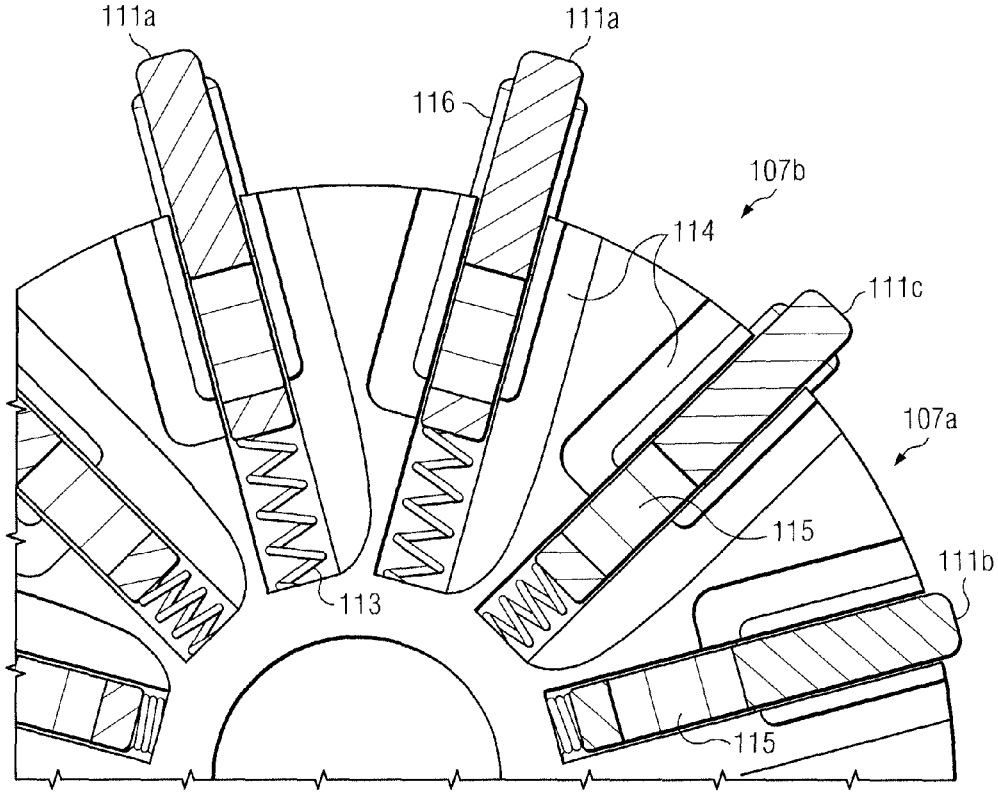
FIG. 14 shows a detail of the pumping mechanism shown in FIGS. 13A and 13B that includes the various operations states of the vanes.

FIGS. 13A, 13B, and 14 show diagrammatic views of the pumping mechanism 110. The pumping mechanism 110 is mechanically coupled to the drive shaft 95 and includes a plurality of vanes 111 that are disposed radially about the axis of the pump drive shaft 95. The vanes 111 are spring loaded to provide translational movement in the radial direction. For example, vane 111*a* shows a fully-extended vane; vane 111*b* shows a fully retracted or depressed vane; and vane 111*c* shows a partially extended (or partially depressed) vane.

Volume compensation channels 114 are provided adjacent to and on either side of each vane 111. Volume compensation channels 114 are structured and arranged to allow fluid to escape from a first pump chamber 107*a* into an adjacent pump chamber 107*b* as a vane 111 is radially depressed. More specifically, as the cam 99 (FIG. 15) forces a vane 111 radially inward, a volume compensation valve 115 corresponding to the vane being depressed 111 connects both sides of the volume compensation chamber, allowing fluid to escape and, thereby, equalizing pressure between adjacent zones. When the vane 111*a* is fully extended, e.g., when it becomes the "active vane", or fully depressed, the volume compensation valve 115 is completely closed.

Figure 16:
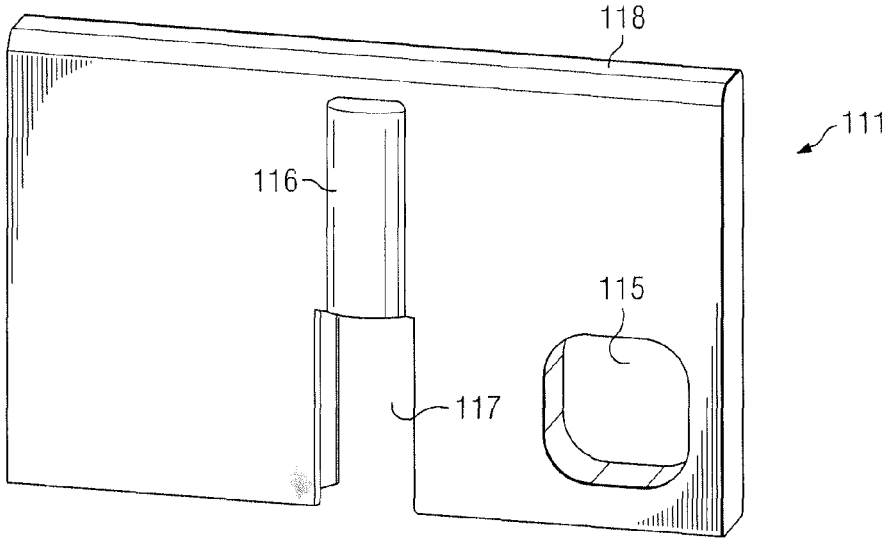
FIG. 16 shows a detail of a vane for the rotary vane pump assembly shown in FIG. 12A.
Figure 17:
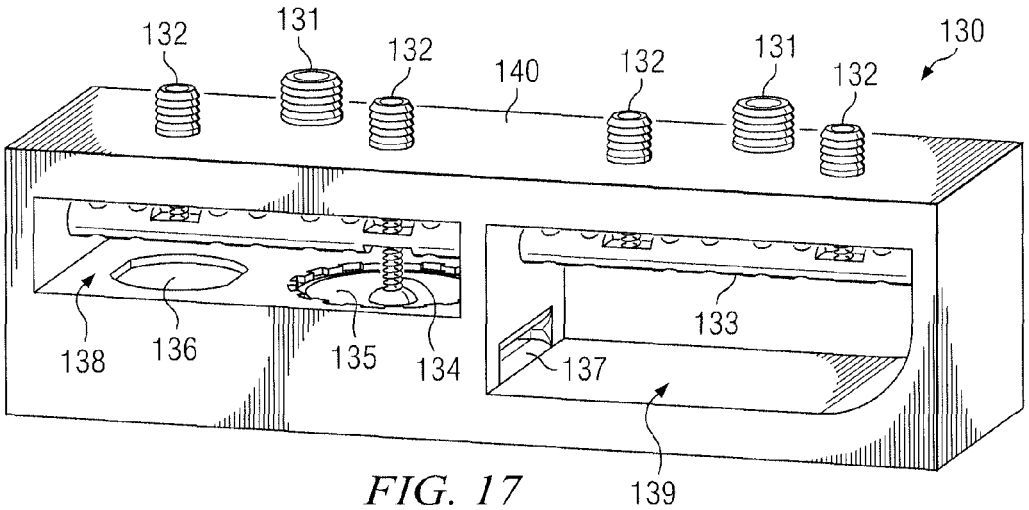
FIG. 17 shows a first diagrammatic view of an optional piezoelectric transducer-based manifold in accordance with the invention as claimed.
Figure 18:
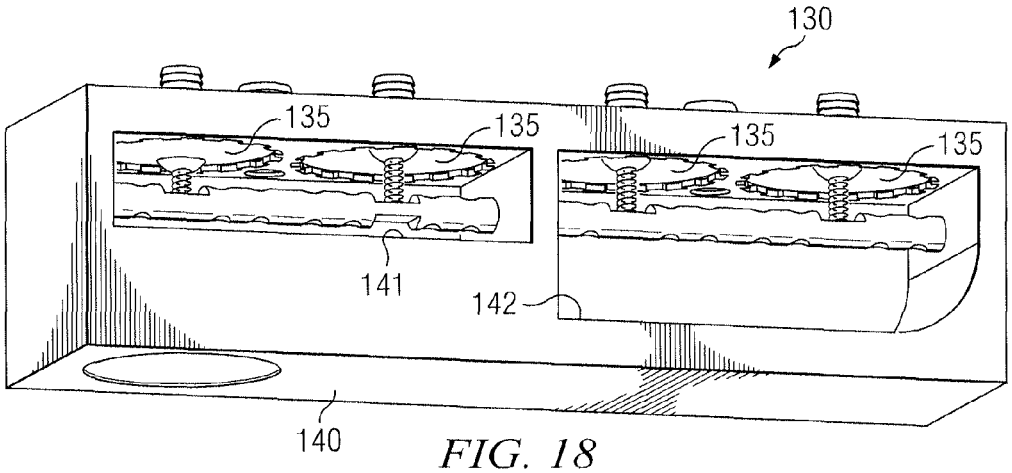
FIG. 18 shows a second diagrammatic view of an optional piezoelectric transducer-based manifold in accordance with the invention as claimed.

FIG. 16 shows a diagrammatic detail of a vane 111. The vane 111 includes a volume compensation valve 115, an alignment feature 116, e.g., a cylindrical alignment feature to keep the vane aligned and in position, and a spring location 117. A small spring (not shown) is disposed in the spring location 117 and biased to hold the distal edge 118 against the periphery of the cam 99 during depression and extension cycles.

Figure 15:
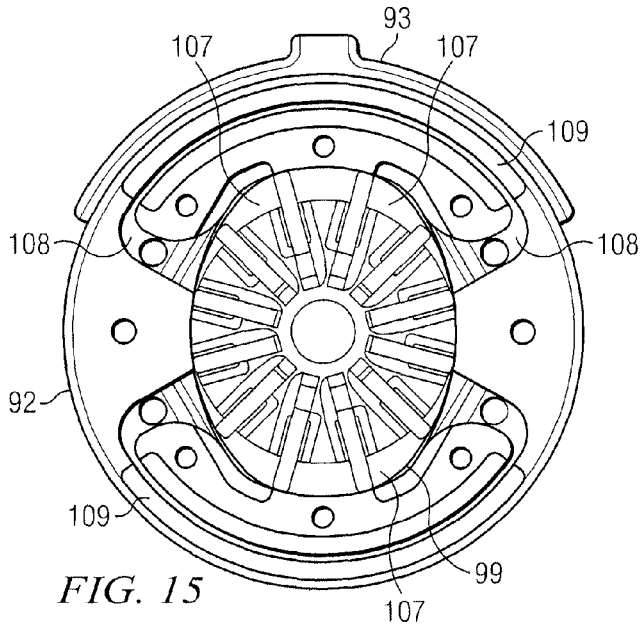
FIG. 15 shows a cross-section of a plan view of the rotary vane pump assembly shown in FIG. 12A.

FIGS. 14 and 15 show the interior components of the pump assembly 90 and the pumping mechanism 110. The pump chambers 107 correspond to zones of positive or negative fluid pressure. Each vane 111 forces fluid into the input/output chambers 108 and into the main valve 109. The pressure transducer runners 93 lead into the input/output chambers.

At the center of the runner 93 is a differential pressure sensor which measures the difference in pressure between adjacent pump chambers 107. The pressure differential (P) multiplied by the area of the exposed vane (A) is equal to the force (F) on the vane 111. This force can be integrated over the radius of the pumping mechanism 110 to provide an estimate of the torque.

Because the individual vanes 111 are constantly moving in and out of the pump chamber 107, a valve system 109 was devised. This valve 109 allows the fluid below the vane 111 to escape into the chamber 107. Because the volume of the fluid below the vane 111 is equal to the volume of the vane 111, the system's volume stays constant which enables the system to operate in a closed manner.

Piezoelectric Transducer-Based, High-Speed, Hydraulic-Control Manifold (Optional)

An (optional) high-speed, hydraulic-control manifold can be integrated into the hydraulic circuit 155, to control the direction and rate of fluid actuation more effectively. Although a manifold 130 can be driven electrically by solenoids, piezoelectric transducers, mechanically by levers or buttons, and so forth, the invention will be described using a piezoelectric transducer-based manifold 130. Advantageously, the piezoelectric transducers can be encapsulated in a compliant material to facilitate both sealing and flexing. Those skilled in the art, however, can appreciate how to adapt alternative driving means in like manner as with the piezoelectric transducers.

Referring to FIGS. 17-23, a manifold 130 comprising a manifold block 140 and having a low-pressure side 138 and a high-pressure side 139 is shown. Each of the low- and high-pressure sides 138 and 139 includes a plurality of (e.g., two) valves 135 that are fluidly coupled to an actuator via inlet/outlet ports 132. Each low- and high-pressure sides 138 and 139 is also fluidly coupled to the hydraulic circuit 155 (and the pump assembly 156) via an inlet/outlet port 131. A bypass 137 provides internal fluid communication between the low-pressures side 138 and the high-pressure side 139. A volume compensator 136 (described in greater detail below) is provided in the low-pressure side 138.

The valves 135 are piezoelectric transducers that are encapsulated in a compliant material to facilitate both sealing and flexing. Biasing member, e.g. springs 134, are mechanically coupled to a stationary rod(s) 133 that is/are disposed within the pressure chamber portions 141 and 142 and are, further, adapted to apply the needed biasing forces to maintain the valves 135 in a normally-closed (NC) position.

Figure 19:
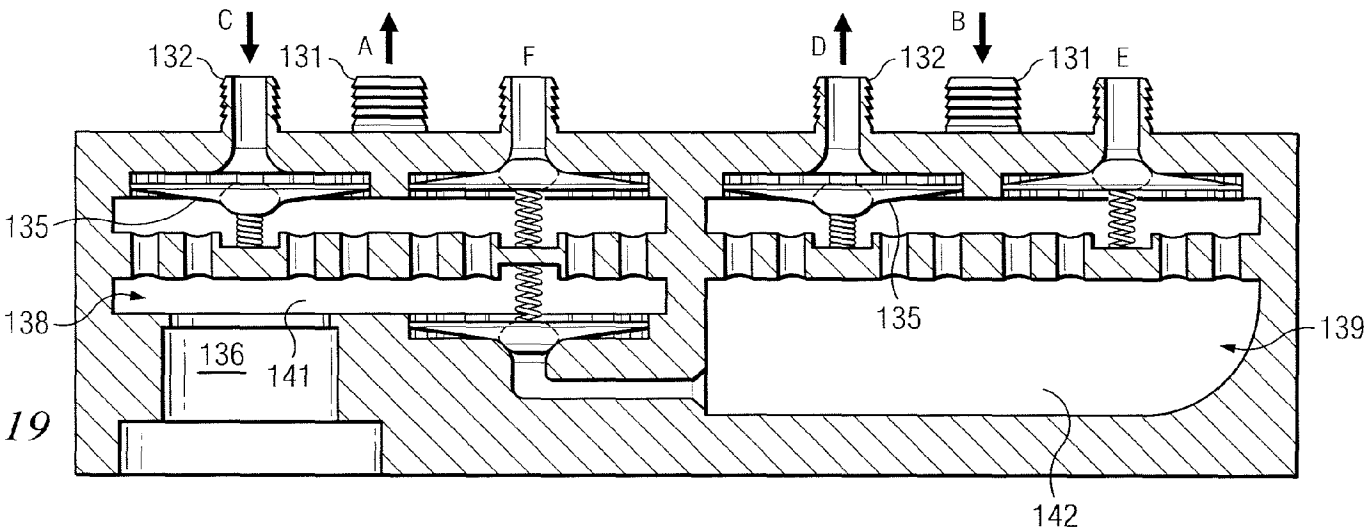
FIG. 19 shows a cross-section view of the manifold shown in FIGS. 17 and 18 that is configured for operation in an actuator mode (forward pumping direction)

Referring to FIG. 19, the operation of the manifold 130 in an actuator mode of operation in a forward direction will be described. Smart control fluid from the hydraulic circuit 155 is pumped into or otherwise flows into the chamber portion 142 of the high-pressure side 139 of the manifold 130 via inlet/outlet port 131 (point B), whence the smart fluid is routed to one or more of the actuators via inlet/outlet port 132 (point D).

Smart fluid returns from the actuator(s) to the low-pressure side 138 of the manifold 130 via inlet/outlet port 132 (point C). The volume compensator 136 in the low-pressure side 138 allows for changes in volume resulting from shaft motion, thermal expansion/contraction of the smart fluid, and the like. The volume compensator 136 can include, for example, a deformable elastic diaphragm that deforms to compensate for the volume change by changing its own volume. After volume compensation is completed, the smart fluid is pumped back into or otherwise flows back into the hydraulic circuit 155, e.g., via inlet/outlet 131 (point A).

Figure 20:
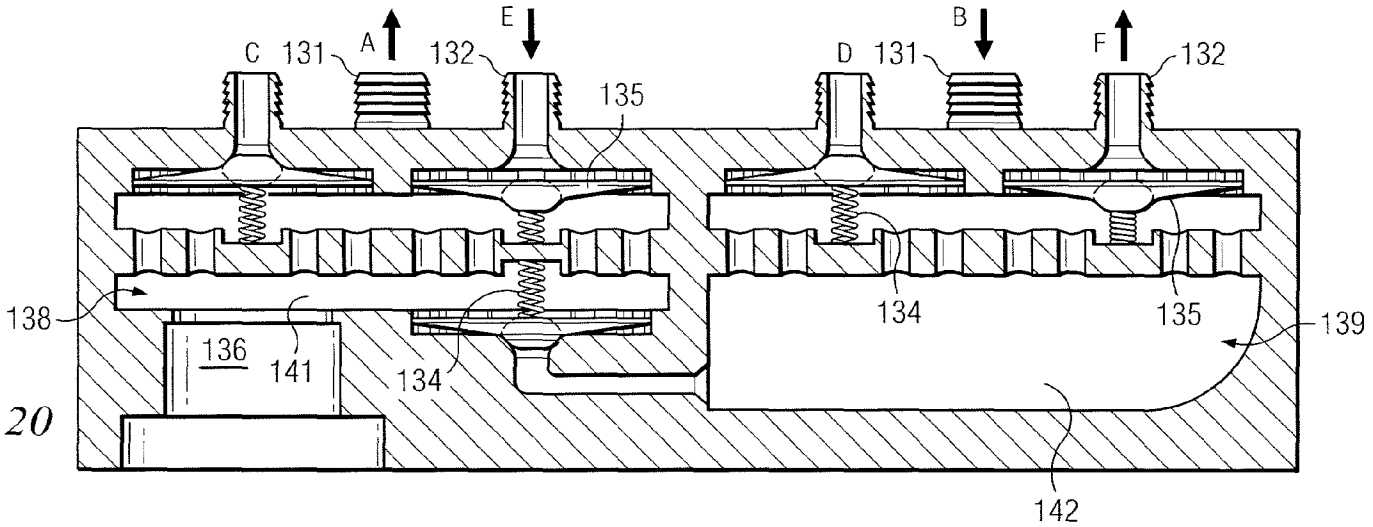
FIG. 20 shows a cross-section view of the manifold shown in FIGS. 17 and 18 that is configured for operation in an actuator mode (reverse pumping direction)

Referring to FIG. 20, the operation of the manifold 130 in an actuator mode of operation in a reverse direction will be described. Smart fluid from the hydraulic circuit 155 again enters the chamber portion 142 of the high-pressure side 139 of the manifold 130 via inlet/outlet port 131 (point B), whence the smart fluid is routed to one or more actuators via inlet/outlet port 132 (point F).

Smart fluid returns to the low-pressure side 138 of the manifold 130 via inlet/outlet port 132 (point E), where the volume compensator 136 allows for changes in volume resulting from shaft motion, thermal expansion/contraction of the smart fluid, and the like. After volume compensation is completed, the smart fluid passes back into the hydraulic circuit 155, e.g., via inlet/outlet 131 (point A).

Figure 21:
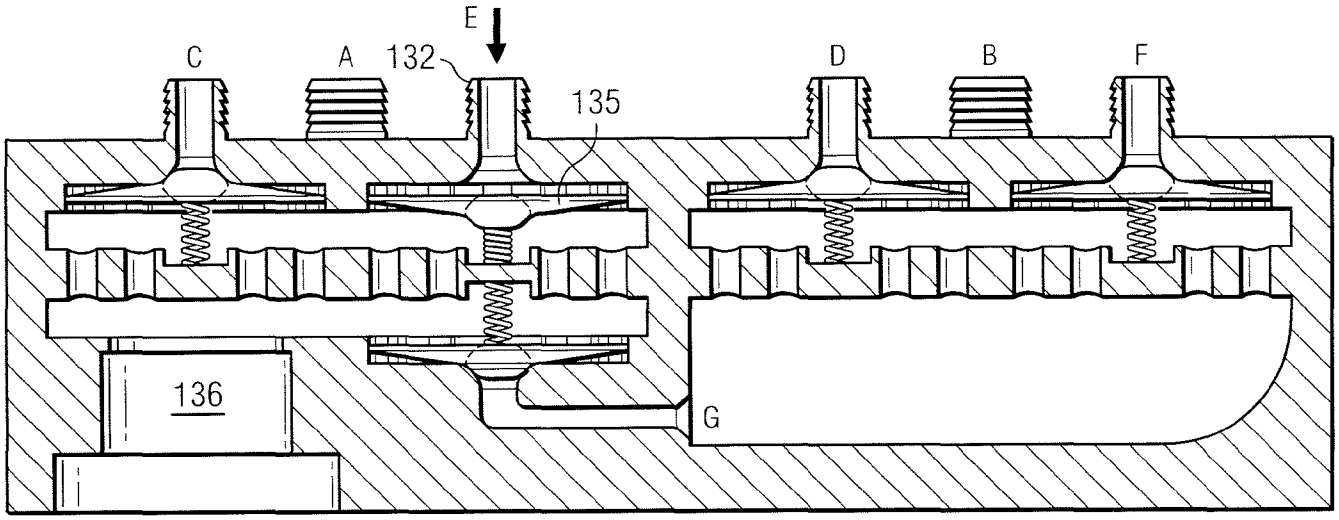
FIG. 21 shows a cross-section view of the manifold shown in FIGS. 17 and 18 that is configured for operation in a damper/brake mode (forward pumping direction)

Referring to FIG. 21, the operation of the manifold 130 in a damper/brake mode of operation in a forward direction will be described. For damping/braking, the high-pressure side 139 is closed off. Smart fluid from the hydraulic circuit 155 enters the chamber portion 141 of the low-pressure side 138 of the manifold 130 via inlet/outlet port 132 (point E) where the volume compensator 136 allows for changes in volume resulting from shaft motion, thermal expansion/contraction of the smart fluid, and the like.

Figure 22:
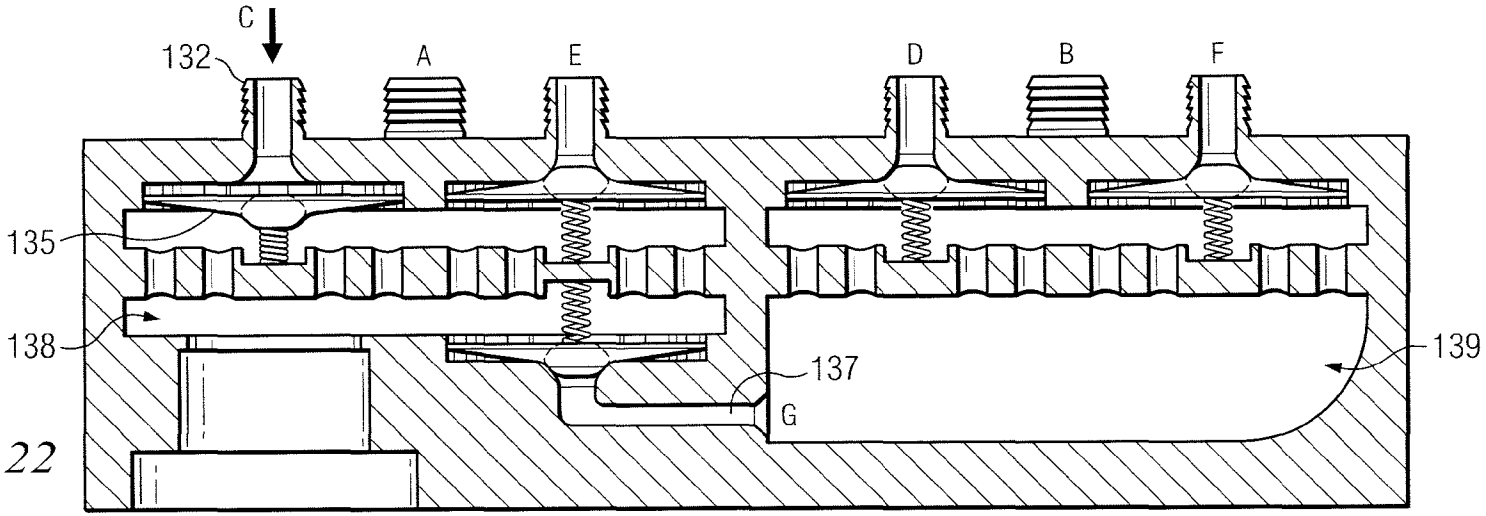
FIG. 22 shows a cross-section view of the manifold shown in FIGS. 17 and 18 that is configured for operation in a damper/brake mode (reverse pumping direction)

Referring to FIG. 22, the operation of the manifold 130 in a damper/brake mode of operation in a reverse direction will be described. For damping/braking, the high-pressure side 139 is again closed off. Smart fluid from the hydraulic circuit 155 enters the chamber portion 141 of the low-pressure side 138 of the manifold 130 via inlet/outlet port 132 (point C) where the volume compensator 136 allows for changes in volume resulting from shaft motion, thermal expansion/contraction of the smart fluid, and the like.

Figure 23:
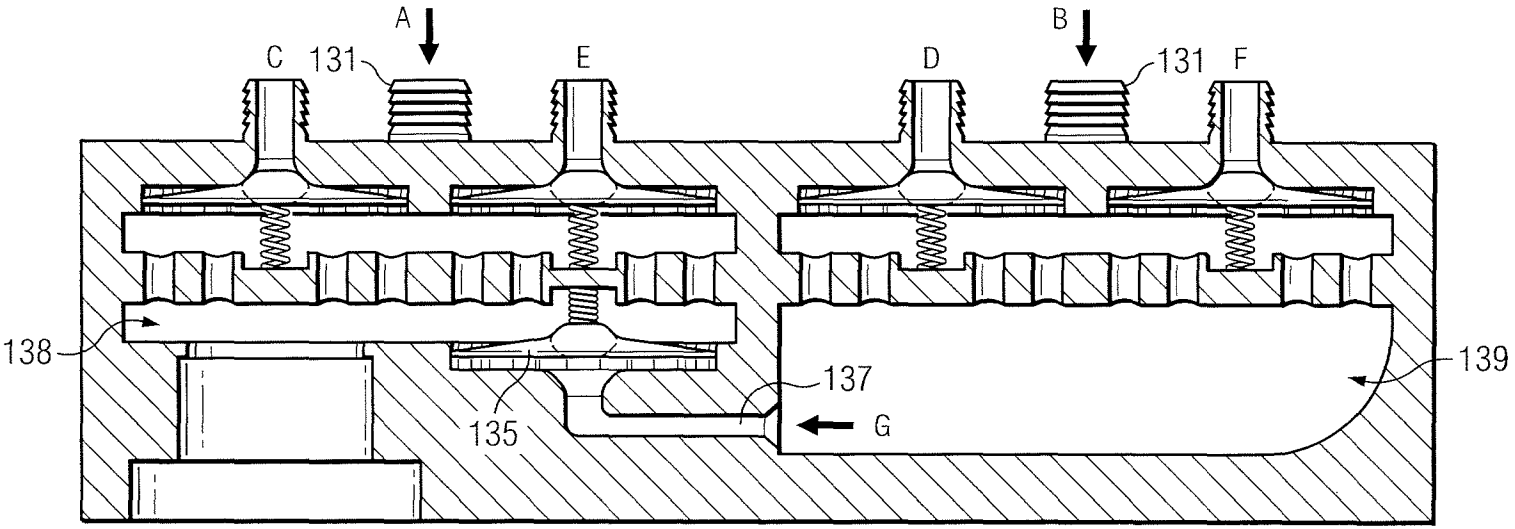
FIG. 23 shows a cross-section view of the manifold shown in FIGS. 17 and 18 that is configured for a bypass mode of operation.

FIG. 23 shows the manifold 130 in a bypass mode of operation. All of the valves 135 in both the low-pressure and high-pressure sides 138 and 139 are closed. Smart fluid from the hydraulic circuit 155 enters the chamber portion 142 of the high-pressure side 139 and travels directly to the chamber portion 141 of the low-pressure side 138 via the bypass 137 (point G) before the smart fluid passes back into the hydraulic circuit 155, e.g., via inlet/outlet 131 (point A).

The bypass mode allows the manifold 130 to react quickly to changing commands/modes while the pump is running. The master flow rate can be controlled both by the pump and by the level of bypass. It should be noted further that the bypass valve 137 as well as the other valves 135 can be proportionally controlled, so that the manifold 130 can operated in a hybrid mode. The hybrid mode combines the principle modes of operation, i.e., actuator, damper, and bypass. Each combined mode and its respective level of pump flow and valving will give the actuator/damper/brake a different "feel".

Power Supply

Depending on whether the smart fluid used is influenced by changes in field strength of a magnetic field or by changes in the field strength of an electric field, the system 150 includes a power supply 154 that provides current or high-voltage, respectively. The invention has been described assuming that the smart fluid is an electro-rheological fluid (ERF); hence, the power source 154 would supply high-voltage to generate an electric field. The selection of ERF is arbitrary and is for illustrative purposes only and is not made to be limiting or exclusive of other smart fluids. Those of ordinary skill in the art can apply the teachings of this disclosure to other smart fluids.

Data Acquisition and Controlling System

Although the gaming engine determines how the rehabilitation system should behave, it is the controller that receives data, e.g., from the sensing devices associated with the robotic interface 151, the hydraulic system 153, the gaming engine 152, and so forth, and that generates signals, e.g., to the patient/user's interface, to the practitioner's interface, and so forth, to ensure that the system functions properly and seamlessly.

Figure 24A:
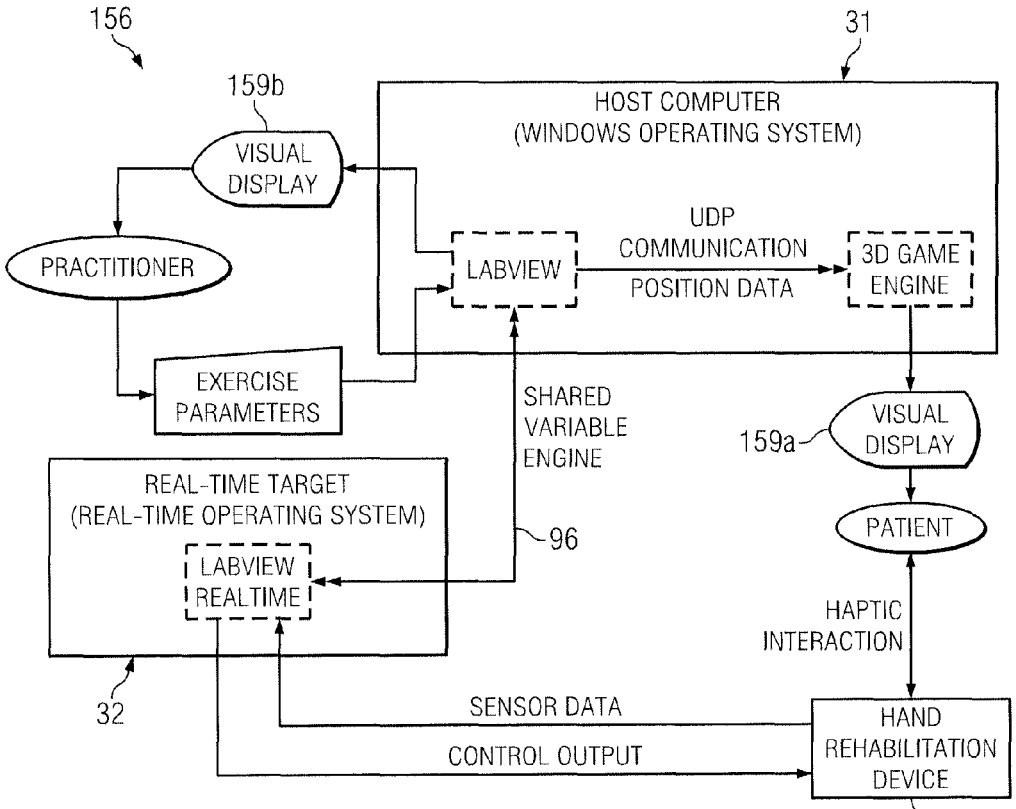
FIGS. 24A and 24B shows frameworks of the controlling system for the rehabilitation system in accordance with the invention as claimed.
Figure 24B:
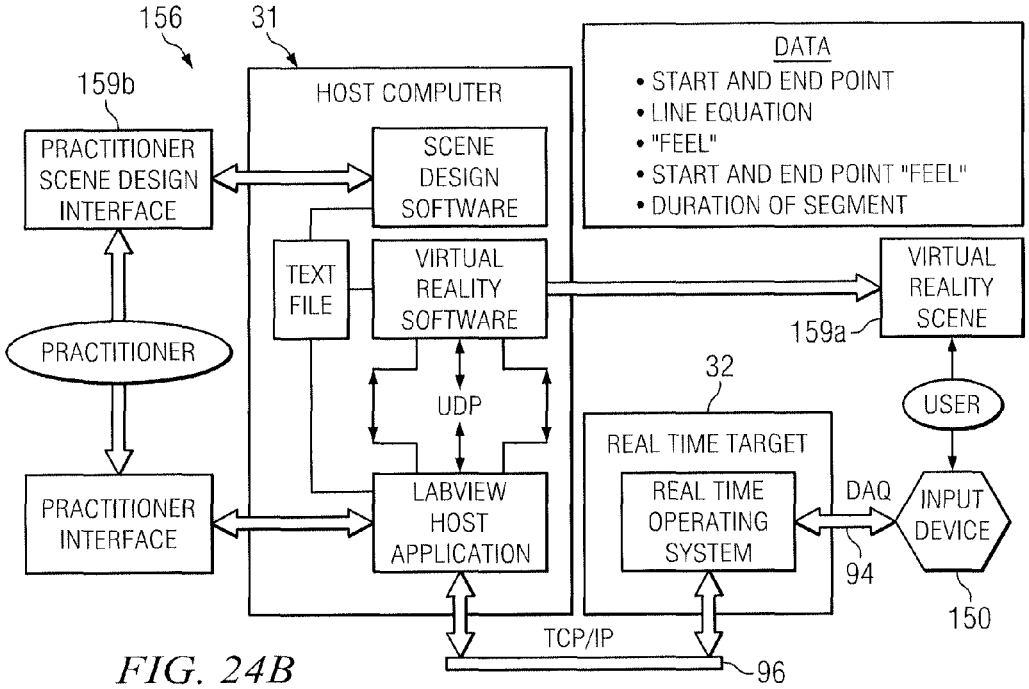
Figure 25:
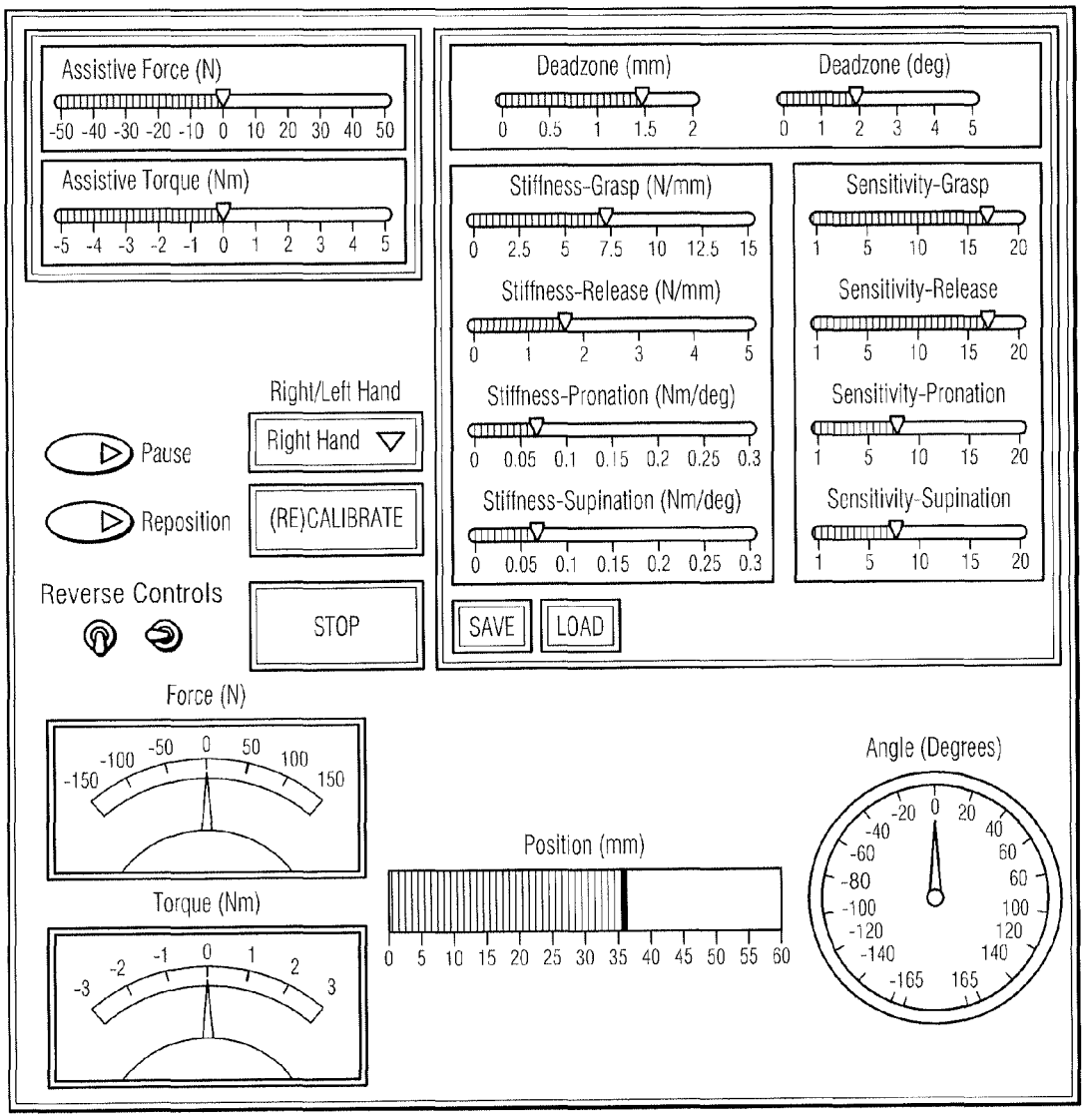
FIG. 25 shows a diagrammatic view of an embodiment of a graphic user interface for the rehabilitation system in accordance with the invention as claimed.

A framework for the controlling system 156 is shown in FIG. 24A and FIG. 24B. The control hardware of the rehabilitation system 150 can include a primary, or "host", controller 31 and a secondary, or "real-time target" (RTT), controller 32. The host controller 31 can be a personal computer, e.g., laptop computer, conventional desk top computer, and the like. The real-time target (RTT) controller 32 should be adapted to run a real-time operating system (RTOS).

More particularly, regular data acquisition (DAQ) hardware running on a general-purpose operating system (OS) e.g., Windows® by Microsoft®, cannot guarantee real-time performance since factors, such as programs running in the background, interrupts, and graphical processes, can compromise performance. In contrast, real-time hardware running a real-time operating system (RTOS) allows a programmer to prioritize tasks so that the most critical task always take control of the processor when needed. This property enables reliable applications with predictable timing characteristics.

The primary controller 31 is structured and arranged to store and/or execute (run) the major software programs needed for the system to operate properly. For example, the software can include software for visualization of a game, e.g., Panda 3D, as well as software for providing communication between the primary 31 and the secondary controllers 32, e.g., LabVIEW.

The host controller 31 further includes hardware or software for displaying patient/user and practitioner graphic user interfaces (GUIs), e.g., on display devices 159*a* and 159*b*. To reduce costs and enhance portability, board level RT targets that feature FPGA chips and single board computers can be used. These solutions offer a significant packaging advantage at the expense of flexibility.

The secondary controller 32 is structured and arranged to control the rehabilitation system 150 itself. To this end, the RTT controller 32 communicates with the rehabilitation system 150 through a data acquisition card 94. A non-exhaustive list of the various functions performed by the secondary controller 32 includes data acquisition, system control, and so forth. The algorithms, software, driver programs, applications and the like of the hand rehabilitation system 150 are run on the real-time platform, i.e., the RTT controller 32, allowing accurate timing characteristics to the system 150.

The RTT controller 32 further communicates with the host controller 31, to transmit data and critical parameters thereto. Communication between the host controller 31 and the RTT controller 32 is via high speed Ethernet 96. Machine code can be developed on the host controller 31, and then deployed to the RTT controller 32. Those of ordinary skill in the art can appreciate that a single controller or more than two controllers may be used. Cost, size, and power requirements, inter alia, will determine an optimal number of controllers.

For example, the force and position sensors that provide data about the actuators transmit output signals to the host controller 31 via the RTT controller 32. In response the host controller 31 routs commands to the various components of the rehabilitation system 150 through the RTT controller 32. For example, the operation of an actuator is controlled by two command inputs: the strength of the electric field applied across the electrodes and the flow rate of the control fluid provided by the pump assembly. Hence, the host controller 31 is adapted to increase/decrease the current or high-voltage from the high-voltage power supply to the electrodes of the actuators 10 and 50 and also to control the speed and direction of the pump assembly 153. The pump assembly 153 facilitates the "active" behavior of the system 150 and the high-voltage power supply 154 provides the electric field (or magnetic field) that controls the behavior of the smart ERF (or MRF).

Figure 40:
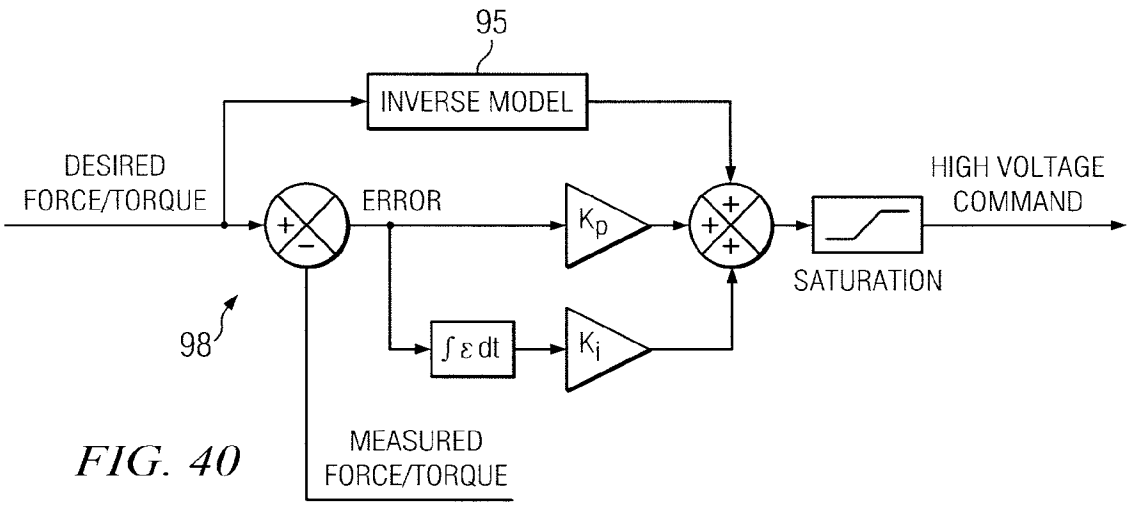
FIG. 40 shows a control diagram for the spring effect of a conventional actuator.

FIG. 40 shows an illustrative control diagram for spring effect of the conventional actuator embodiment shown in FIGS. 37-39. The magnitude of the applied force (F) and the position or relative position (x) of the handle assembly are important variables. As a result, the controller 31 is structured and arranged to provide appropriate input signals to various components of the system 150 that will result in the specified output of the actuator(s).

For example, force (F) is proportional to the displacement (x) of a spring with a known, fixed spring constant (k). hence, once a displacement (x) is measured by the sensing devices, e.g., linear potentiometers, the magnitude of the required force (or torque) can be fed into an inverse model 95 of the system while simultaneously or substantially simultaneously the desired force and the measured force are compared in a proportional feedback controller 98. Results from the proportional feedback controller and the inverse model 95 are combined to provide a needed electric field strength to activate the linear motor. Knowing this, a high-voltage requirement is computed, which the power supply delivers.

In other applications, the host controller 31 is further structured and arranged to include friction compensation, an integral controller for zero steady state error, an adaptive or robust control for guaranteed stability and performance under varying system conditions.

Although the invention is described through the above-described exemplary embodiments, it will be understood by those of ordinary skill in the art that modifications to, and variations of, the illustrated embodiments can be made without departing from the inventive concepts disclosed herein. Accordingly, the invention should not be viewed as limited, except by the scope and spirit of the appended claims.

What we claim is:

1. A multiple degree-of-freedom, rehabilitation system for at least one limb of a patient/user, to improve performance of coordinated movements of said limb, the rehabilitation system comprising:

a multiple degree-of-freedom robotic interface that is movable by said patient/user, to provide at least one of precisely-modulated resistive forces and precisely-modulated motive forces, the robotic interface including:

a first linear actuator having a first linear motor and a first compliant force sensor;

a second linear actuator having a second linear motor, a rack-and-pinion drive, and a second compliant force sensor; and a plurality of sensor stages that are movably attached to a linear guide rail;

a gaming interface that is structured and arranged with a display device to simulate virtual reality and to present visuomotor integration tasks to said patient/user on the display device; and a controlling system that is adapted to control operation of the rehabilitation system, the controlling system including at least one of:

a device for displaying visuomotor integration tasks or a virtual-reality simulation to at least one of the patient/user and a third party on the display device based on coordinated movements of at least one limb of the patient/user when interacting with the robotic interface;

memory for storing input data of multiple degree-of-freedom movement from the robotic interface; and a processor for calculating parameter changes to vary at least one of the resistive forces and the motive forces.

2. The rehabilitation system as recited in claim 1, wherein the coordinated movements are selected from the group consisting of active movements, assisted movements, movements against resistance, forearm pronation movements, forearm supination movements, hand grasp movements, hand release movements, and isolated finger movements.

3. The rehabilitation system as recited in claim 1, wherein the robotic interface includes at least one sensing device for sensing at least one of force, load, torque, angular displacement, angular velocity, displacement, and position.

4. The rehabilitation system as recited in claim 3, wherein the controlling system is adapted to monitor output from each of the at least one sensing device continuously and to make adjustments to the rehabilitation system based on said output.

5. The rehabilitation system as recited in claim 1, wherein the plurality of sensor stages includes:

an outer sensor stage having a first end and a second end; and an inner sensor stage that is disposed between the first and second ends of the outer sensor stage, a first spring being disposed between the first end of the outer sensor stage and the inner stage and a second spring being disposed between the second end of the outer sensor stage and the inner stage.

6. The rehabilitation system as recited in claim 5, wherein each of the first spring and the second spring rests on a set screw, each of which is adapted to include a preload force to a corresponding first spring and/or second spring.

7. The rehabilitation system as recited in claim 5, wherein the inner sensor stage is fixedly attached to a rack portion of the rack-and-pinion drive.

8. The rehabilitation system as recited in claim 7, wherein a first, force sensing device is fixedly attached between the second end of the outer sensor stage and the inner sensor stage so that any movement of the rack portion of the pack-and-pinion drive displaces the inner sensor stage with respect to the second end of the outer sensor stage.

9. The rehabilitation system as recited in claim 5, wherein a second, position sensing device is fixedly attached to the first end of the outer sensor stage and to a case portion of the second linear motor.

10. The rehabilitation system as recited in claim 5, wherein each of the first and second linear motors are actuated to provide resistance or motive force to the outer sensor stage.

11. The rehabilitation system as recited in claim 1, wherein the first linear motor and the second linear motor are linear, brushless servomotors.

12. The rehabilitation system as recited in claim 1, further comprising a power supply, the power supply adapted to provide at least one of a high-voltage power or a variable current.

13. The rehabilitation system as recited in claim 1, wherein the system is constructed to be Magnetic Resonance Imaging (MRI) compatible.

14. The rehabilitation system as recited in claim 1, wherein the controlling system includes a first processing device and a second processing device that are adapted to inter-communicate, the first processing device providing a real-time operating system that is electrically coupled to the interface device to receive data signals therefrom and to transmit control data thereto; and the second processing device providing a hosting function and that is adapted to communicate with and between at least one of said first processing device, a patient/user's graphical display device, and a third-party graphical display device.

15. The rehabilitation system as recited in claim 14, wherein the third-party graphical display device includes a graphical user interface to allow the third-party to customize performance parameters of the robotic interface.

16. The rehabilitation system as recited in claim 1, wherein the gaming interface includes:

at least one input/output device that is structured and arranged to enable the patient/user to interact with software being executed on the gaming interface; and a display device that is adapted to display graphical images that are representative of the patient/user's manipulation of the robotic interface.

17. The rehabilitation system as recited in claim 1, wherein sensors are positioned on the patient/user to monitor compensatory strategies used by said patient/user to facilitate performance of a task.

18. The rehabilitation system as recited in claim 17, wherein the system includes a device that is structured and arranged to adjust the system to discourage the patient/user from using compensatory strategies.

19. The rehabilitation system as recited in claim 1, wherein components of the system are attached to a robotic device or a rehabilitation device that allows the patient/user to perform upper extremity exercises that include reaching for and manipulation of objects, to provide a platform to achieve coordinated movements of proximal and distal joints.

20. A multiple degree-of-freedom, rehabilitation system for at least one limb of a patient/user, to improve performance of coordinated movements of said limb, the rehabilitation system comprising:

a multiple degree-of-freedom robotic interface that is movable by said patient/user, to provide at least one of precisely-modulated resistive forces and precisely-modulated motive forces;

a gaming interface that is structured and arranged with a display device to simulate virtual reality and to present visuomotor integration tasks to said patient/user on the display device;

a controlling system that is adapted to control operation of the rehabilitation system, the controlling system including at least one of:

a device for displaying visuomotor integration tasks or a virtual-reality simulation to at least one of the patient/user and a third party on the display device based on coordinated movements of at least one limb of the patient/user when interacting with the robotic interface;

memory for storing input data of multiple degree-of-freedom movement from the robotic interface; and a processor for calculating parameter changes to vary at least one of the resistive forces and the motive forces;

the system further comprising an external hydraulic circuit for controllably distributing a smart fluid or control fluid to the robotic interface;

the external hydraulic circuit including at least one of:

at least one pump assembly;

a plurality of hydraulic lines that are fluidly coupled between each of the at least one pump assembly and at least one actuator portion of the robotic interface; and at least one sensing device; and the system still further comprising a manifold, wherein the manifold is driven by piezoelectric transducer-based valves that are encapsulated in a compliant material to facilitate both sealing and flexing.

21. The rehabilitation system as recited in claim 20, wherein the manifold is structured and arranged to provide an operating mode selected from the group comprising an actuator mode with a forward pumping direction, an actuator mode with a reverse pumping direction, a braking/damping mode with a forward pumping direction, a braking/damping mode with a reverse pumping direction or a bypass mode.

22. The rehabilitation system as recited in claim 20, wherein the robotic interface includes:

a first, smart fluid-based actuator that is structured and arranged to provide linear actuation; and a second, smart fluid-based actuator that is structured and arranged to provide linear actuation, the first and second actuators being disposed perpendicular or substantially perpendicular to each other.

23. The rehabilitation system as recited in claim 20, wherein the robotic interface includes an actuator selected from the group consisting of ball-screw linear actuators, pneumatic actuators, standard hydraulic actuators, geared rotary DC motors, and geared linear DC motors.

24. The rehabilitation system as recited in claim 20, wherein the robotic interface includes:

a first, smart fluid-based actuator that is structured and arranged to provide one of linear actuation and rotary actuation; and a second, smart fluid-based actuator that is structured and arranged to provide one of linear actuation and rotary actuation.

25. The rehabilitation system as recited in claim 24, wherein the first and second smart fluid-based actuators are positioned in-line with respect to each other and/or concentric with one another.

26. The rehabilitation system as recited in claim 24, wherein the first and second smart fluid-based actuators comprise a multiple degree-of-freedom, multi-mode actuator that is capable of operating in at least one of a pure damping mode, a pure braking mode, and a pure actuation mode.

27. The rehabilitation system as recited in claim 24, wherein each of the first and second smart fluid-based actuators provides linear actuation.

28. The rehabilitation system as recited in claim 24, wherein the first smart fluid-based actuator provides linear actuation and the second smart fluid-based actuator provides rotary actuation.

29. The rehabilitation system as recited in claim 24, wherein the smart fluid is selected from the group consisting of magneto-rheological fluid (MRF) and electro-rheological fluid (ERF).

30. A multiple degree-of-freedom, rehabilitation system for at least one limb of a patient/user, to improve performance of coordinated movements of said limb, the rehabilitation system comprising:

a multiple degree-of-freedom robotic interface that is movable by said patient/user, to provide at least one of precisely-modulated resistive forces and precisely-modulated motive forces;

a gaming interface that is structured and arranged with a display device to simulate virtual reality and to present visuomotor integration tasks to said patient/user on the display device; and a controlling system that is adapted to control operation of the rehabilitation system, the controlling system including at least one of:

a device for displaying visuomotor integration tasks or a virtual-reality simulation to at least one of the patient/user and a third party on the display device based on coordinated movements of at least one limb of the patient/user when interacting with the robotic interface;

memory for storing input data of multiple degree-of-freedom movement from the robotic interface; and a processor for calculating parameter changes to vary at least one of the resistive forces and the motive forces;

wherein the controlling system includes at least one of an algorithm, an application, and at least one driver program that is adapted to provide a haptic interaction program that is adapted to define force/torque using a virtual spring, having a spring constant, and a damper, having a damping constant, wherein the spring constant of the virtual spring can be positive so as to maintain the object at a neutral position or can be negative so as to make the object deviate from the neutral position.

31. A multiple degree-of-freedom, rehabilitation system for at least one limb of a patient/user, to improve performance of coordinated movements of said limb, the rehabilitation system comprising:

a multiple degree-of-freedom robotic interface that is movable by said patient/user, to provide at least one of precisely-modulated resistive forces and precisely-modulated motive forces;

a gaming interface that is structured and arranged with a display device to simulate virtual reality and to present visuomotor integration tasks to said patient/user on the display device; and a controlling system that is adapted to control operation of the rehabilitation system, the controlling system including at least one of:

a device for displaying visuomotor integration tasks or a virtual-reality simulation to at least one of the patient/user and a third party on the display device based on coordinated movements of at least one limb of the patient/user when interacting with the robotic interface;

memory for storing input data of multiple degree-of-freedom movement from the robotic interface; and a processor for calculating parameter changes to vary at least one of the resistive forces and the motive forces;

the system further comprising an external hydraulic circuit for controllably distributing a smart fluid or control fluid to the robotic interface;

the external hydraulic circuit including at least one of:

at least one pump assembly;

a plurality of hydraulic lines that are fluidly coupled between each of the at least one pump assembly and at least one actuator portion of the robotic interface; and at least one sensing device; and the system still further comprising a manifold, wherein the manifold includes:

a high-pressure side that is fluidly coupled to the hydraulic circuit and to at least one actuator; and a low-pressure side having a volume compensator, the low-pressure side being fluidly coupled to the hydraulic circuit, to at least one actuator, and to the high-pressure side via a bypass.

* * * * *